US010893730B2

(12) United States Patent
Adler et al.

(10) Patent No.: US 10,893,730 B2
(45) Date of Patent: Jan. 19, 2021

(54) HEALTH CARE KITS, CARE PACKS, AND METHODS THEREFOR

(71) Applicant: Medline Industries, Inc., Mundelein, IL (US)

(72) Inventors: Deborah B. Adler, New York, NY (US); Susan Macinnes, Trout Valley, IL (US); Yayun Huang, Rego Park, NY (US)

(73) Assignee: Medline Industries, Inc., Northfield, IL (US)

( * ) Notice: Subject to any disclaimer, the term of this patent is extended or adjusted under 35 U.S.C. 154(b) by 1850 days.

(21) Appl. No.: 14/208,631

(22) Filed: Mar. 13, 2014

(65) Prior Publication Data

US 2014/0262851 A1 Sep. 18, 2014

Related U.S. Application Data

(60) Provisional application No. 61/781,849, filed on Mar. 14, 2013.

(51) Int. Cl.

| | |
|---|---|
| ***A45C 7/00*** | (2006.01) |
| ***A45C 11/24*** | (2006.01) |
| ***A45C 11/00*** | (2006.01) |

(52) U.S. Cl.

CPC ..... *A45C 7/0095* (2013.01); *A45C 11/008* (2013.01); *A45C 11/24* (2013.01); *A45C 2011/007* (2013.01); *Y10T 29/49826* (2015.01)

(58) Field of Classification Search

CPC ..... A45C 7/0095; A45C 11/008; A45C 11/24; A45C 2011/007; Y10T 29/49826

USPC ..... 206/5, 6, 6.1, 38, 223, 281, 438, 479, 206/581; 190/102, 107–110, 901; 150/104, 113, 117; D9/414, 431; D3/201, 233, 243, 298, 902

See application file for complete search history.

(56) References Cited

U.S. PATENT DOCUMENTS 185,181 A * 12/1876 Keeney ..... A45C 3/00 190/111
770,354 A * 9/1904 Corpman ..... A45C 3/00 223/108
791,598 A * 6/1905 Woodland ..... B65D 33/14 383/22

(Continued)

OTHER PUBLICATIONS

Oh, Eung G., "PCT Search Report", PCT/US2014/028280; filed Mar. 14, 2014; dated Jul. 4, 2014.

(Continued)

*Primary Examiner* — J. Gregory Pickett
*Assistant Examiner* — Brijesh V. Patel
(74) *Attorney, Agent, or Firm* — Philip H. Burrus, IV

(57) ABSTRACT

Healthcare kits and care packs are provided. A pack (4000) can include a container (4001) and a branding sleeve (4002). The pack can include a pair of flaps (4200, 4800) to close each end. The flaps can be prolate spheroid to define a concave end profile when closed and a convex profile when open. Alternatively, a pack (700) can include a base layer (100) and selectively detachable pouches (701, 702). The base layer can selectively fold about the pouches to form a briefcase or suitcase appearance. A fastening extension (116) can selectively hold the base layer in the closed configuration, or can be used as a hanging loop to hang the pack in an open configuration.

17 Claims, 79 Drawing Sheets

(56) References Cited

U.S. PATENT DOCUMENTS 2,711,234 A * 6/1955 Rubens ..... A45C 13/002 190/26
2,754,867 A * 7/1956 Langer ..... B65D 75/42 206/278
2,764,201 A * 9/1956 Whippo ..... A45C 11/008 150/111
2,964,227 A 12/1960 Goldsholl
3,010,571 A 11/1961 Transport
3,120,297 A * 2/1964 Riley ..... A45C 7/0095 190/110
3,729,038 A * 4/1973 Ekeson ..... A45C 7/0045 190/110
3,769,741 A * 11/1973 Hessler ..... A01K 97/06 206/315.11
4,286,714 A * 9/1981 Zdarsky ..... B65D 5/46008 206/526
4,314,635 A * 2/1982 Fraser ..... A45C 3/02 206/232
4,467,551 A * 8/1984 Pulver ..... A01K 97/06 206/315.1
4,598,803 A * 7/1986 Ghiassi ..... A45C 7/0086 190/102
4,738,547 A * 4/1988 Brown ..... A45C 7/0095 383/119
4,852,783 A * 8/1989 Bryden ..... A45C 7/0095 150/149
4,859,084 A * 8/1989 Kaumeyer ..... A45C 3/00 190/903
D303,500 S 9/1989 Colla
5,020,673 A * 6/1991 Adams ..... A45C 3/00 150/112
D317,977 S 7/1991 Felkner et al.
D333,913 S * 3/1993 Tunnan ..... D3/278
D351,730 S 10/1994 Miller et al.
5,413,198 A * 5/1995 Ferris ..... A45C 3/004 190/1
D369,025 S 4/1996 Miller et al.
D385,694 S * 11/1997 Magnussen ..... D3/201
5,706,935 A * 1/1998 Lorton ..... A45C 11/008 150/117
5,752,589 A * 5/1998 Berg ..... B42F 7/02 190/109
5,779,033 A * 7/1998 Roegner ..... A45C 11/16 206/6.1
5,865,233 A * 2/1999 Roegner ..... A45C 1/06 150/104
5,984,092 A * 11/1999 Heard-Willmon ..... A45C 13/02 206/232
D423,771 S 5/2000 Gomez et al.
6,073,769 A * 6/2000 Fulda ..... A45C 11/18 206/455
D433,663 S * 11/2000 Bergh ..... A45C 11/00 D12/415
6,220,436 B1 * 4/2001 Chung ..... A45C 7/0095 206/424
D443,749 S 6/2001 Alburquerque et al.
6,296,094 B1 * 10/2001 Knecht ..... A45C 7/0095 190/107
D461,053 S 8/2002 Heilman et al.
6,481,577 B1 * 11/2002 Roegner ..... A45C 11/00 150/106
D466,297 S 12/2002 Raisner et al.
D471,011 S * 3/2003 Kowalsky ..... A45C 11/00 D3/299
D473,715 S 4/2003 Moldovan
6,547,070 B1 * 4/2003 Kolpin ..... F41C 33/06 190/102
6,578,706 B2 * 6/2003 Thompson ..... A45C 7/0095 206/214
D476,811 S 7/2003 Brookhouse
D481,205 S 10/2003 Parrott et al.
6,634,473 B1 * 10/2003 Wagner ..... A45C 7/009 190/110
D506,066 S 6/2005 Nieves
D518,954 S * 4/2006 Wald ..... A45C 7/0095 D3/273
7,111,733 B1 * 9/2006 Foote ..... A45C 11/26 206/528
D530,078 S 10/2006 Siegal
D564,218 S 3/2008 Bagus
D568,762 S 5/2008 Keberlein
7,451,909 B2 11/2008 Sexton
7,600,619 B2 10/2009 Sapyta
7,735,644 B2 * 6/2010 Sirichai ..... A45F 5/02 206/320
7,798,323 B1 9/2010 McCann et al.
7,854,317 B1 * 12/2010 Hebert ..... A45C 3/06 132/314
7,913,845 B2 3/2011 Velazquez et al.
D640,549 S 6/2011 Atkin et al.
D658,361 S * 5/2012 Kontos ..... D3/203.1
8,312,990 B2 * 11/2012 Gaspari ..... A45C 11/26 206/566
D687,703 S 8/2013 Hannant et al.
D692,663 S 11/2013 Ito et al.
D695,101 S 12/2013 Keberlein et al.
8,607,972 B2 12/2013 Maclean et al.
D703,954 S 5/2014 Zizka
D708,841 S 7/2014 Herbert et al.
D708,842 S 7/2014 Hebert et al.
D711,218 S 8/2014 Jacobs et al.
D715,534 S 10/2014 Reaux
D721,493 S * 1/2015 Godshaw ..... D3/301
D728,359 S 5/2015 Iwegbu
D728,921 S 5/2015 Jones
D730,647 S 6/2015 Thompson
D753,398 S 4/2016 Arami
D754,969 S 5/2016 Godshaw et al.
D761,564 S * 7/2016 Rhodes ..... D3/284
2002/0114539 A1 * 8/2002 Strevey ..... A45C 3/00 383/13
2003/0221978 A1 * 12/2003 Redzisz ..... A45C 11/00 206/278
2005/0011780 A1 1/2005 Simon et al.
2007/0102078 A1 5/2007 Shimp
2009/0014267 A1 * 1/2009 Day ..... A45C 7/0095 190/110
2009/0127045 A1 * 5/2009 Williams ..... A45C 7/0059 190/107
2010/0018820 A1 * 1/2010 Sartee ..... A45C 7/0095 190/102
2011/0268490 A1 11/2011 Acierto et al.
2014/0352858 A1 * 12/2014 DeWitt ..... A45C 13/02 150/110

OTHER PUBLICATIONS

"Online Article", How to Make DIY Handmade Perfume Oils to Give as Gifts for Holiday Stocking Stuffers and Wedding Favors. [online] Published Nov. 10, 2012. Retrieved from URL: <http://soapdelinews.com/2012/11/How-to-Make-DIY-Handmade-Perfume-Oils-to-Give-as-Gifts-for-H.

Koenig, Vy N., "NonFinal OA", U.S. Appl. No. 29/492,055, filed May 28, 2014; dated Jul. 16, 2015.

Koenig, Vy "NonFinal OA", U.S. Appl. No. 29/496,642, filed Jul. 15, 2014; dated Jul. 15, 2015.

"Picture", MediChoice—Quiet Kit; Unknown Publication date but believed to be prior to filing of present application.

"Picture", Dignity Health; Care pack; Unknown publication date but at least as early as Dec. 18, 2012.

Koenig, Vy "Notice of Allowance", U.S. Appl. No. 29/492,055, filed May 28, 2014; dated Jan. 22, 2016.

Koenig, Vy N., "NonFinal OA", U.S. Appl. No. 29/496,642, filed Jul. 15, 2014; dated Jan. 22, 2016.

E-A-R Classic uncorded earplugs by 3M Healthcare; Medline Product Catalog; http://www.medline.com/catalog/catalog.jsp; Unknown Publication date but believed to be prior to present application filed.

(56) References Cited

OTHER PUBLICATIONS

Hemoccult ICT Patient Kit by Beckman Coulter; Medline Product Catalog; http://www.medline.com/catalog/catalog.jsp; Unknown Publication date but believed to be prior to present application filed.
Pedicatric Coloring Book and Crayons; Medline Product Catalog; http://www.medline.com/catalog/catalog.jsp; Unknown Publication date but believed to be prior to present application filed.
Presource Pediatric Kit by Cardinal Health; Medline Product Catalog; http://www.medline.com/catalog/catalog.jsp; Unknown Publication date but believed to be prior to present application filed.
Sleep Aid Kit; Medline Product Catalog; http://www.medline.com/catalog/catalog.jsp; Unknown Publication date but believed to be prior to present application filed.
Koenig, Vy N., "Notice of Allowance", U.S. Appl. No. 29/496,642, filed Jul. 15, 2014; dated Jul. 11, 2016.
Thurman, Holly "Ex Parte Quayle", U.S. Appl. No. 29/492,059, filed May 28, 2014; mailed Sep. 12, 2016.
Vy, Koenig "Notice of Allowance", U.S. Appl. No. 29/496,642, filed Jul. 15, 2014; dated Oct. 14, 2016.

* cited by examiner

HEALTH CARE KITS, CARE PACKS, AND METHODS THEREFOR

CROSS REFERENCE TO PRIOR APPLICATIONS

This application claims priority and benefit under 35 U.S.C. § 119(e) from U.S. Provisional Application No. 61/781,849, filed Mar. 14, 2013, which is incorporated by reference for all purposes.

BACKGROUND

Technical Field

This disclosure relates generally to kits, and more particularly to care kits.

Background Art

Being hospitalized or otherwise relegated to staying away from home in a health care facility can be a challenging experience. While hospitalization may be the best mode of receiving care for a particular ailment, a patient may long for home very quickly. Hospitalization means sleeping in a bed that is not one's own, not having one's personal articles within easy reach, dealing with temperatures that are not to one's preference, and possibly spending time in a non-private room with other patients. It would be advantageous to have methods, devices, and systems to make such a stay more pleasant.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present disclosure.

Figure 1:
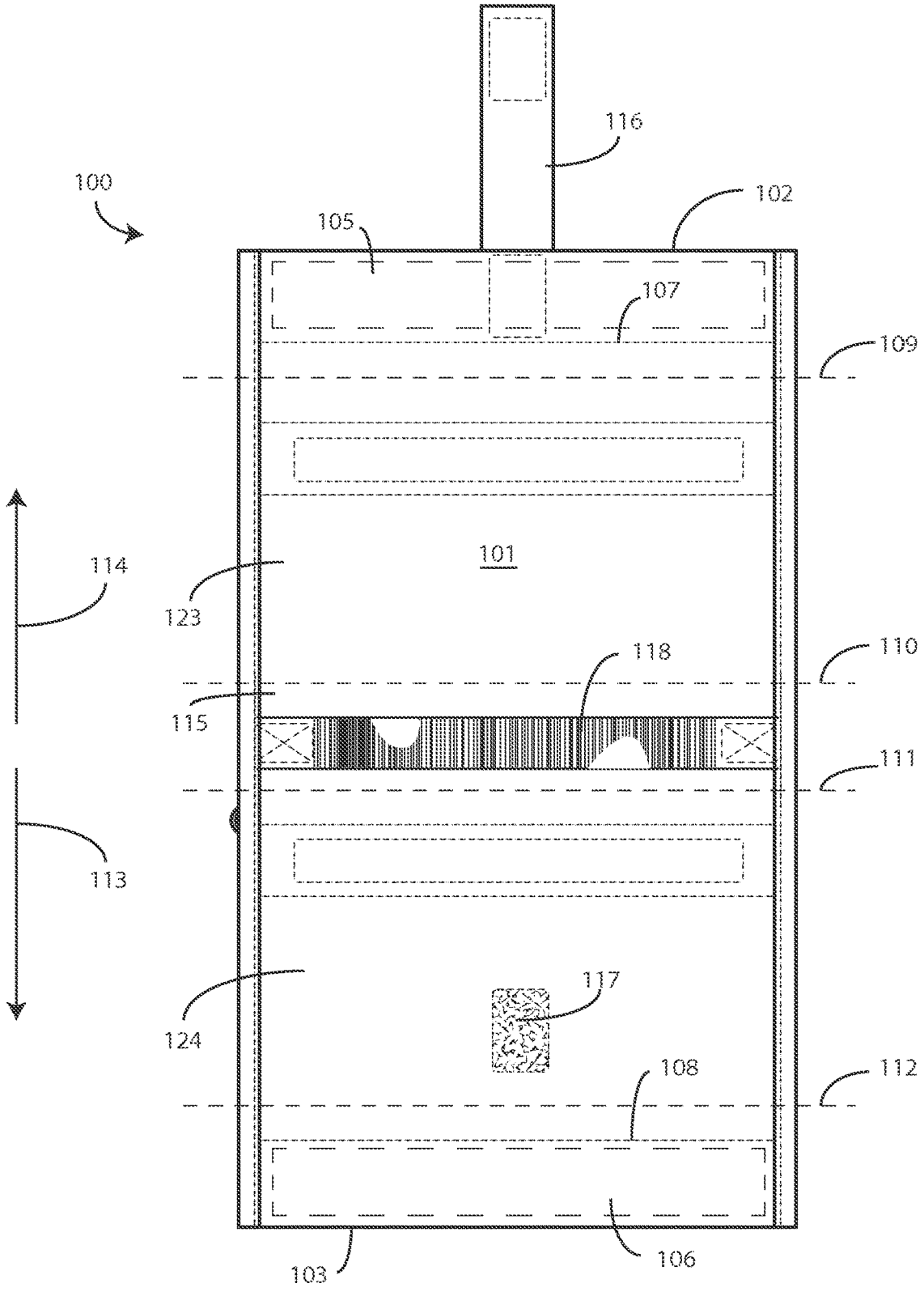
FIG. 1 is a front elevation view of one explanatory device in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

It is advantageous for healthcare services providers to provide an exceptional care experience to patients, families, and personal care personnel. Embodiments of the disclosure provide a personal care kit that enables a patient to have a more "homelike" experience while being hospitalized or otherwise relegated to a health care facility for an extended stay. Embodiments of the disclosure help transform a stay at a hospital or long-term care facility from one that is clinical and sterile to one that is comfortable and luxurious, more akin to a stay at a luxury hotel. Embodiments of the disclosure work to promote a positive patient experience, a quieter environment, more overall cleanliness, and better patient/healthcare services provider interactions.

Embodiments of the disclosure provide customizable care packs that enhance and improve a patient's stay in a healthcare facility. Embodiments of the disclosure also provide for customizable branding so that a particular healthcare services provider can brand the care packs to promote and strengthen brand equity.

Embodiments of the disclosure provide a pack that can be configured as a healthcare kit or care pack. Each healthcare kit or care pack includes contents that a patient can use while staying in a healthcare facility such as a hospital, hospice, rehabilitation center, therapy center, spa, or other facility. For example, in one embodiment the pack can be configured as a "Quiet Kit" or "Relax Kit" that includes implements suitable for helping a patient sleep. These implements can include one or more of an eye mask, earplugs, a puzzle book, a healthcare question list, a do not disturb sign, or a pencil. Accordingly, a patient can work on the puzzle book with the pencil to become drowsy after placing the do not disturb sign on their door. They may then read over the healthcare question kit to see if there are any unanswered questions for their healthcare services provider. They may then don the eye mask and earplugs and drift blissfully to sleep.

In another embodiment, the pack can be configured as a "Refresh Kit." Implements disposed therein can include one or more of a cleansing gel, a skin cream, a hand sanitizer, toothpaste, lip balm, or a toothbrush. The patient can use these implements to refresh by washing hands, brushing teeth, moisturizing skin, and so forth.

In one or more embodiments, multiple kits can be included in a single pack. For example, in one embodiment a pack includes a base layer. In one embodiment, the base layer is foldable along at least four transverse folding lines. A first pouch is selectively detachable from a first major face of the base layer. In one embodiment, the first pouch is disposed between a first transverse folding line and a second transverse folding line. In one embodiment, the first pouch is a Refresh Kit that includes one or more of a cleansing gel, a skin cream, a hand sanitizer, toothpaste, lip balm, or a toothbrush.

A second pouch can be selectively detachable from the first major face of the base layer as well. In one embodiment, the second pouch is disposed between a third transverse folding line and a fourth transverse folding line. In one embodiment, the second pouch is configured as a Relax Kit and includes one or more of an eye mask, earplugs, a puzzle book, a healthcare question list, a do not disturb sign, or a pencil.

A fastening extension can extend from one end of the base layer. The base layer can define another end to fold about the fourth transverse folding line to conceal a bottom end of the second pouch. The first end can then fold about the first transverse folding line atop the first end. The fastening extension can couple to a second major face of the base layer to retain the pack in a closed configuration. In one embodiment, the closed configuration resembles a suitcase, with a handle disposed along the second major face of the base layer.

A user can detach the fastening extension from the second major face to open the pack. The pack then unfolds along the four (or more) transverse folding lines to extend into a substantially planar configuration. In one embodiment, the user can then attach the fastening extension to a complementary fastener disposed along the first major face to form a hanging loop. The pack can then be hung from a shower curtain rod or other hanging apparatus. The user can then selectively detach the pouches to use the contents therein as desired.

Figure 2:
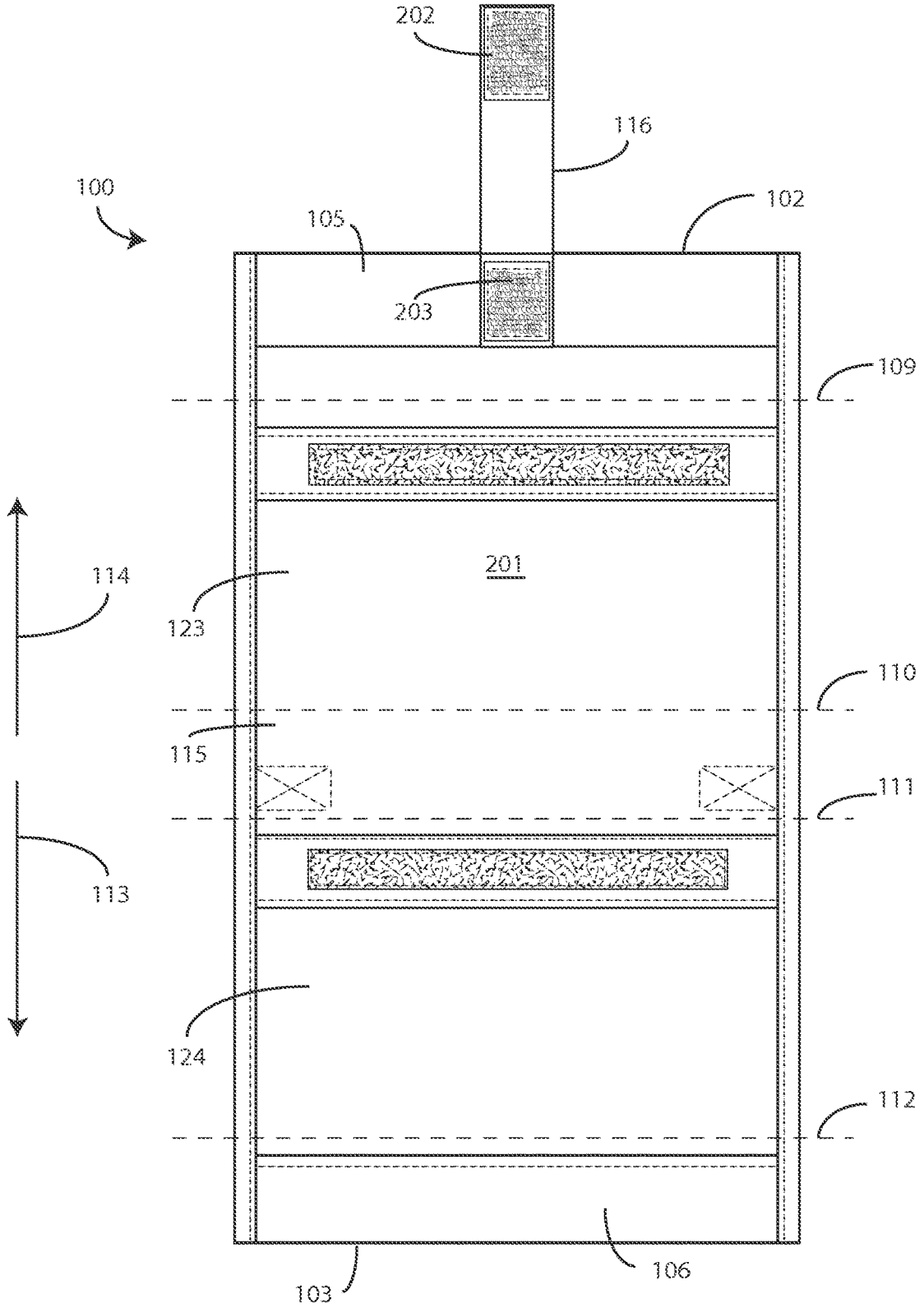
FIG. 2 is a rear elevation view of one explanatory device in accordance with one or more embodiments of the disclosure.
Figure 3:
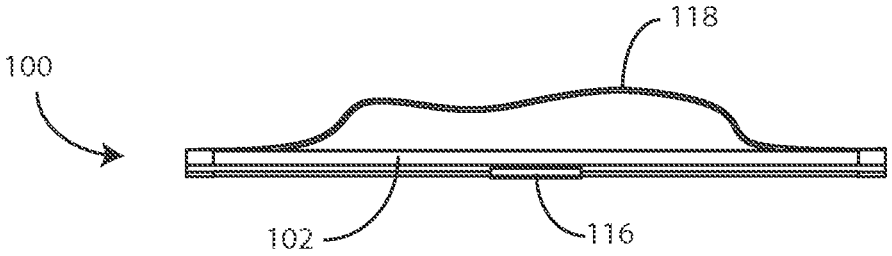
FIG. 3 is a top plan view of one explanatory device in accordance with one or more embodiments of the disclosure.
Figure 4:
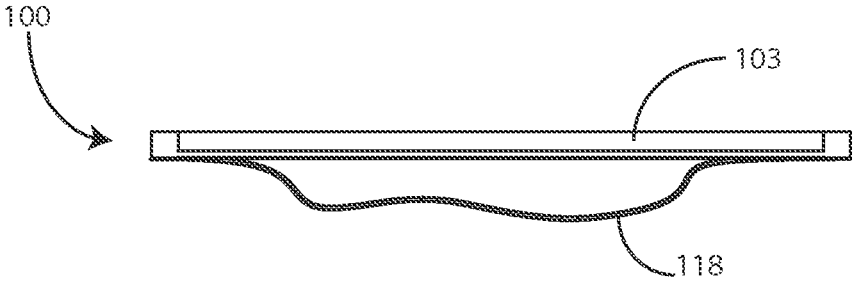
FIG. 4 is a bottom plan view of one explanatory device in accordance with one or more embodiments of the disclosure.
Figure 5:
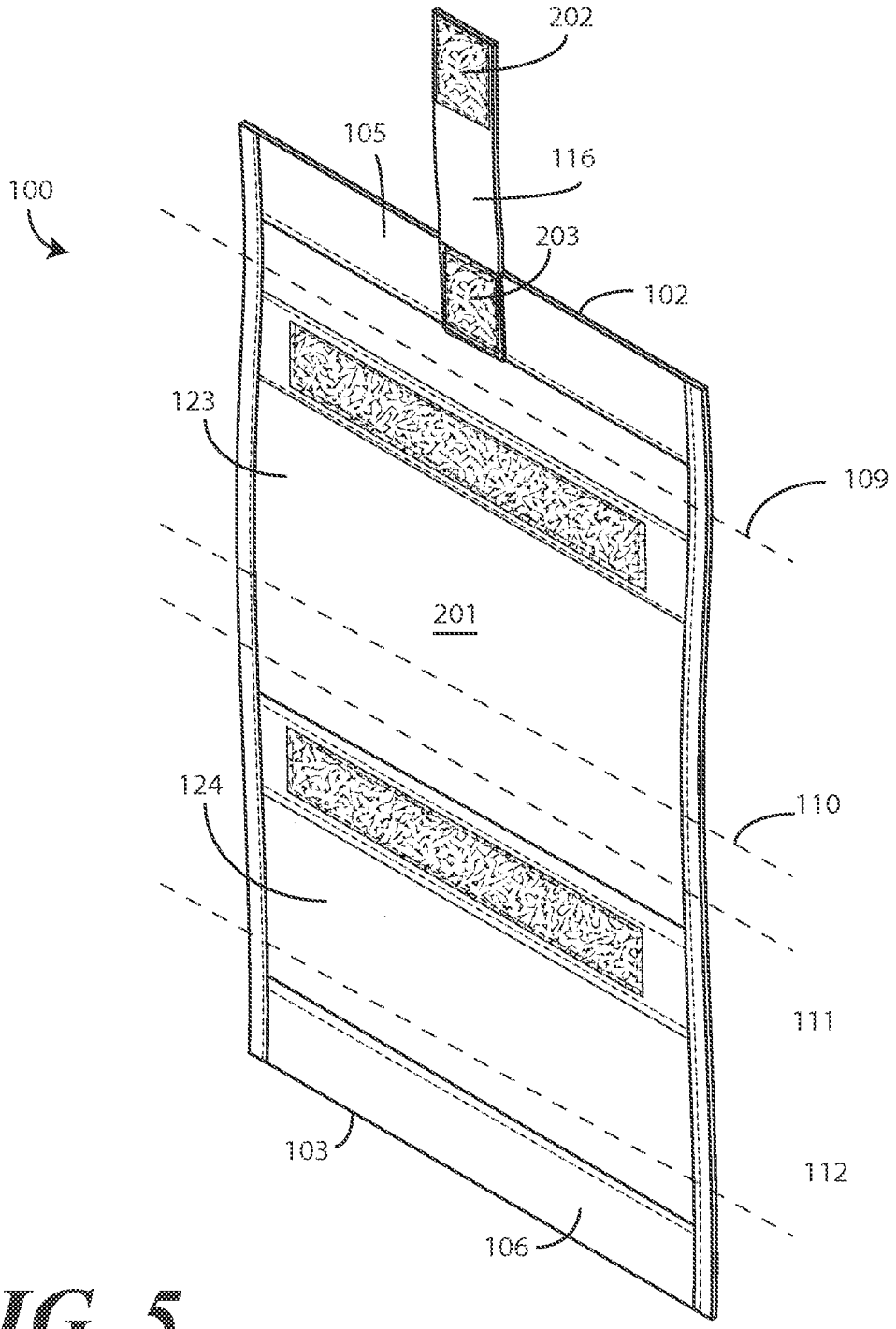
FIG. 5 is a perspective view of one explanatory device in accordance with one or more embodiments of the disclosure.
Figure 6:
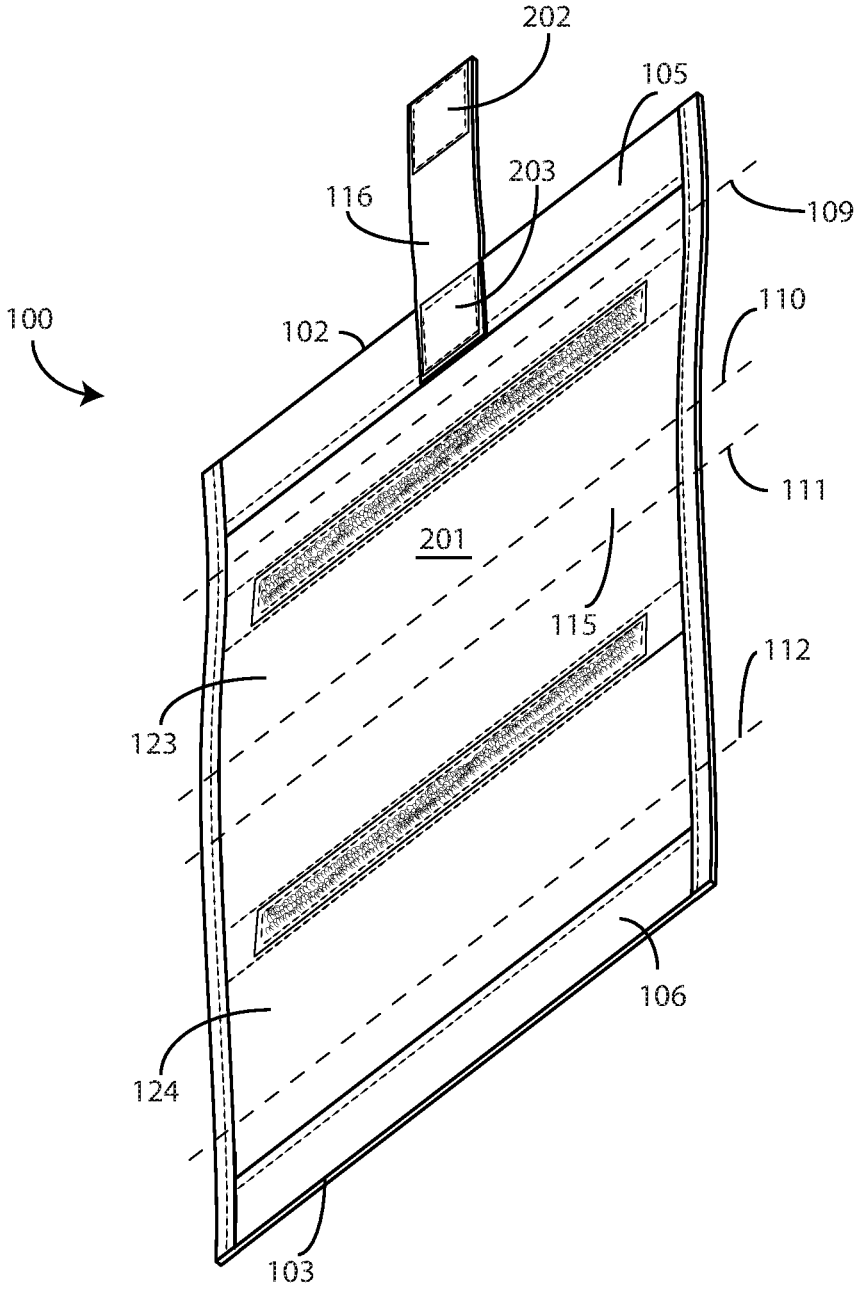
FIG. 6 is another perspective view of one explanatory device in accordance with one or more embodiments of the disclosure.

Turning now to FIGS. 1-6, illustrated therein is one embodiment of a base layer 100 for a pack configured in accordance with one or more embodiments of the disclosure. FIG. 1 is a front elevation view of the base layer 100, while FIG. 2 is a rear elevation view of the base layer 100. FIG. 3 is a top plan view of the base layer 100, while FIG. 4 is a bottom plan view of the base layer 100. FIGS. 5-6 are perspective views of the base layer 100.

The base layer 100 defines a first major face 101 and a second major face. The base layer 100 also defines a first end 102 and a second end 103. In one embodiment, the base layer 100 is manufactured from a textile material such as a woven cotton. Other materials can also be used, including woven synthetics, non-woven synthetics, non-woven organic materials, woven organic materials, and so forth. In one embodiment, panels 123, 124 of the base layer 100 are configured to be soft and pliable. In one embodiment, the material of the base layer 100 is color coded so as to indicate the type of pack it contains. For example, in one illustrative embodiment the base layer 100 is manufactured from a blue material.

In one embodiment, one or both small panels 105, 106 disposed at the first end 102 and the second end 103, respectively, comprise stiffeners. For example, a cardboard, plastic, or metal stiffener can be sewn into the small panels 105, 106 by stitching 107, 108 to keep the base layer 100 from folding about vertical lines. In one embodiment, a first stiffener is disposed exterior to the first transverse folding line 109, while a second stiffener is disposed exterior to the fourth transverse folding line 112. In one embodiment, the portion 115 of the base layer 100 disposed between the second transverse folding line 110 and the third transverse folding line 111 comprises a stiffener as well.

In one embodiment, the base layer 100 is foldable about at least four transverse folding lines 109, 110, 111, 112. In one embodiment, a first portion 113 of the base layer 100 folds about a third transverse folding line 111 while a second portion 114 of the base layer 100 folds about a second transverse folding line 110. In this fashion, the first portion 113 and the second portion 114 of the base layer 100 form the sides of a U-shape. A portion 115 of the base layer 100 disposed between the second transverse folding line 110 and the third transverse folding line 111 forms the base of the U-shape.

In one embodiment, the second end 103 then folds beneath the first end 102. Said differently, the small panel 105 disposed at the first end 102 folds atop the small panel 106 disposed at the second end 103 in one embodiment. This folding converts the base layer 100 to a closed configuration, which will be shown in more detail with reference to subsequent figures, from the open configuration shown in FIGS. 1-6.

In one embodiment, a fastening extension 116 extends distally from the first end 102 of the base layer 100. The fastening extension 116 comprises a fastener 202. In one embodiment, the second major face 201 comprises a complementary fastener 117. In one embodiment, the fastener 202 comprises one of a hook and loop fastener, while the complementary fastener 117 is another of a hook and loop fastener. Thus, if fastener 202 is a hook fastener, complementary fastener 117 would be a loop fastener, and vice versa. Hook and loop fasteners are but one type of fastener that may be used in accordance with embodiments of the disclosure. Other fasteners will be obvious to those of ordinary skill in the art having the benefit of this disclosure. For example, magnets, snaps, and press fit closures could be substituted for the hook and loop fasteners of FIGS. 1-6.

When the base layer 100 is folded about the four transverse folding lines 109, 110, 111, 112 to the closed configuration, in one embodiment the fastening extension 116 can couple to the complementary fastener 117 disposed on the second major face 201 of the base layer 100 to retain the corresponding pack in a closed configuration.

In one embodiment, when the base layer 100 is unfolded to the open position shown in FIGS. 1-6, to provide a mechanism for a user to hang the base layer, a second complementary fastener 203 can be disposed on the first major face 101 of the base layer 100. In one embodiment, the second complementary fastener 203 is disposed along the small panel 105 disposed at the first end 102 of the base layer 100. In one embodiment, the fastener 202 comprises one of a hook and loop fastener, while the second complementary fastener 203 is another of a hook and loop fastener. Thus, if fastener 202 is a hook fastener, the second complementary fastener 203 would be a loop fastener, and vice versa. As noted above, hook and loop fasteners are but one type of fastener that may be used in accordance with embodiments of the disclosure. Other fasteners will be obvious to those of ordinary skill in the art having the benefit of this disclosure. For example, magnets, snaps, and press fit closures could be substituted for the hook and loop fasteners of FIGS. 1-6.

When the base layer 100 is in the open position, a user may couple the fastener 202 to the second complementary fastener 203 to transform the fastening extension 116 into a hanging loop. For example, a user may wrap the fastening extension 116 about a shower curtain, coat rack, hanging loop, or even a door handle, and couple the fastener 202 to the second complementary fastener 203 to hang the base layer 100 from the fastening extension 116.

In one or more embodiments, a handle 118 is disposed along the second major face 201 of the base layer 100. In one embodiment, the handle 118 is disposed between the second transverse folding line 110 and the third transverse folding line 111. When the base layer 100 is folded to the closed configuration, the handle 118 allows a user to carry the pack as if it were a small suitcase, briefcase, or purse.

Figure 7:
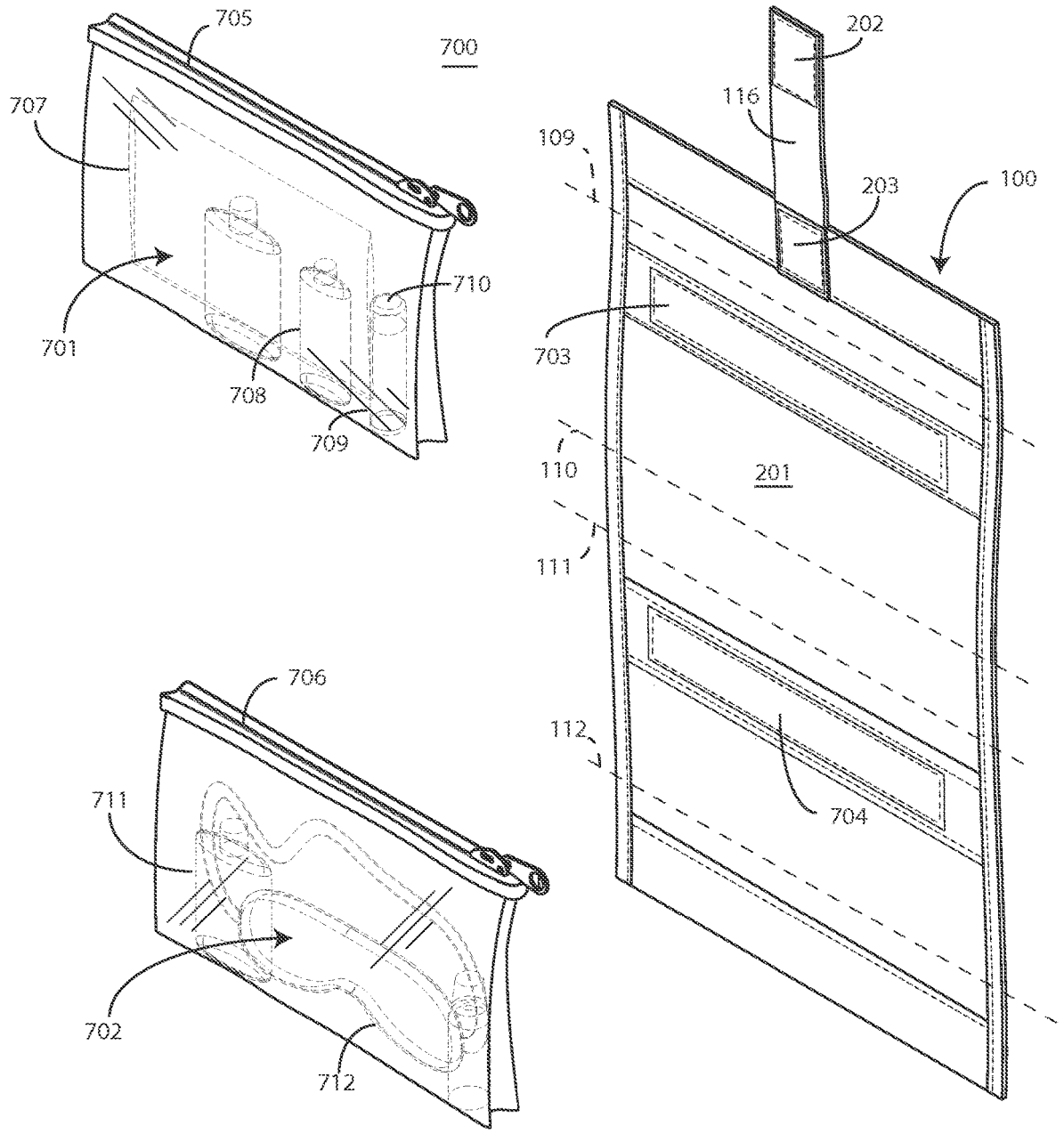
FIG. 7 is another perspective view of one explanatory device in accordance with one or more embodiments of the disclosure.

Turning now to FIG. 7, illustrated therein is an exploded view of one explanatory pack 700 configured in accordance with one or more embodiments of the disclosure. The pack 700, which can be configured as a healthcare kit or care pack in one or more embodiments, includes the base layer 100 from FIGS. 1-6 and one or more pouches 701, 702. In this illustrative embodiment, the pack 700 includes a first pouch 701 and a second pouch 702. Those of ordinary skill in the art having the benefit of this disclosure will appreciate that the length of the base layer 100 can be extended to accommodate three, four, or more pouches in other embodiments. Similarly, the length of the base layer 100 can be shortened to accommodate only one pouch as well.

In one embodiment, each of the first pouch 701 and the second pouch 702 are transparent. For example, in one embodiment each of the first pouch 701 and the second pouch 702 are manufactured from a pliant, transparent thermoplastic or vinyl material. In one embodiment, this transparent configuration contrasts with the base layer 100, which is opaque.

In one embodiment, each of the first pouch and the second pouch 702 includes a closure 705, 706 to retain one or more items therein. In this illustrative embodiment, the closures 705, 706 are zippers. However, those of ordinary skill in the art having the benefit of this disclosure will recognize that other closures can be substituted for the zippers. For example, in one embodiment the closures 705, 706 can be zip-strip closures. In another embodiment, the closures 705, 706 can be snaps. In another embodiment, the closures 705, 706 can be hook and loop fasteners, laces, or other closure devices.

In one embodiment, each pouch 701, 702 is to contain one or more items 707, 708, 709, 710, 711, 712. In this illustrative embodiment, the first pouch 701 is configured as a "Refresh" kit, while the second pouch 702 is configured as a "Relax" kit. Accordingly, in one embodiment the first pouch 701 contains one or more items 707, 708, 709, 710. In one embodiment, the one or more items 707, 708, 709, 710 are one or more of a cleansing gel, a skin cream, a hand sanitizer, toothpaste, lip balm, or a toothbrush. Similarly, in this illustrative embodiment the second pouch 702 contains one or more items 711, 712. In one embodiment, the one or more items 711, 712 are one or more of an eye mask, earplugs, a puzzle book, a healthcare question list, a do not disturb sign, or a pencil. Examples of the puzzle book include crossword puzzles or Sudoku puzzles. In one embodiment, the puzzle book includes both easy and difficult puzzles. A user can employ the pencil to complete the puzzles of the puzzle book. In one embodiment, the healthcare question list includes a predetermined set of questions, such as "What surgery will be performed on me?" or "What steps do I take to properly recover?" Alternatively, in another embodiment the healthcare question list can be a booklet of lined paper upon which the patient can write answers to their own questions.

Each pouch 701, 702 is selectively detachable from the first major face 101 of the base layer 100 in this illustrative embodiment. For example, in one embodiment, each of the first pouch 701 and the second pouch 702 is attached to the first major face 101 by a hook and loop fastener 703, 704. As noted above, other fastening devices can be substituted for the hook and loop fastener 703, 704 shown in this embodiment. Advantageously, making the pouches 701, 702 selectively detachable allows a user to remove a pouch from the base layer 100 to use it in another location. Thus, where a user couples the fastener 202 to the second complementary fastener 203 to transform the fastening extension 116 into a hanging loop, the user can detach the first pouch 701, for example, to use it in another room without disturbing the hanging configuration of the base layer 100.

It should be noted that the pouches 701, 702 can be disposed at various locations along the base layer 100. In one explanatory embodiment, the first pouch 701 is disposed between the first transverse folding line 109 and the second transverse folding line 110. The second pouch 702 is then disposed between the third transverse folding line 111 and the fourth transverse folding line 112. This configuration advantageously allows the base layer 100 to fold about the transverse folding lines 109, 110, 111, 112 to enclose the pouches 701, 702 when the pack 700 is in the closed configuration, as will be shown in subsequent figures.

Figure 8:
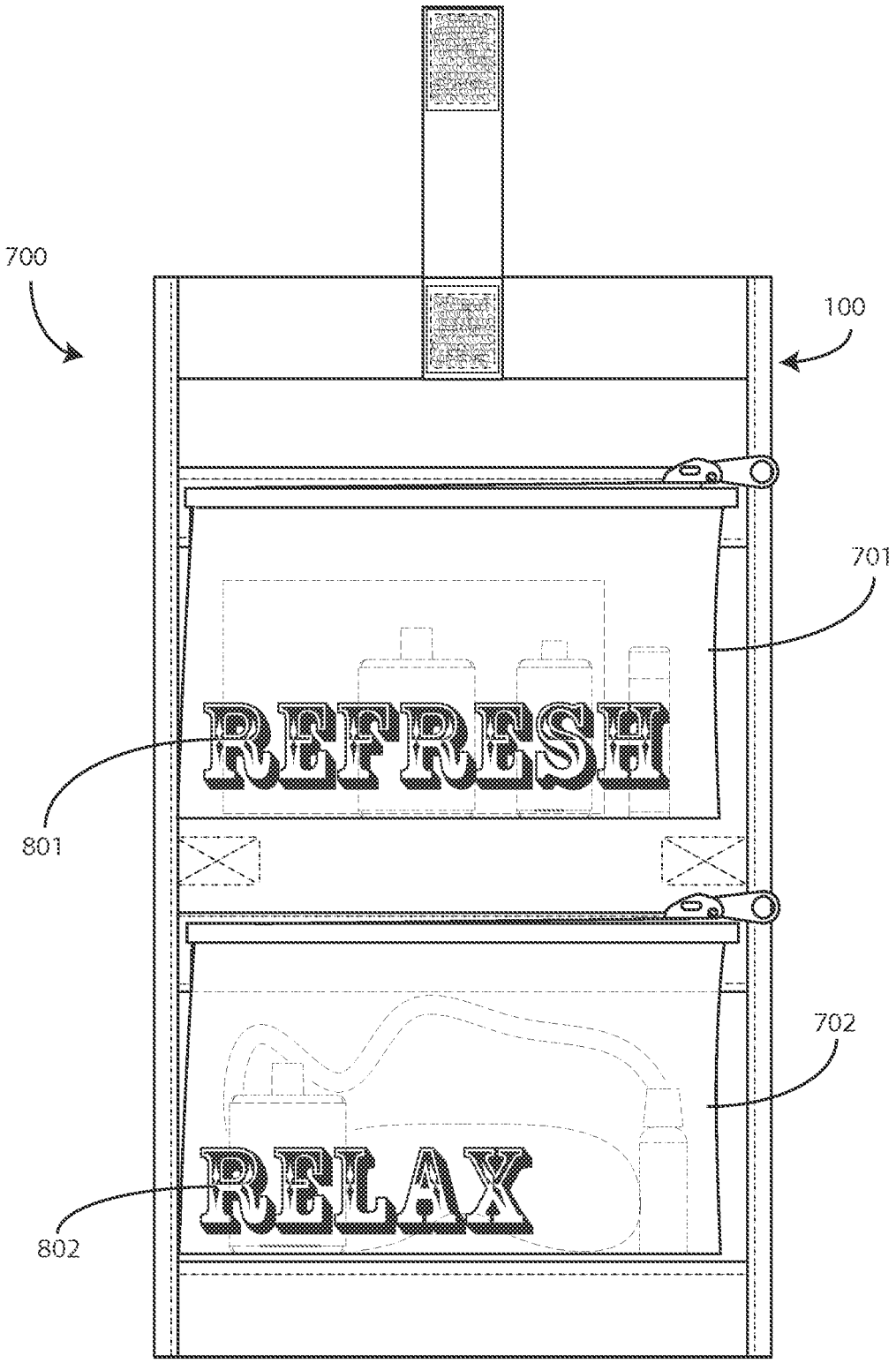
FIG. 8 is another front elevation view of one explanatory device in accordance with one or more embodiments of the disclosure.
Figure 9:
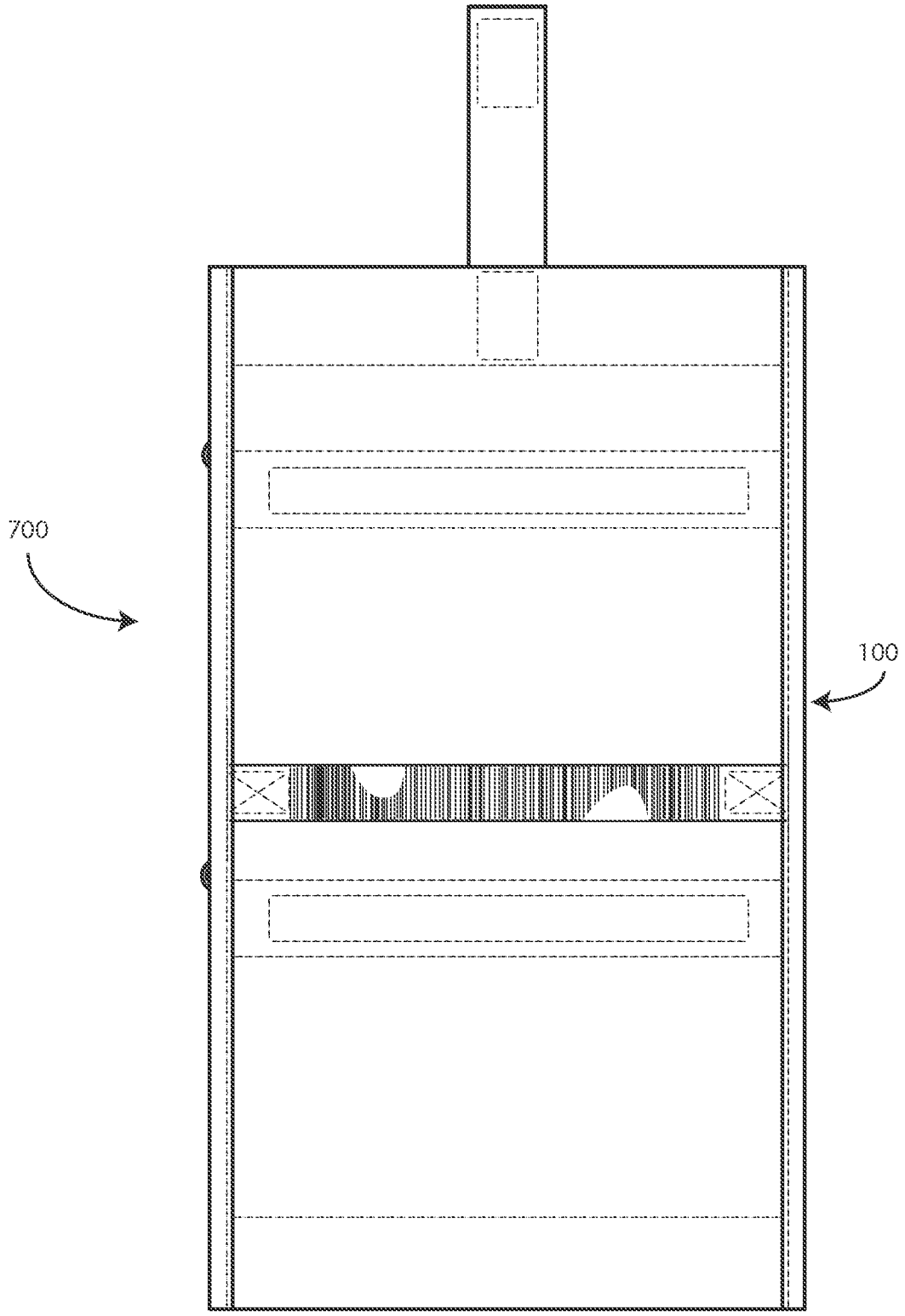
FIG. 9 is another rear elevation view of one explanatory device in accordance with one or more embodiments of the disclosure.
Figure 10:
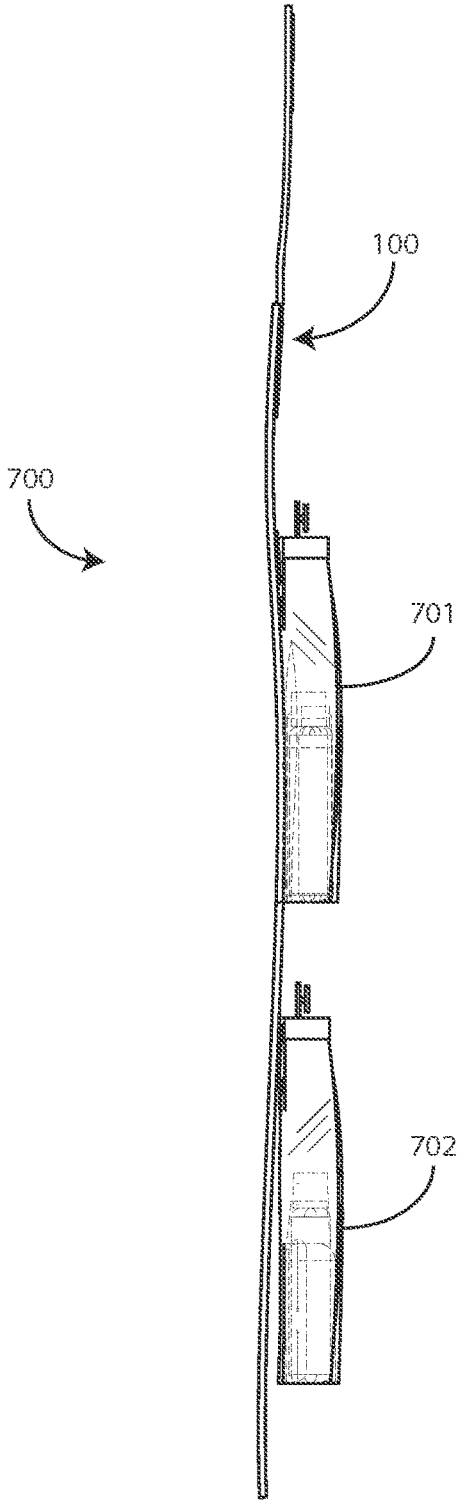
FIG. 10 is another left elevation view of one explanatory device in accordance with one or more embodiments of the disclosure.
Figure 11:
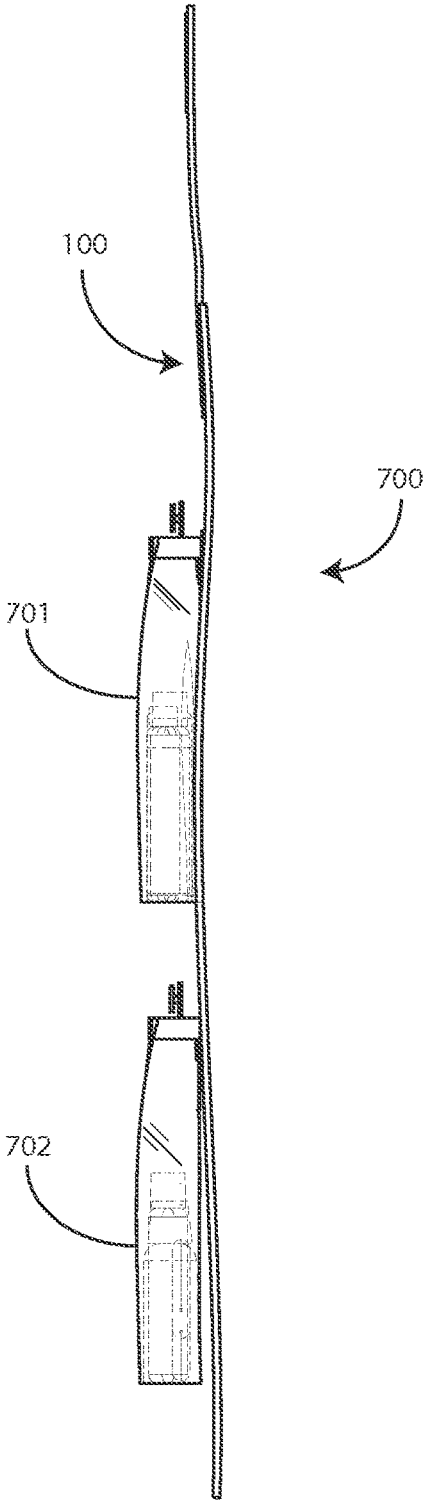
FIG. 11 is another right elevation view of one explanatory device in accordance with one or more embodiments of the disclosure.
Figure 12:
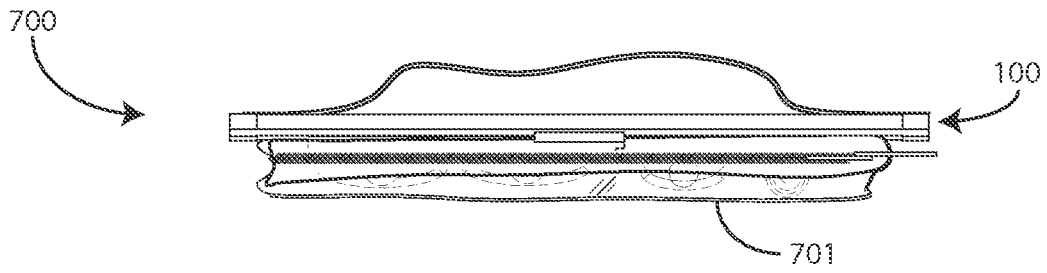
FIG. 12 is another top plan view of one explanatory device in accordance with one or more embodiments of the disclosure.
Figure 13:
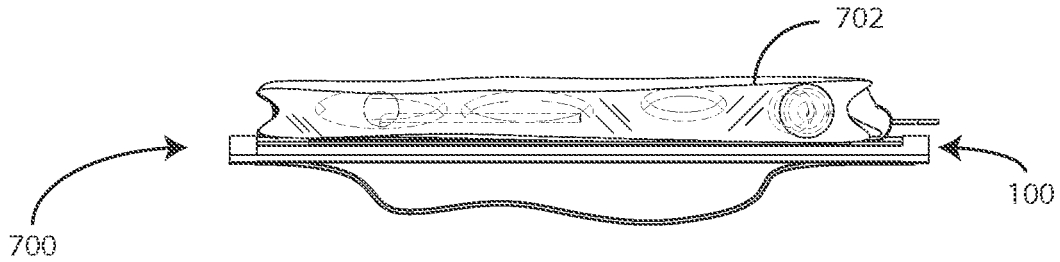
FIG. 13 is another bottom plan view of one explanatory device in accordance with one or more embodiments of the disclosure.
Figure 14:
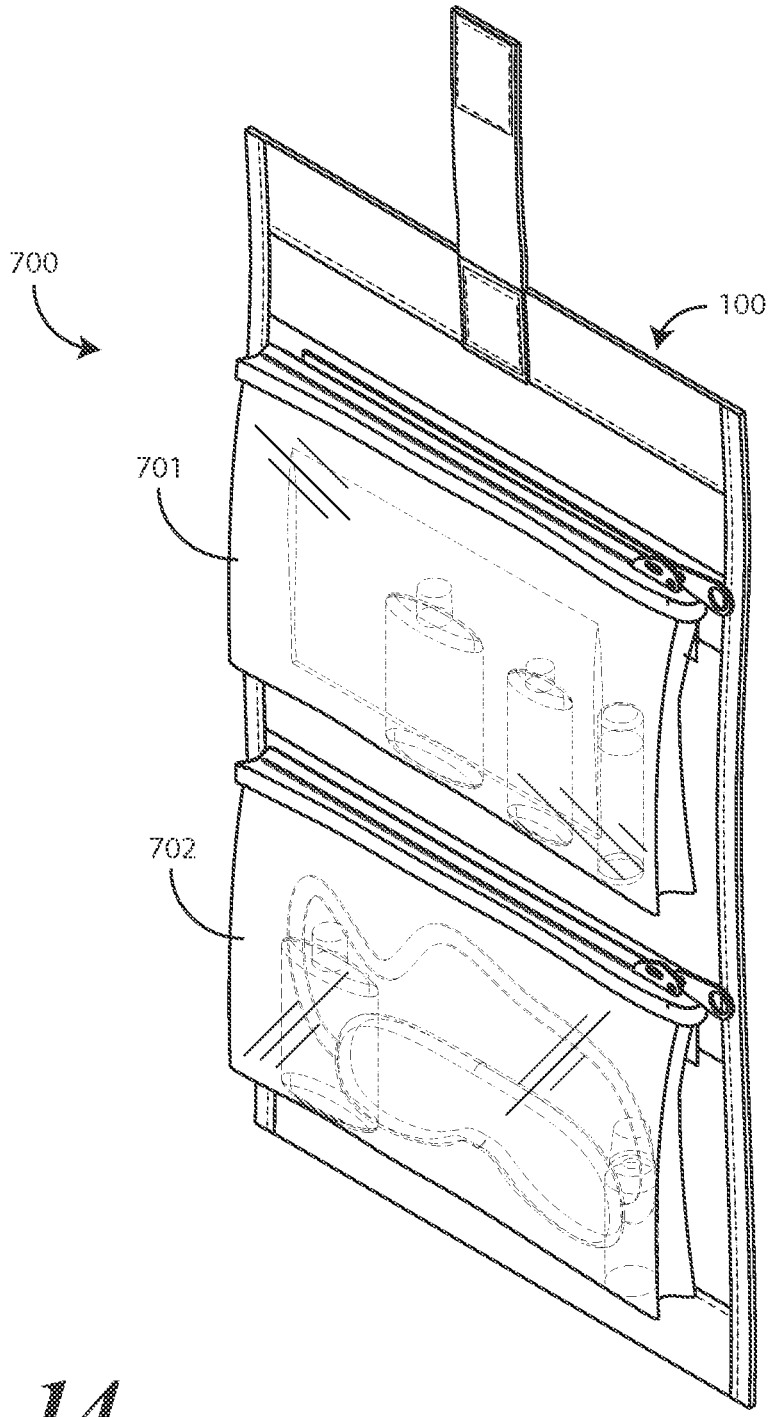
FIG. 14 is another perspective view of one explanatory device in accordance with one or more embodiments of the disclosure.
Figure 15:
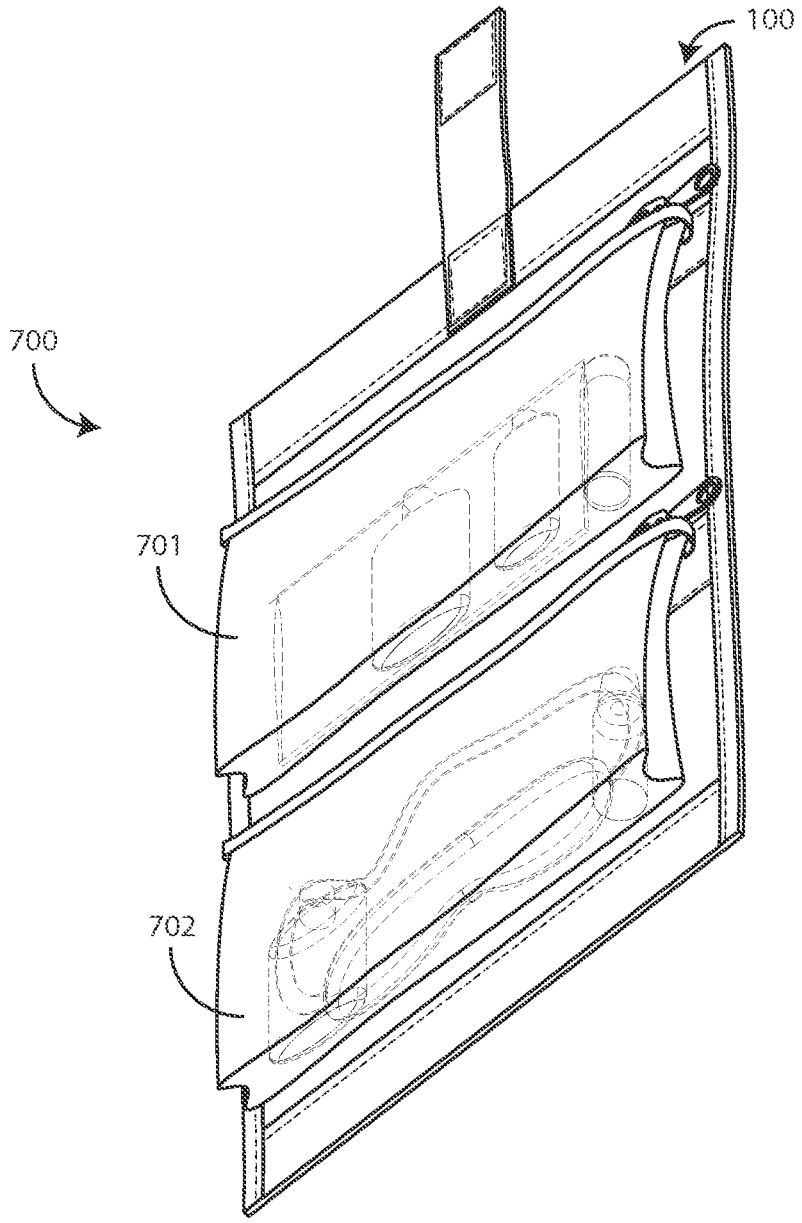
FIG. 15 is another perspective view of one explanatory device in accordance with one or more embodiments of the disclosure.

Turning now to FIGS. 8-15, illustrated therein is one embodiment of a pack 700 of FIG. 7 when both pouches 701, 702 are attached to the base layer 100. FIG. 8 is a front elevation view of the pack 700, while FIG. 9 is a rear elevation view of the pack 700. FIG. 10 is a right elevation view of the pack 700, while FIG. 11 is a left elevation view of the pack 700. FIG. 12 is a top plan view of the pack 700, while FIG. 13 is a bottom plan view of the pack 700. FIGS. 14-15 are perspective views of the pack 700.

As best shown in FIG. 8, in one embodiment each pouch 701, 702 comprises a single-word identifier 801, 802 suggesting the contents disposed within each pouch 701, 702. In one embodiment, the single word identifier 801, 802 is disposed along an exterior of each pouch 701, 702. For example, in the illustrative embodiment of FIG. 8, the first single word identifier 801 is "Refresh," while the second single word identifier 802 is "Relax." Those of ordinary skill in the art having the benefit of this disclosure will appreciate that other words can be used as well. For example, instead of "Relax," the second single word identifier 802 may have been "Quiet" or "Serenity."

The use of a single word identifier 801, 802 offers several advantages. First, it provides a simple suggestion that piques the user's curiosity as to what is within each pouch 701, 702. With this piqued curiosity, the user is more likely to open each pouch 701, 702 and investigate and use its contents. Second, the use of a single word identifier 801, 802 connotes the minimalist experience offered by many spas and retreats, thereby providing subconscious relaxation to the user. Third, the use of a single word identifier 801, 802 prevents clutter along the exterior of each pouch 701, 702. This allows a user to more easily see the contents of each pouch 701, 702 when that pouch 701, 702 is transparent.

In one embodiment, the single word identifier 801, 802 is printed on the exterior of each pouch 701, 702. In another embodiment, the single word identifier 801, 802 is embossed onto each pouch 701, 702. In yet another embodiment, the single word identifier 801, 802 is molded into the pouches 701, 702. Other methods of disposing the single word identifier 801, 802 on the pouch will be obvious to those of ordinary skill in the art having the benefit of this disclosure.

Figure 16:
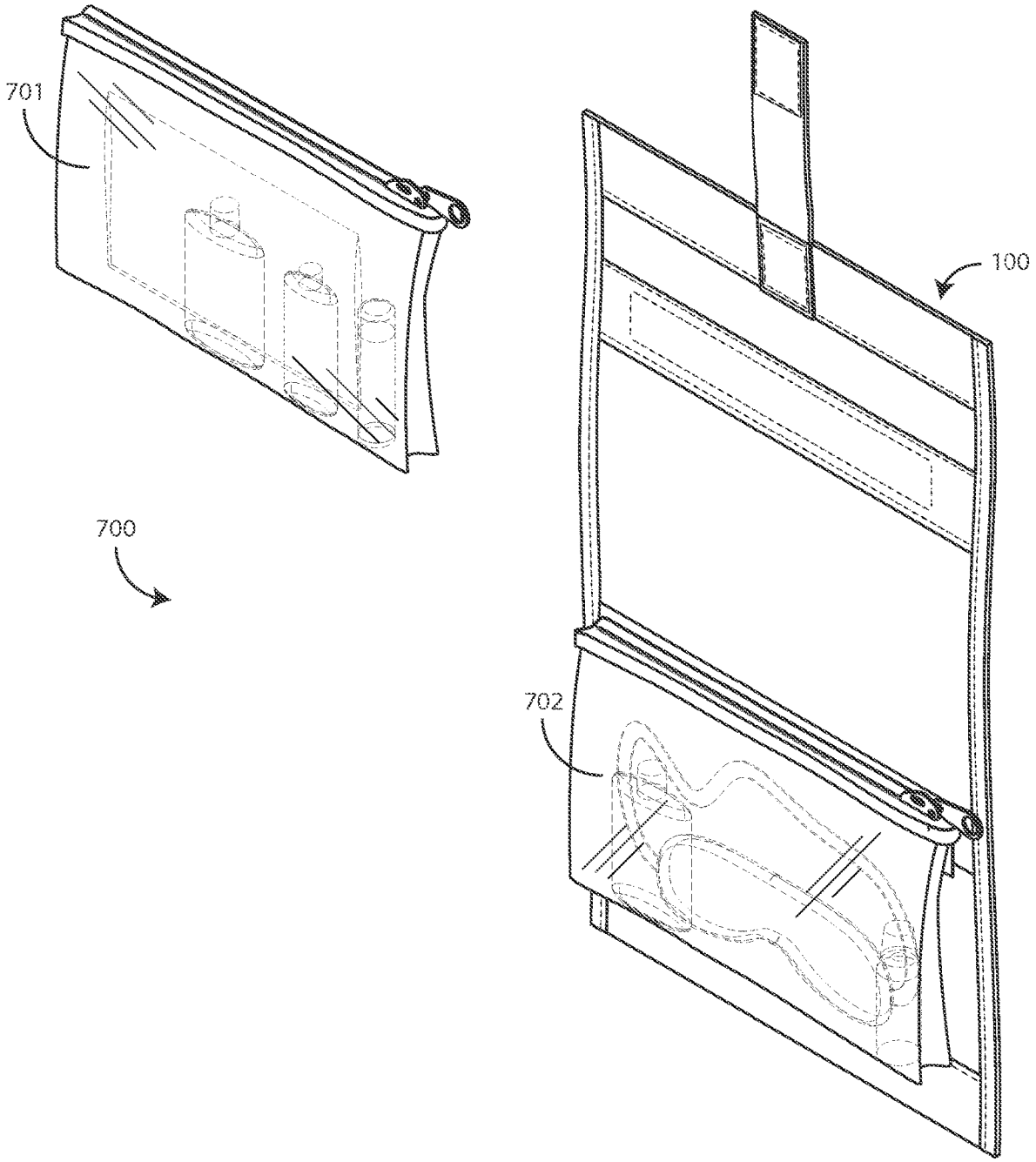
FIG. 16 is another perspective view of one explanatory device in accordance with one or more embodiments of the disclosure.

Turning now to FIG. 16, illustrated therein is a pack 700 with one pouch 701 selectively detached from the base layer 100 and another pouch 702 attached to the base layer 100. This figure illustrates the selective detachability of the pouches 701, 702. Illustrating by example, if the first pouch 701 is a Refresh Kit, a user may detach the first pouch 701 and take it to the bathroom to use during a shower. This allows the second pouch 702, which may be a Relax Kit, to remain on the base layer 100 until it is ready for use. When the user is finished with the first pouch 701, they simply reattach it to the base layer 100 using the hook and loop fastener 703. The user can then optionally detach the second pouch 702 to take to a bedside table for use when getting ready for bed.

Figure 17:
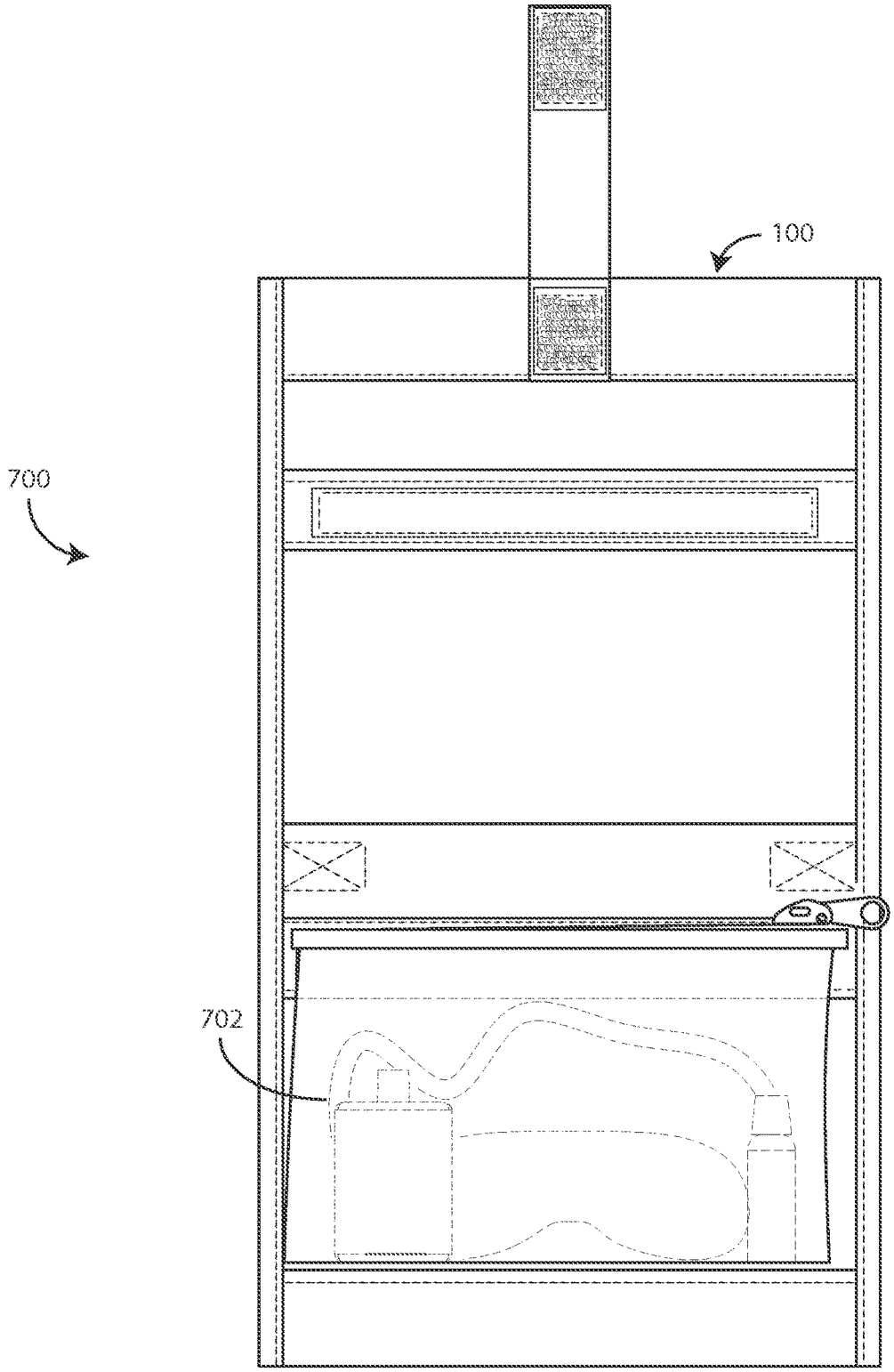
FIG. 17 is another front elevation view of one explanatory device in accordance with one or more embodiments of the disclosure.
Figure 18:
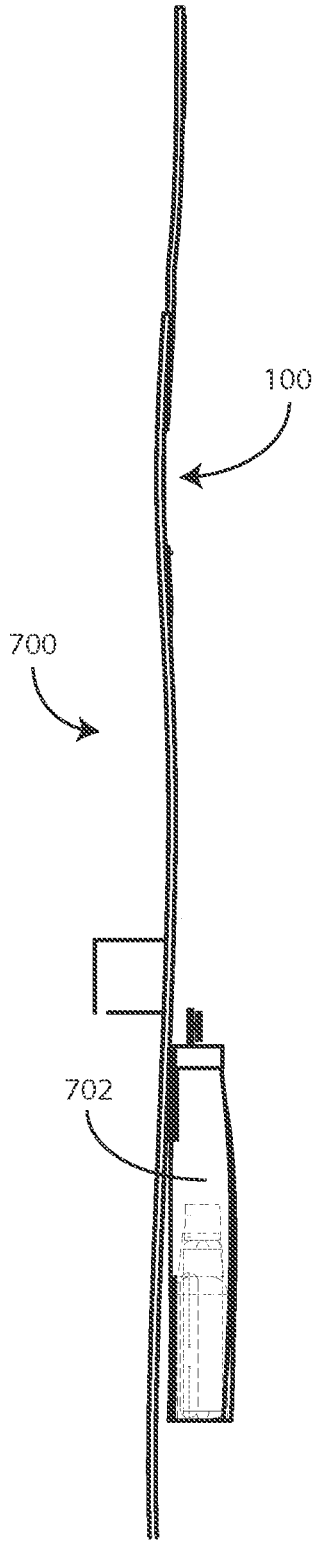
FIG. 18 is another left elevation view of one explanatory device in accordance with one or more embodiments of the disclosure.
Figure 19:
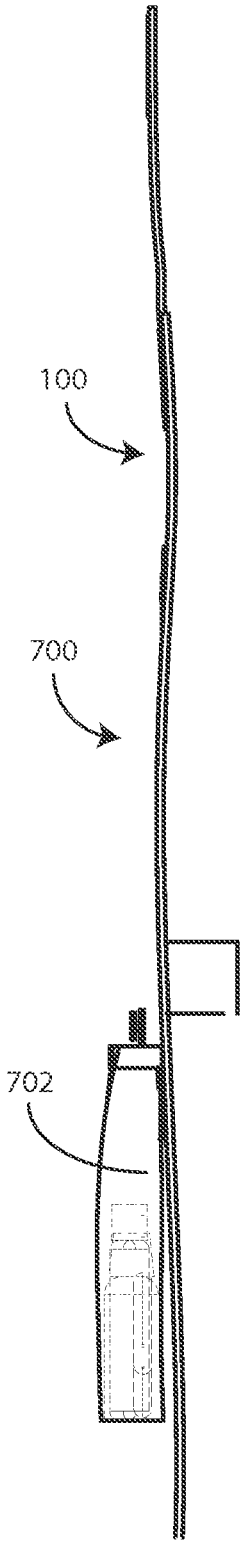
FIG. 19 is another right elevation view of one explanatory device in accordance with one or more embodiments of the disclosure.
Figure 20:
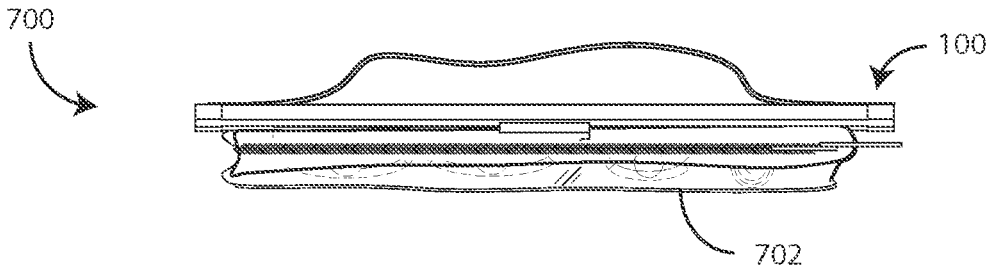
FIG. 20 is another top plan view of one explanatory device in accordance with one or more embodiments of the disclosure.

FIGS. 17-23 illustrate the pack 700 with one pouch (701) removed from the base layer 100. FIG. 17 is a front elevation view of the pack 700, while FIG. 18 is a rear elevation view of the pack 700. FIG. 19 is a right elevation view of the pack 700, while FIG. 20 is a left elevation view of the pack 700.

Figure 21:
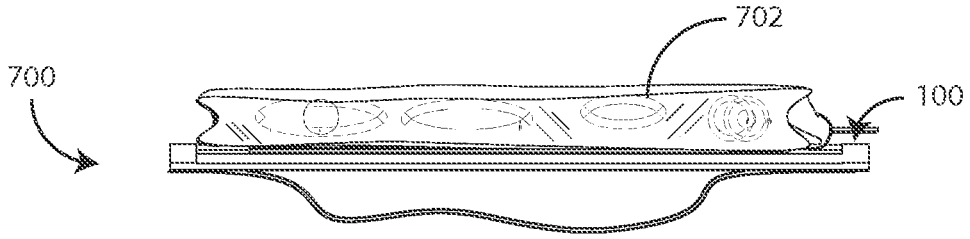
FIG. 21 is another bottom plan view of one explanatory device in accordance with one or more embodiments of the disclosure.
Figure 22:
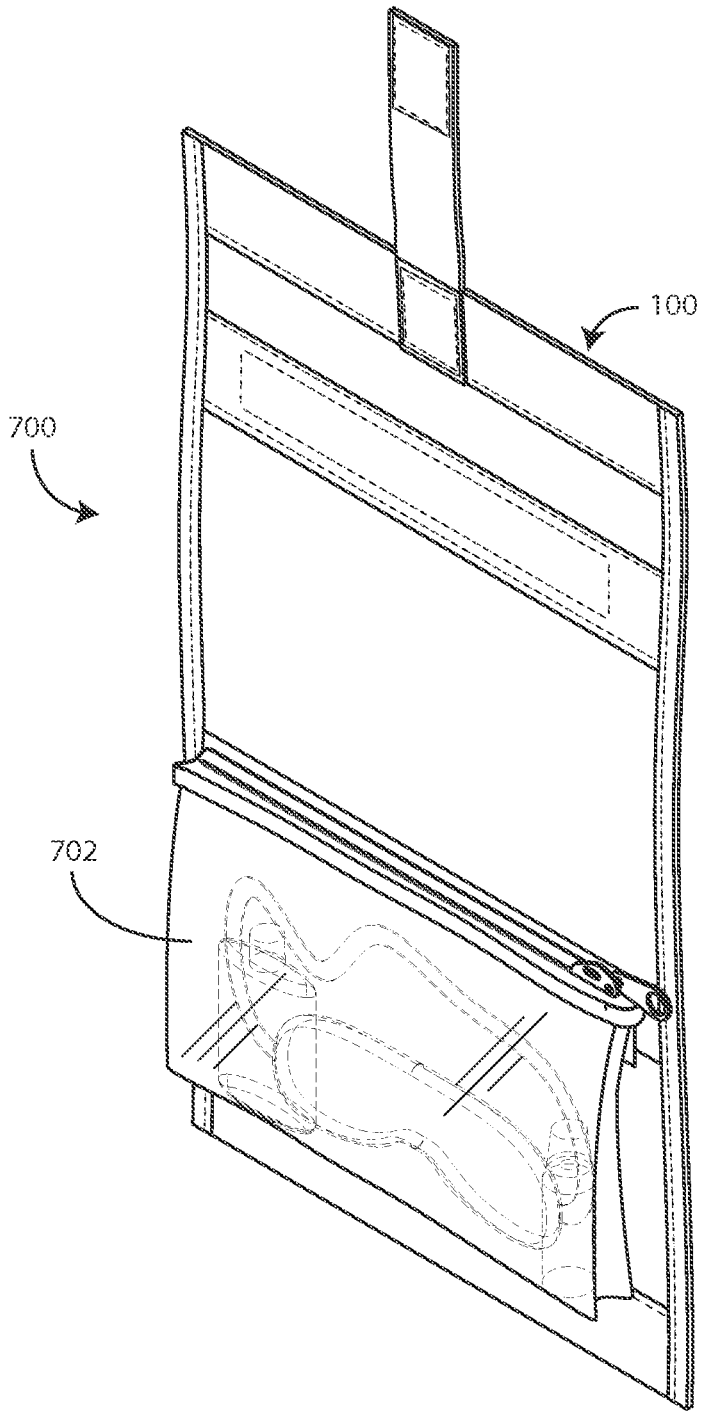
FIG. 22 is another perspective view of one explanatory device in accordance with one or more embodiments of the disclosure.
Figure 23:
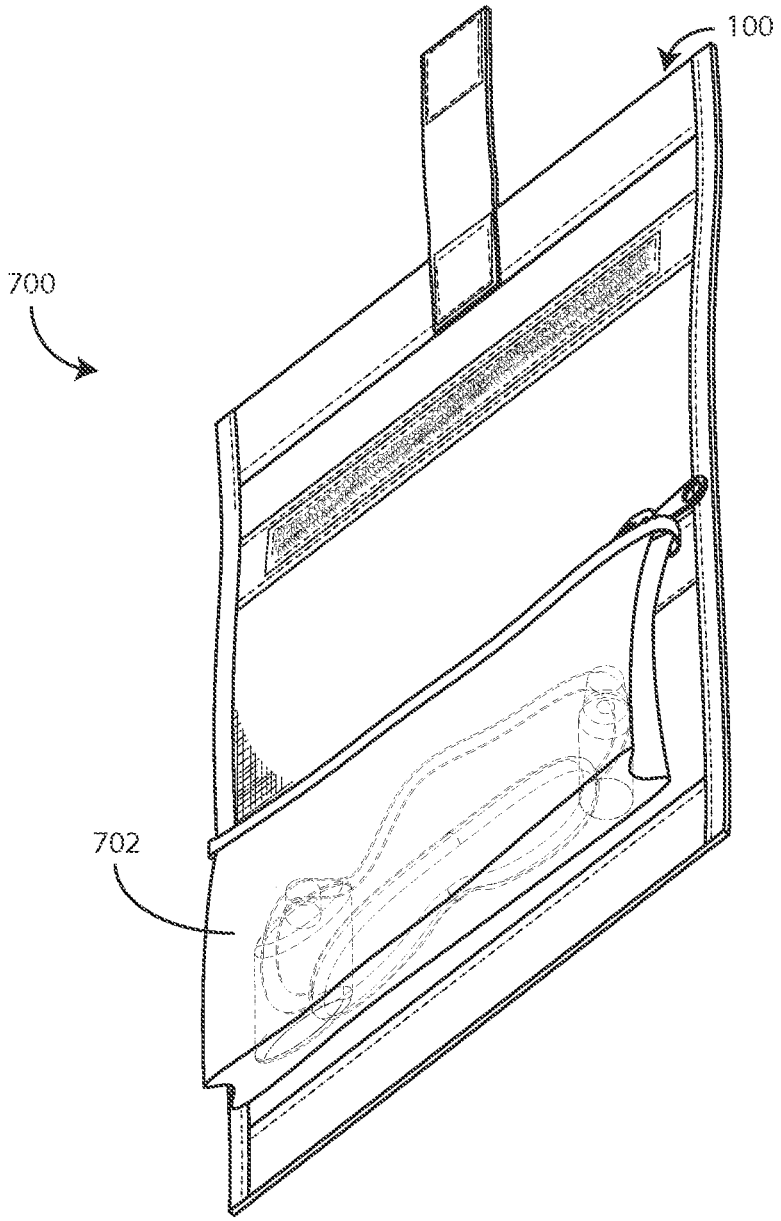
FIG. 23 is another perspective view of one explanatory device in accordance with one or more embodiments of the disclosure.
Figure 24:
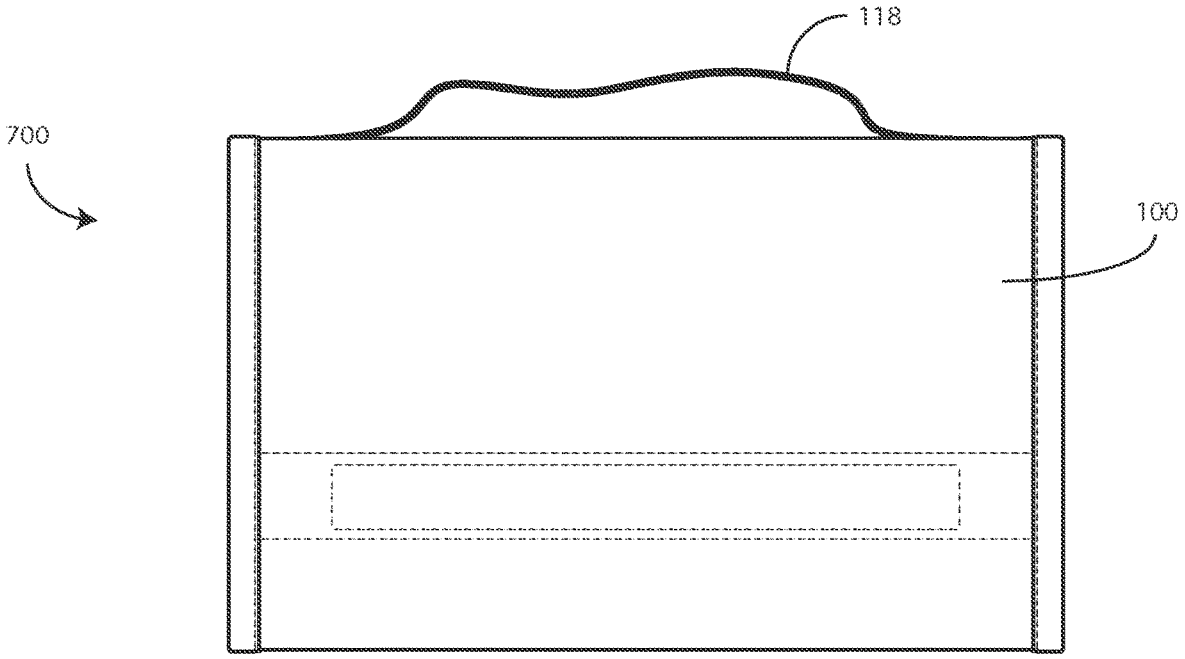
FIG. 24 is another front elevation view of one explanatory device in accordance with one or more embodiments of the disclosure.

FIG. 21 is a top plan view of the pack 700, while FIG. 22 is a bottom plan view of the pack 700. FIGS. 23-24 are perspective views of the pack 700. In each figure, the pack 700 is shown in the open configuration.

Figure 25:
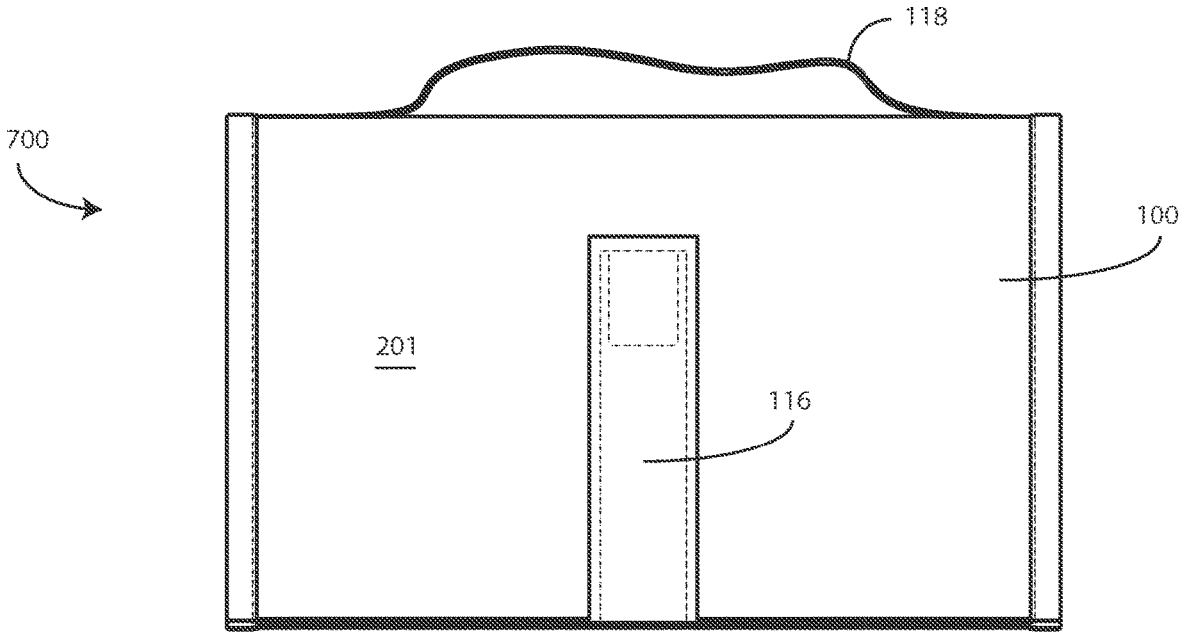
FIG. 25 is another rear elevation view of one explanatory device in accordance with one or more embodiments of the disclosure.
Figure 26:
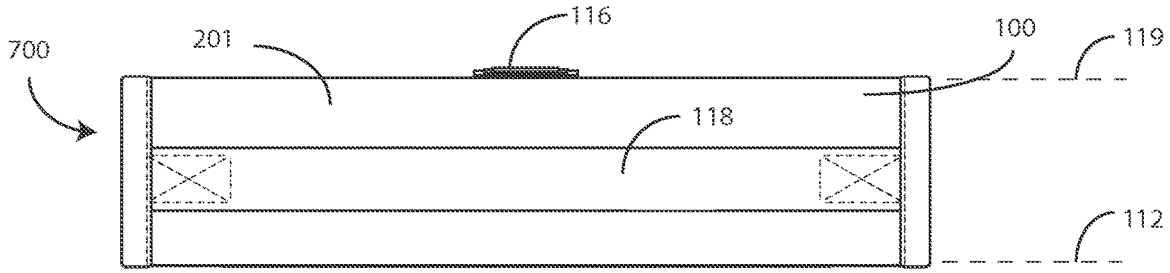
FIG. 26 is another top plan view of one explanatory device in accordance with one or more embodiments of the disclosure.
Figure 27:
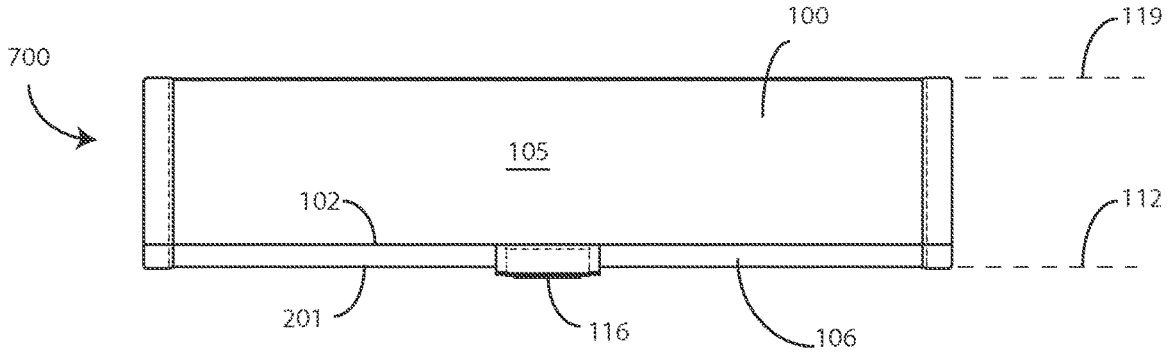
FIG. 27 is another bottom plan view of one explanatory device in accordance with one or more embodiments of the disclosure.
Figure 28:
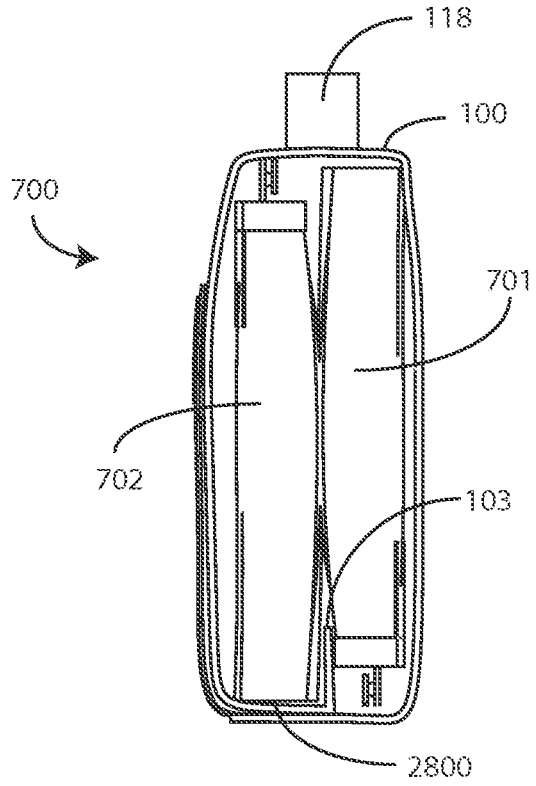
FIG. 28 is another right elevation view of one explanatory device in accordance with one or more embodiments of the disclosure.
Figure 29:
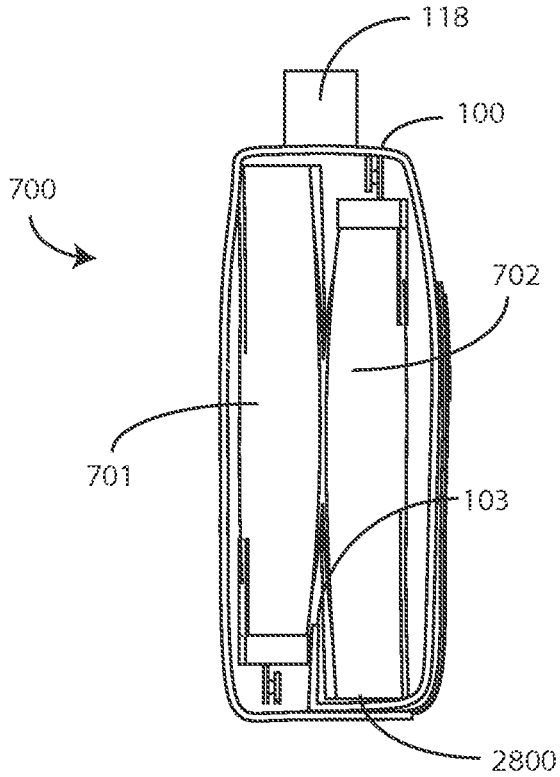
FIG. 29 is another left elevation view of one explanatory device in accordance with one or more embodiments of the disclosure.
Figure 30:
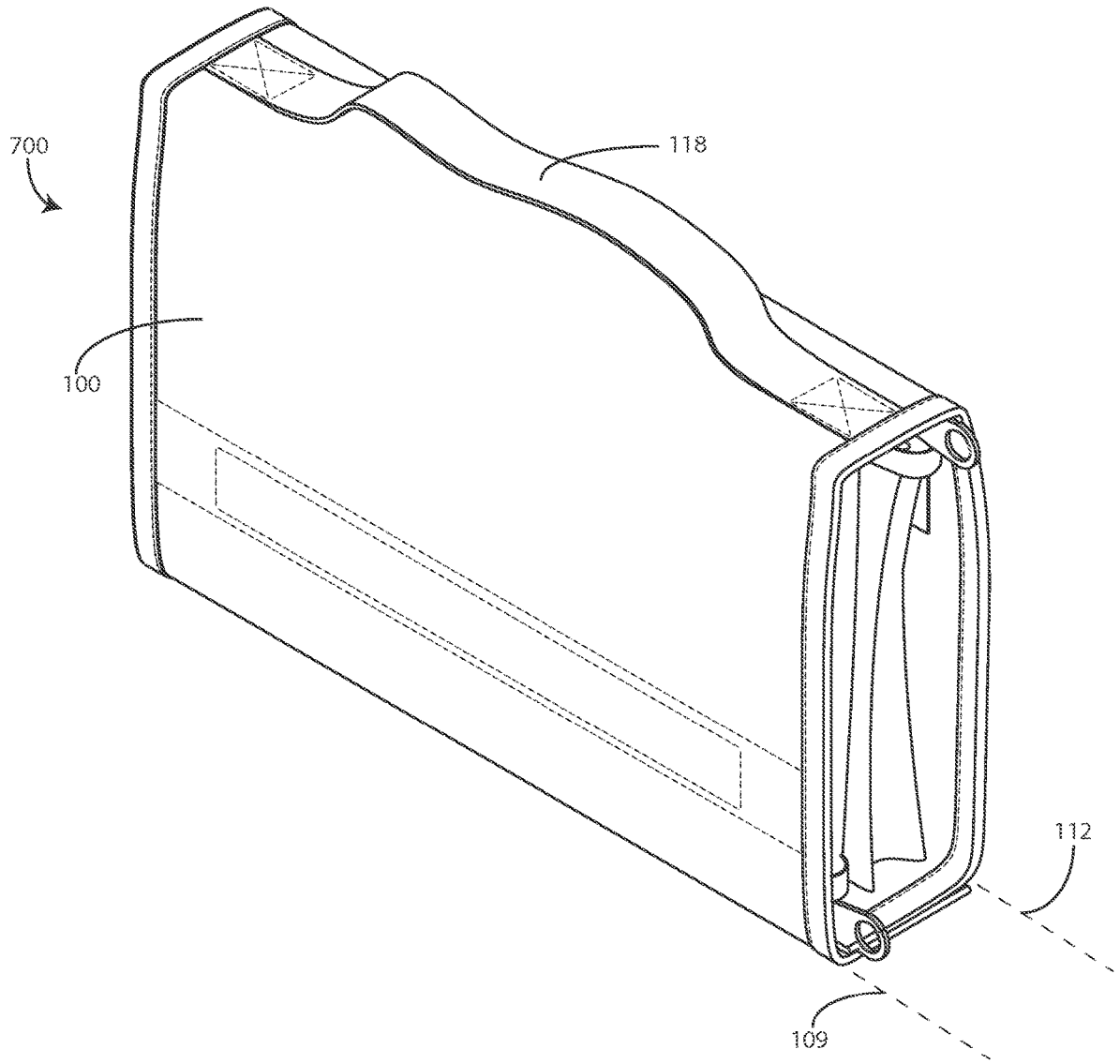
FIG. 30 is another perspective view of one explanatory device in accordance with one or more embodiments of the disclosure.
Figure 31:
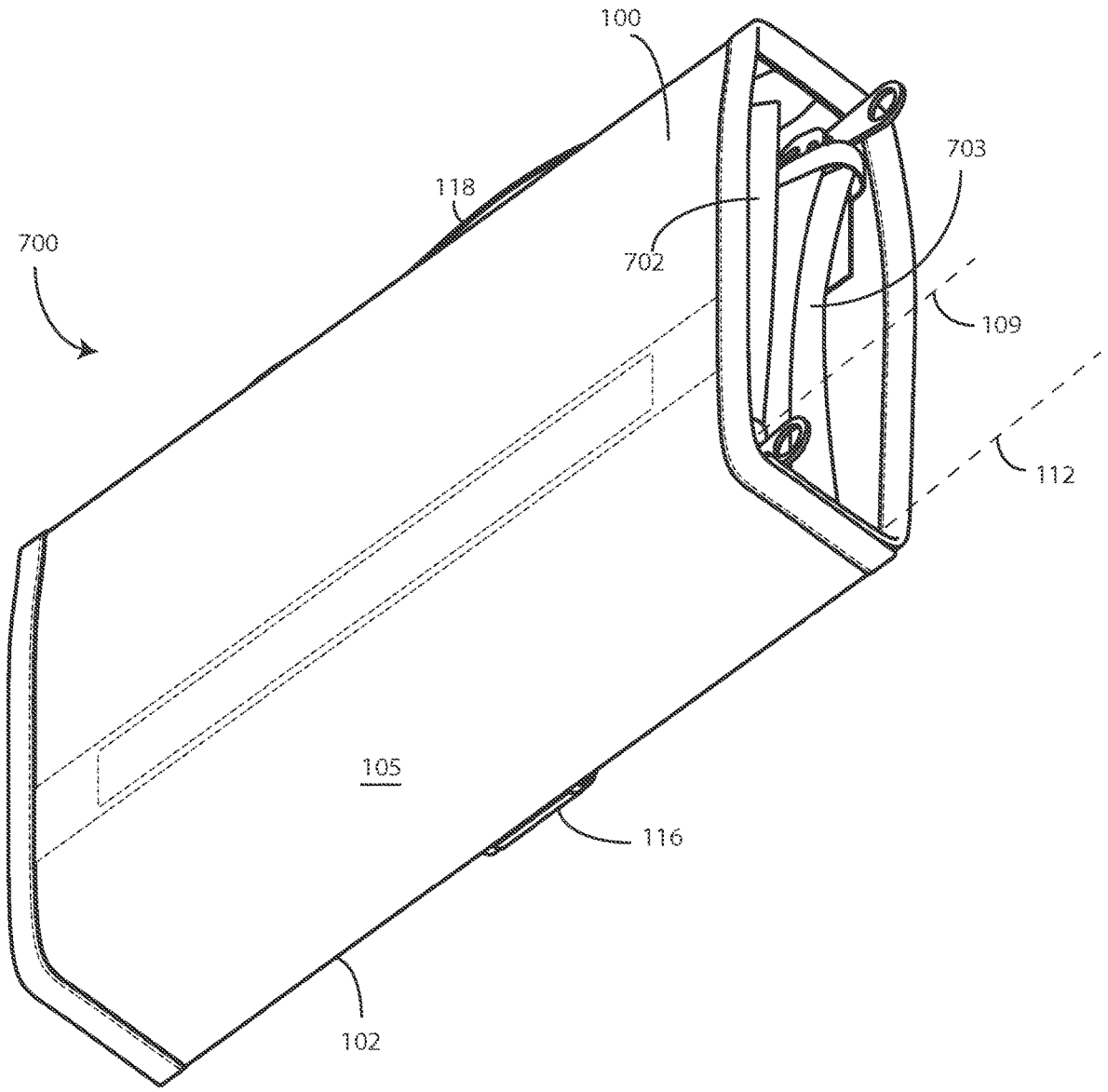
FIG. 31 is another perspective view of one explanatory device in accordance with one or more embodiments of the disclosure.

As noted above, in one or more embodiments the base layer 100 can be folded from the open configuration shown in FIGS. 17-23 to a closed configuration. Turning now to FIGS. 24-31, illustrated therein is the pack 700 in the closed configuration. FIG. 24 is a front elevation view of the pack 700, while FIG. 25 is a rear elevation view of the pack 700. FIG. 26 is a right elevation view of the pack 700, while FIG. 27 is a left elevation view of the pack 700. FIG. 28 is a top plan view of the pack 700, while FIG. 29 is a bottom plan view of the pack 700. FIGS. 30-31 are perspective views of the pack 700. In each figure, the pack 700 is shown in the open configuration.

In one embodiment, when transforming to the closed configuration, the second end 103 of the base layer 100 is to fold about the fourth transverse folding line 112 to conceal a bottom end 2800 of the second pouch 702. In one embodiment the second end 103 is to fold between the first pouch 701 and the second pouch 702 when the pack 700 is in the closed position.

The first end 102 is then to fold about the first transverse folding line 109 such that the small panel 105 disposed at the first end 102 sits atop, i.e., exterior to, the small panel (106) disposed at the second end 103. The fastening extension 116 can then couple to the second major face 201 of the base layer 100 to retain the pack 700 in the closed configuration. This results in the pack 700 providing an appearance of a small briefcase, small suitcase, or small purse. A user can then carry the pack 700 by the handle 118.

Figure 32:
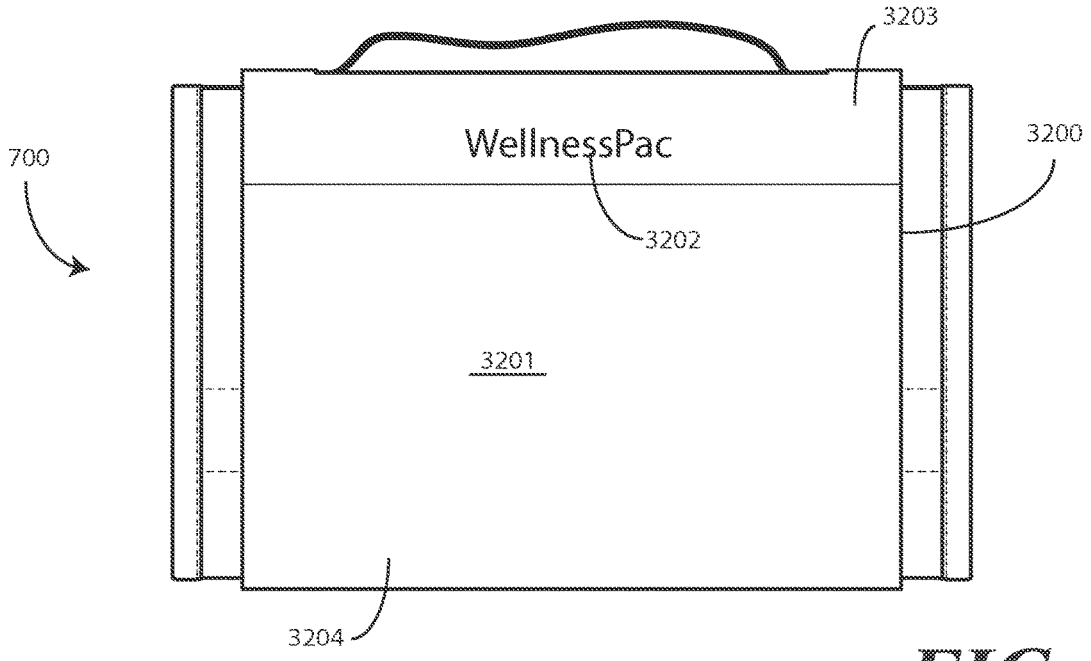
FIG. 32 illustrates another front elevation view of one explanatory device in accordance with one or more embodiments of the disclosure.
Figure 33:
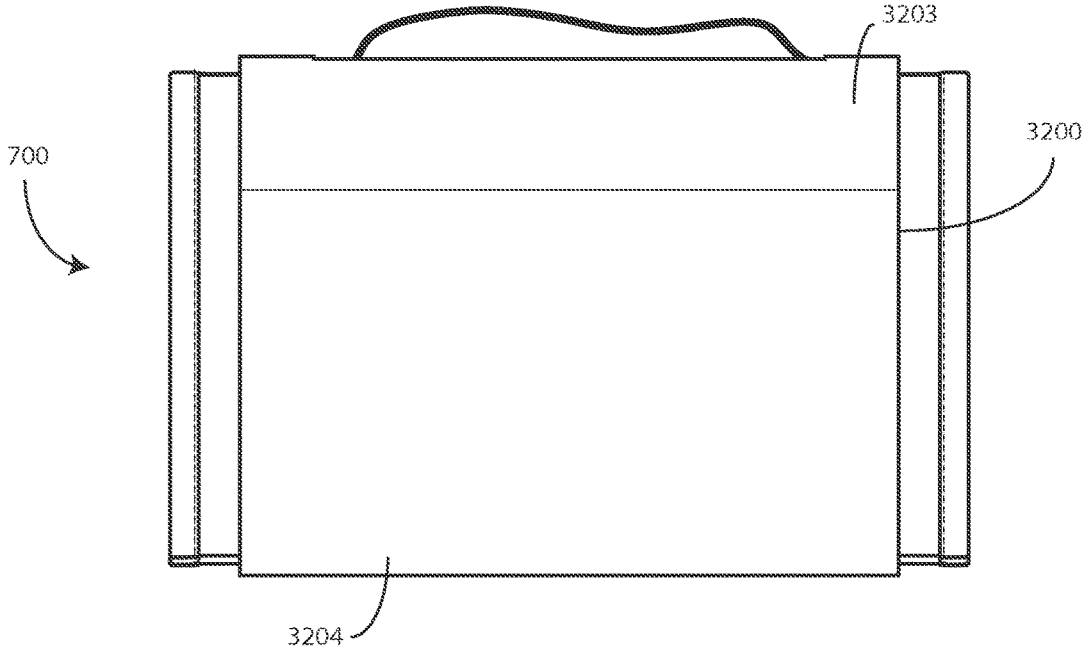
FIG. 33 illustrates another rear elevation view of one explanatory device in accordance with one or more embodiments of the disclosure.
Figure 34:
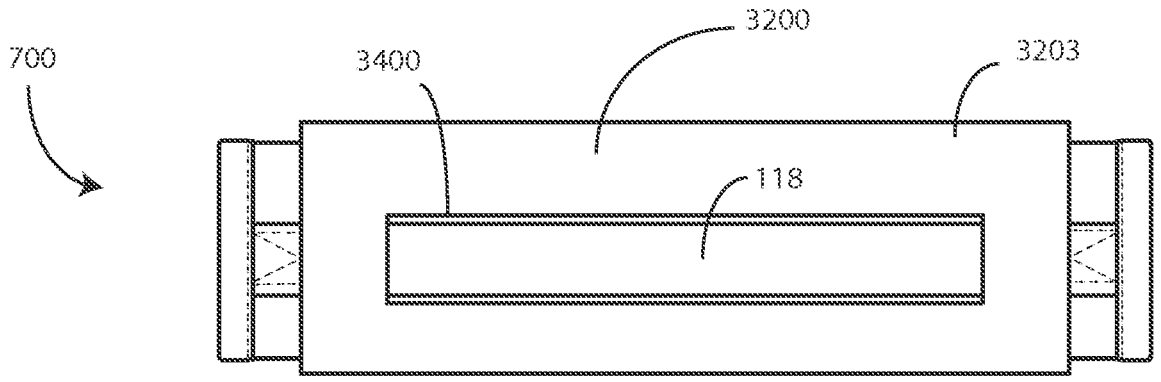
FIG. 34 illustrates another top plan view of one explanatory device in accordance with one or more embodiments of the disclosure.
Figure 35:
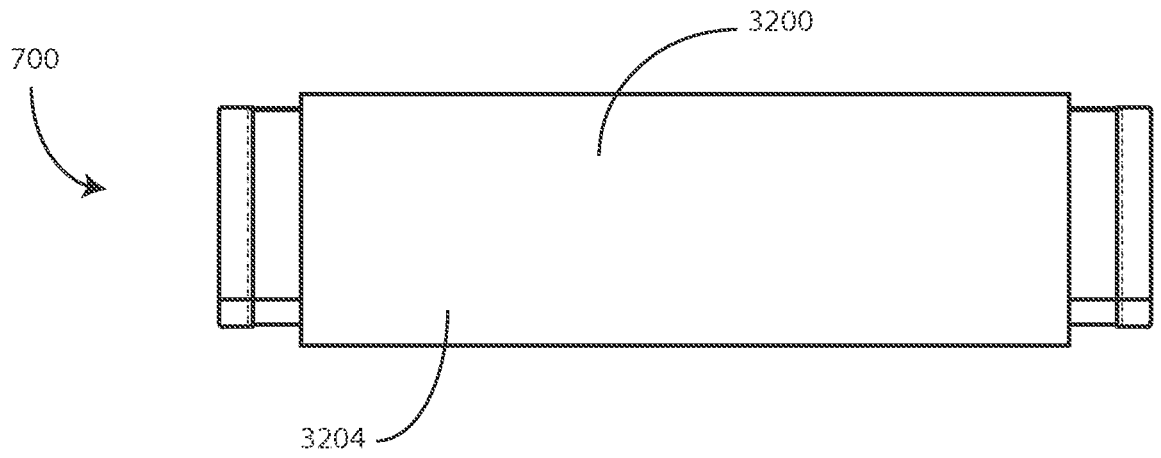
FIG. 35 is another bottom plan view of one explanatory device in accordance with one or more embodiments of the disclosure.
Figure 36:
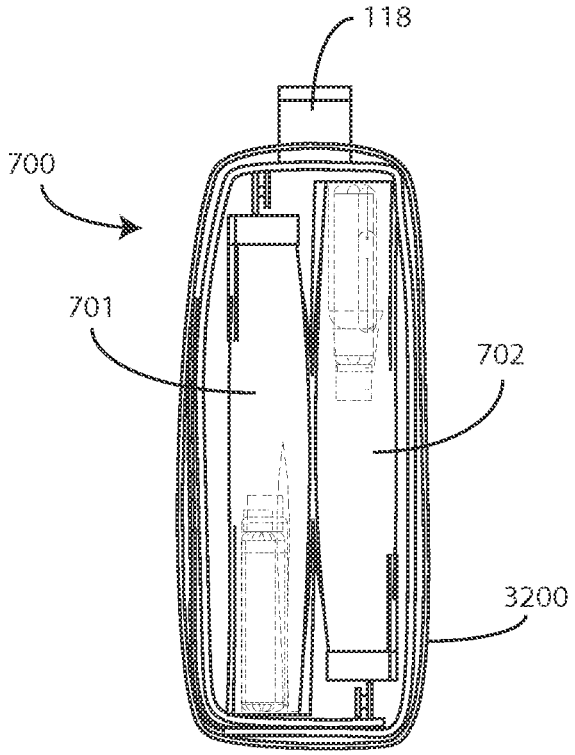
FIG. 36 is another right elevation view of one explanatory device in accordance with one or more embodiments of the disclosure.
Figure 37:
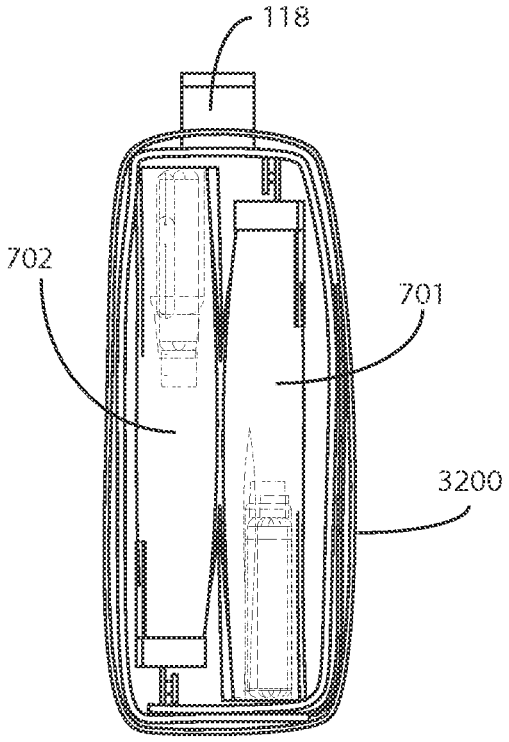
FIG. 37 is a left elevation view of one explanatory device in accordance with one or more embodiments of the disclosure.
Figure 38:
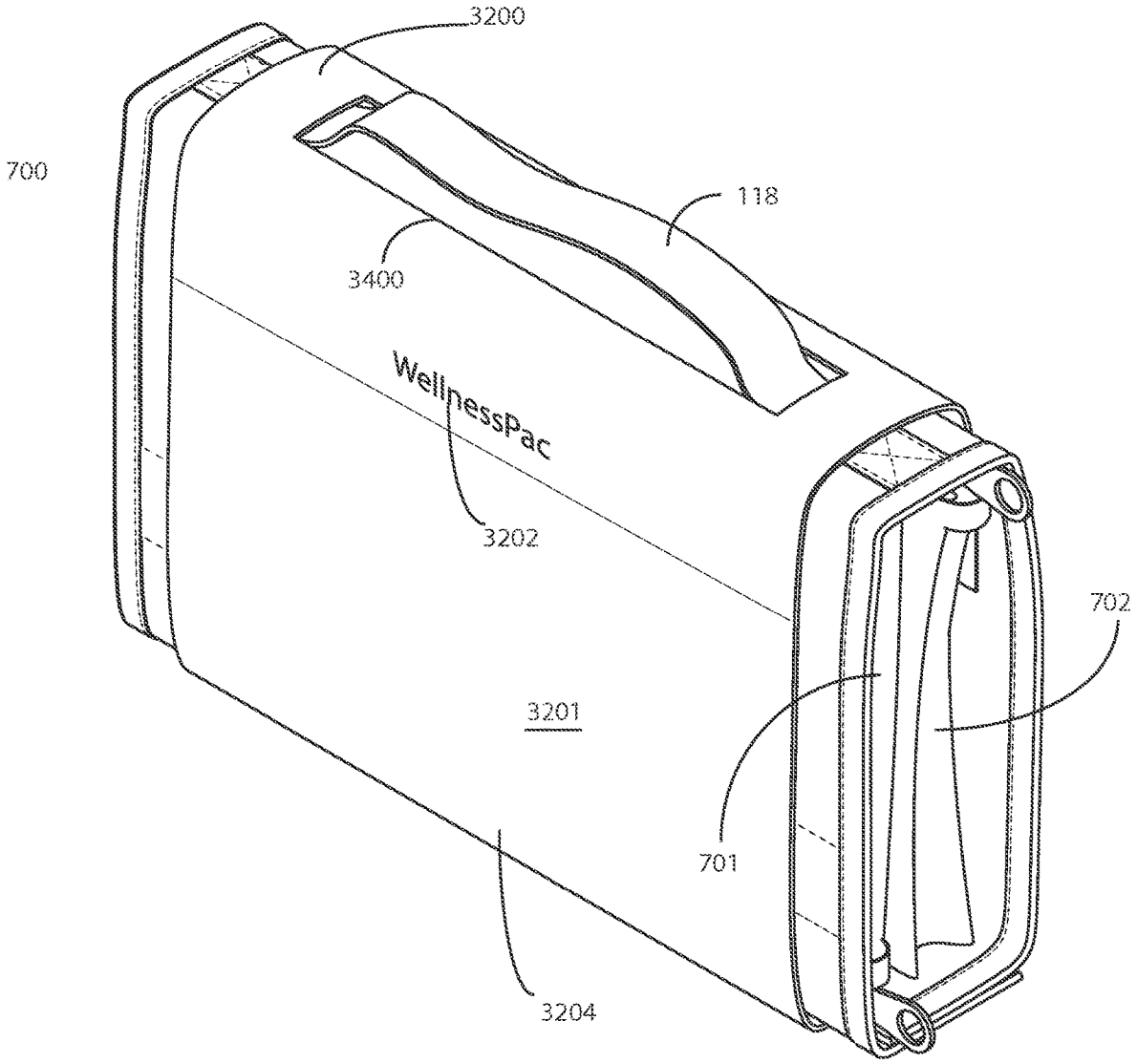
FIG. 38 is another perspective view of one explanatory device in accordance with one or more embodiments of the disclosure.
Figure 39:
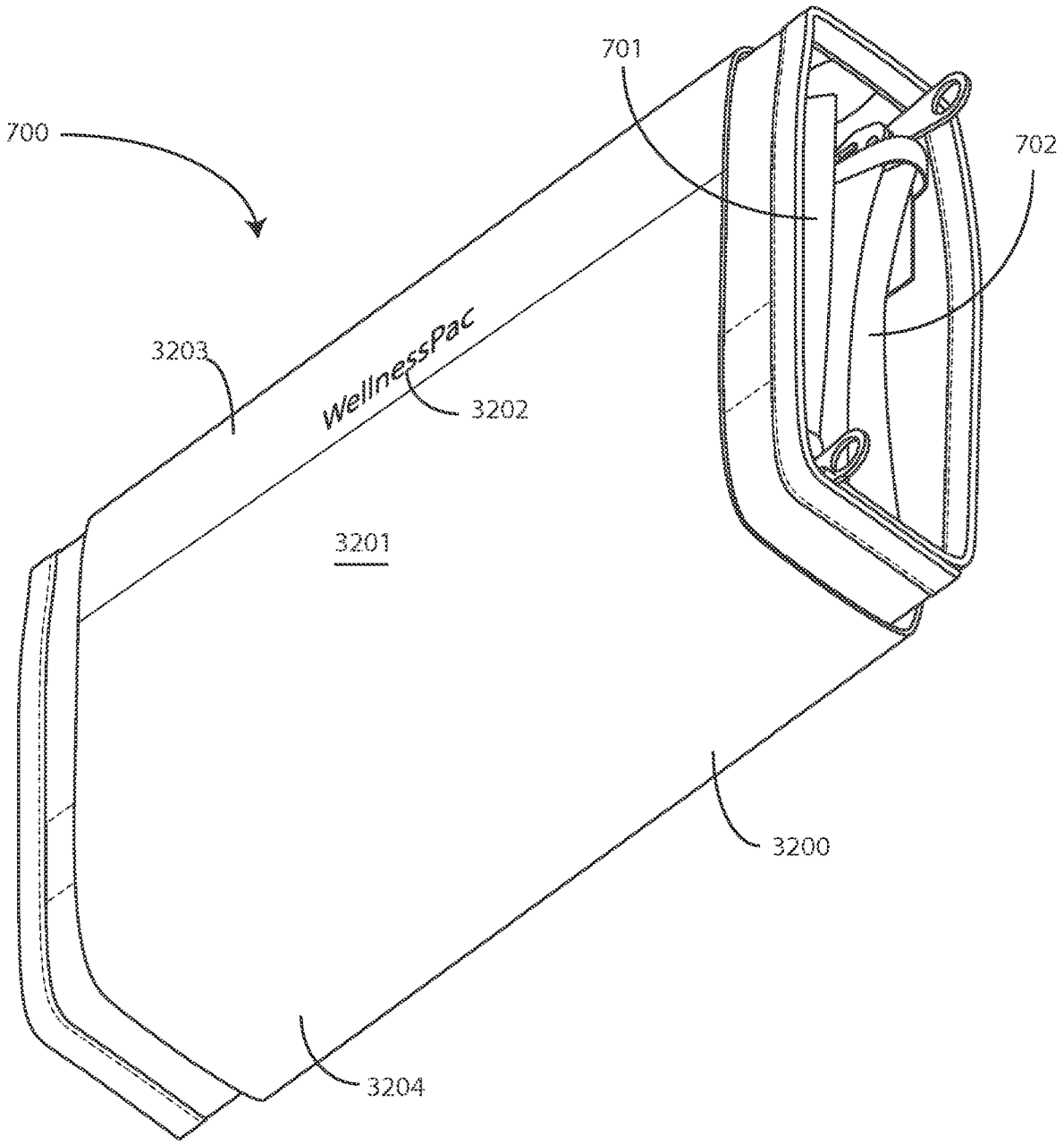
FIG. 39 is another perspective view of one explanatory device in accordance with one or more embodiments of the disclosure.

In one or more embodiments, a branding sleeve is included with the pack 700. Turning now to FIGS. 32-39, illustrated therein is one such embodiment. FIG. 32 is a front elevation view of the pack 700, while FIG. 33 is a rear elevation view of the pack 700. FIG. 34 is a right elevation view of the pack 700, while FIG. 35 is a left elevation view of the pack 700. FIG. 36 is a top plan view of the pack 700, while FIG. 37 is a bottom plan view of the pack 700. FIGS. 38-39 are perspective views of the pack 700. In each figure, the pack 700 is shown in the open configuration.

As shown in these figures, the pack 700 is encapsulated in a branding sleeve 3200. In one embodiment, the branding sleeve 3200 is manufactured from paper or cardboard and can be torn for removal from the pack 700. The branding sleeve 3200 allows the overall kit to be customized by placing branding information, kit information, and other information thereon. Additionally, when the branding sleeve 3200 is intact and has not been torn, a user is provided with assurance that the pack 700 is fresh and has not been used.

For example, in one embodiment a healthcare service provider can place brand information on the branding sleeve 3200 to promote and strengthen brand equity. Other information can be placed on the branding sleeve 3200 as well. For example, in one embodiment manufacturer information can be placed on the branding sleeve 3200. In one embodiment tracking information, such as a lot number, can be placed on the branding sleeve 3200. Where applicable, in one embodiment an expiration date can be placed on the branding sleeve 3200.

Branding slogans and other indicia can be placed on the branding sleeve 3200. For example, in one embodiment the sentences "We provide all our patients with the essentials they need to stay clean, comfortable, and well rested. This is an important part of healing and recovery, both here and at home" can be placed on the branding sleeve 3200. Contents of the pouches 701, 702 can be placed on the branding sleeve 3200 as well. For example, in one embodiment the branding sleeve 3200 can read: "Refresh: Shampoo/cleansing gel, moisturizing lotion, hand sanitizer, lip balm, toothbrush, and tooth paste." In another embodiment, the branding sleeve 3200 can read: "Relax: Earplugs, eye mask, puzzles, questions for my caregiver, pencil, do not disturb card." Combinations of these sentences can be used. Other sentences will be obvious to those of ordinary skill in the art having the benefit of this disclosure.

In one or more embodiments, a name for the pack 700 can be printed on the branding sleeve 3200. For example, in one embodiment a front face 3201 of the branding sleeve 3200 includes a single word identifier 3202. In this illustrative embodiment, the single word identifier 3202 is "Wellness-Pac." Other single word identifiers 3202 will be obvious to those of ordinary skill in the art having the benefit of this disclosure.

In one or more embodiments, the branding sleeve 3200 can be multicolored. For example, a first portion 3203 of the branding sleeve 3200 can be a first color, while a second portion 3204 can be a second color. The multi-colored configuration can serve as a mnemonic device as to what is included in the pack 700. In one embodiment, the first portion 3203 of the branding sleeve 3200 is white, while the second portion 3204 of the branding sleeve 3200 is blue. Other color combinations will be obvious to those of ordinary skill in the art having the benefit of this disclosure.

In one embodiment, the branding sleeve 3200 defines an aperture 3400 through which the handle 118 may be accessed. This aperture 3400 allows the user to carry the pack 700 by the handle 118 even when the branding sleeve is disposed thereon. Moreover, the aperture 3400 allows the pack 700 to retain its appearance of a small briefcase, small suitcase, or small purse.

Figure 40:
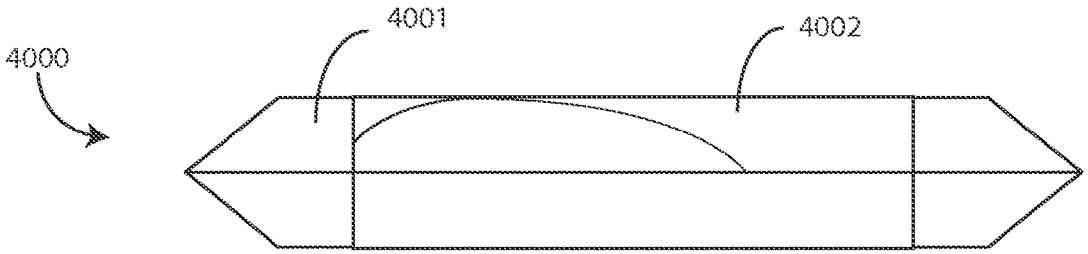
FIG. 40 is a bottom plan view of another explanatory device in accordance with one or more embodiments of the disclosure.
Figure 41:
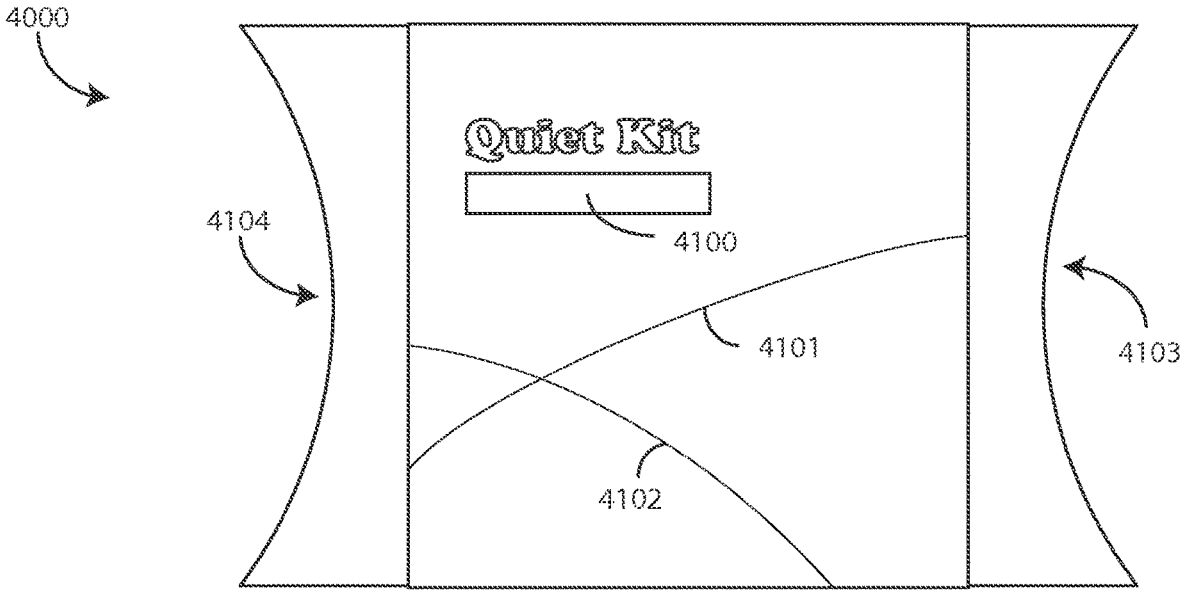
FIG. 41 is a front elevation view of another explanatory device in accordance with one or more embodiments of the disclosure.
Figure 42:
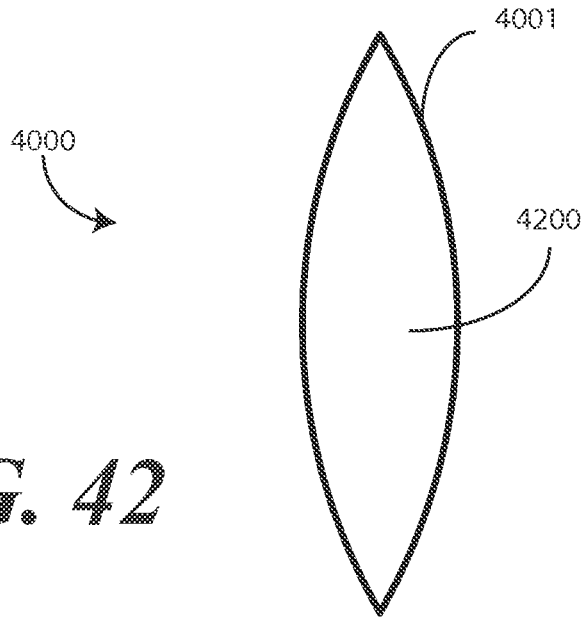
FIG. 42 is a right elevation view of another explanatory device in accordance with one or more embodiments of the disclosure.
Figure 43:
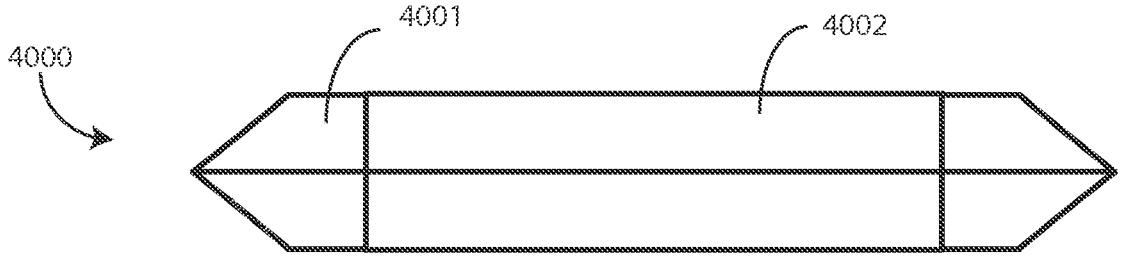
FIG. 43 is a top plan view of another explanatory device in accordance with one or more embodiments of the disclosure.
Figure 44:
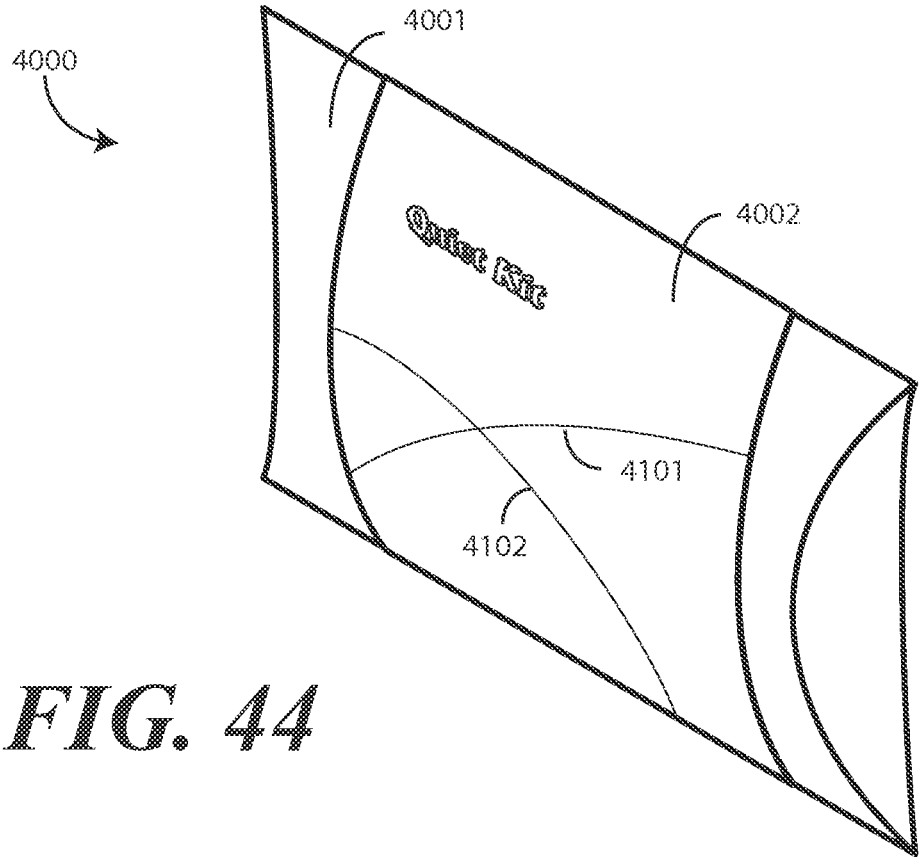
FIG. 44 is a perspective view of another explanatory device in accordance with one or more embodiments of the disclosure.
Figure 45:
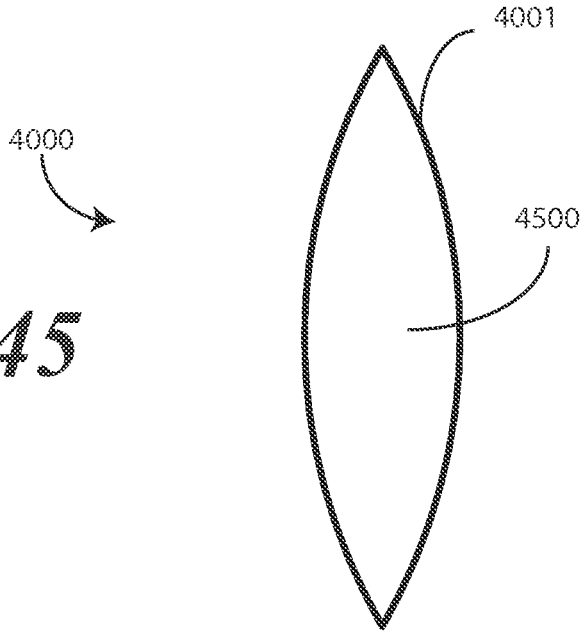
FIG. 45 is a left elevation view of another explanatory device in accordance with one or more embodiments of the disclosure.

Turning now to FIGS. 40-55, illustrated therein is an alternate pack 4000 configured in accordance with one or more embodiments of the disclosure. FIG. 40 is a bottom plan view of the pack 4000 in a closed configuration, while FIG. 41 is a front elevation view of the pack 4000 in the closed configuration. FIG. 42 is a right side elevation view of the pack 4000 in the closed configuration, while FIG. 43 is a top plan view of the pack 4000 in the closed configuration. FIG. 44 is a perspective view of the pack 4000 in the closed configuration, while FIG. 45 is a left elevation view of the pack 4000 in the closed configuration.

Figure 46:
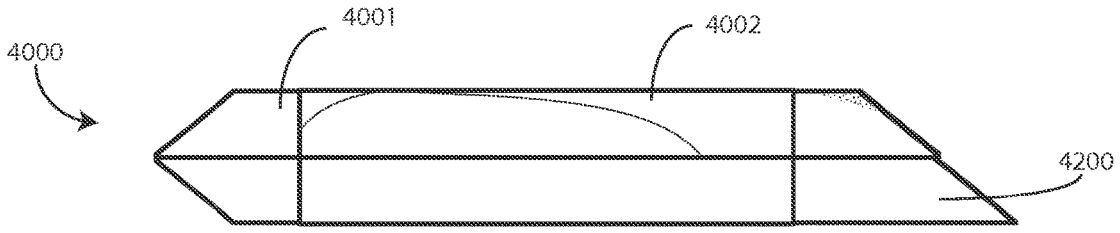
FIG. 46 is another bottom plan view of another explanatory device in accordance with one or more embodiments of the disclosure.
Figure 47:
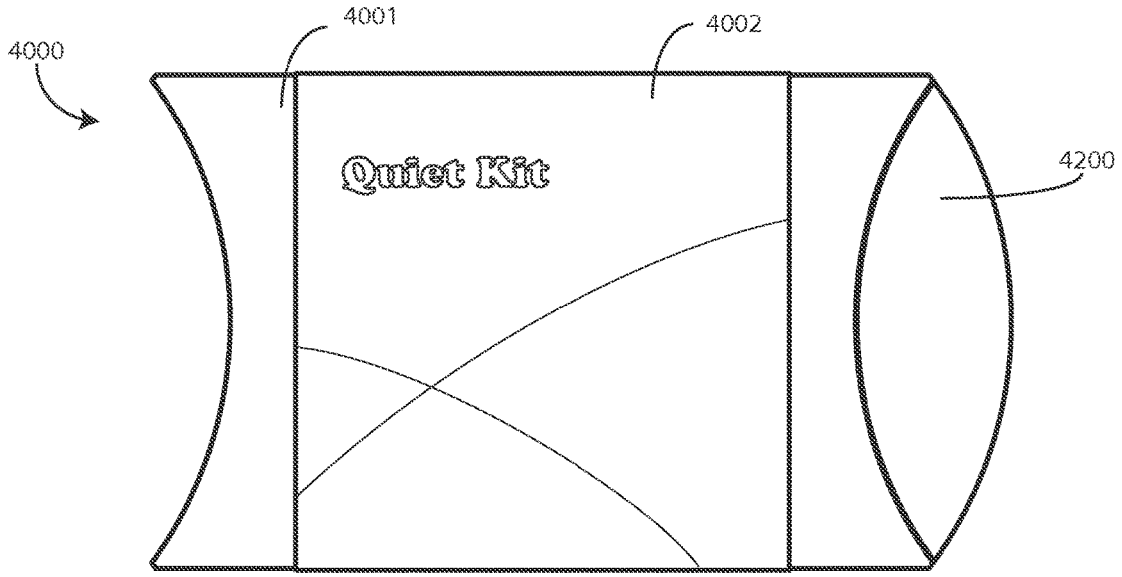
FIG. 47 is another front elevation view of another explanatory device in accordance with one or more embodiments of the disclosure.
Figure 48:
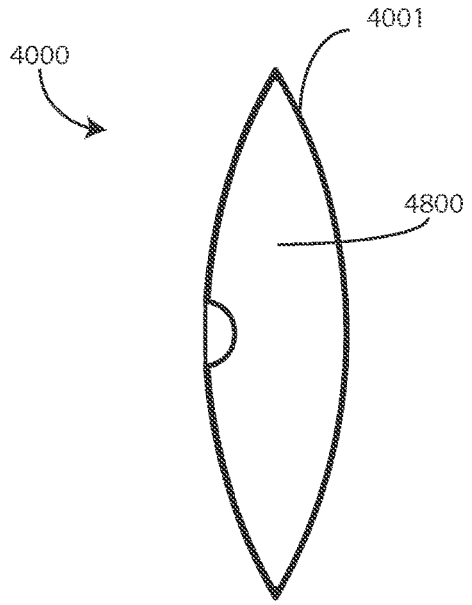
FIG. 48 is another right elevation view of another explanatory device in accordance with one or more embodiments of the disclosure.
Figure 49:
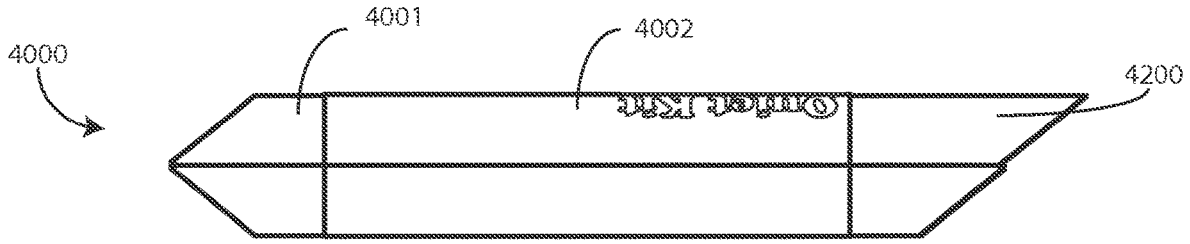
FIG. 49 is another top plan view of another explanatory device in accordance with one or more embodiments of the disclosure.
Figure 50:
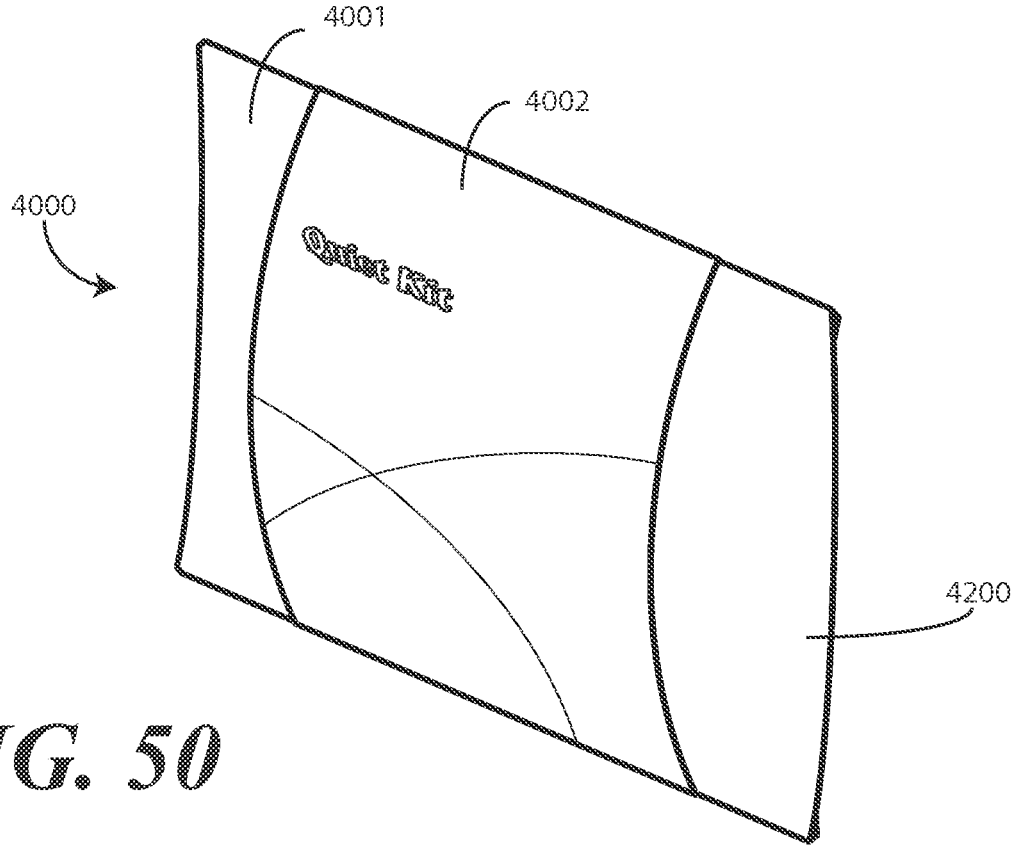
FIG. 50 is another perspective view of another explanatory device in accordance with one or more embodiments of the disclosure.
Figure 51:
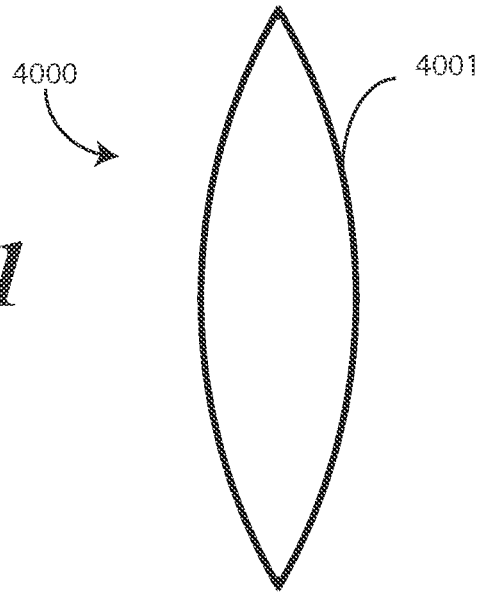
FIG. 51 is another left elevation view of another explanatory device in accordance with one or more embodiments of the disclosure.

FIG. 46 is a bottom plan view of the pack 4000 with a first flap 4200 in an open position. FIG. 47 is a front elevation view of the pack 4000 with the first flap 4200 in the open position. FIG. 48 is a right elevation view of the pack 4000 with the first flap (4200) in the open position. FIG. 49 is a top plan view of the pack 4000 with the first flap 4200 in the open position. FIG. 51 is a left elevation view of the pack 4000 with the first flap (4200) in the open position.

Figure 52:
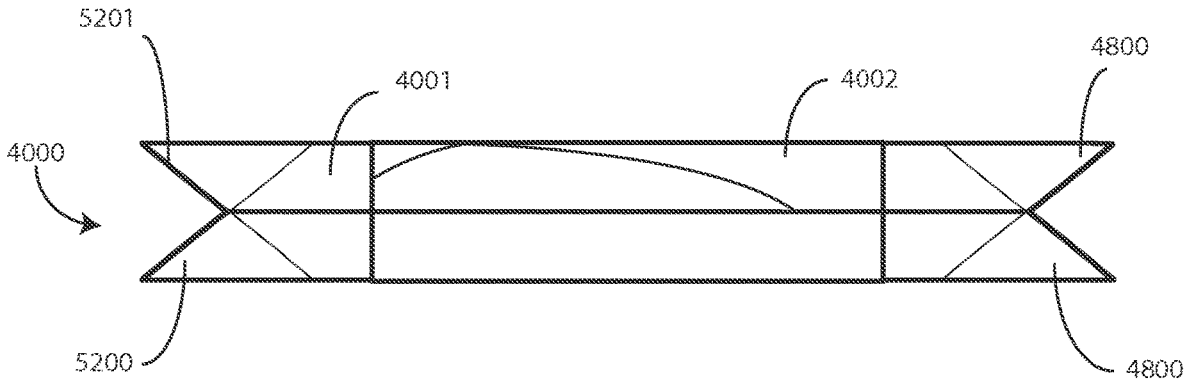
FIG. 52 is another bottom plan view of another explanatory device in accordance with one or more embodiments of the disclosure.
Figure 53:
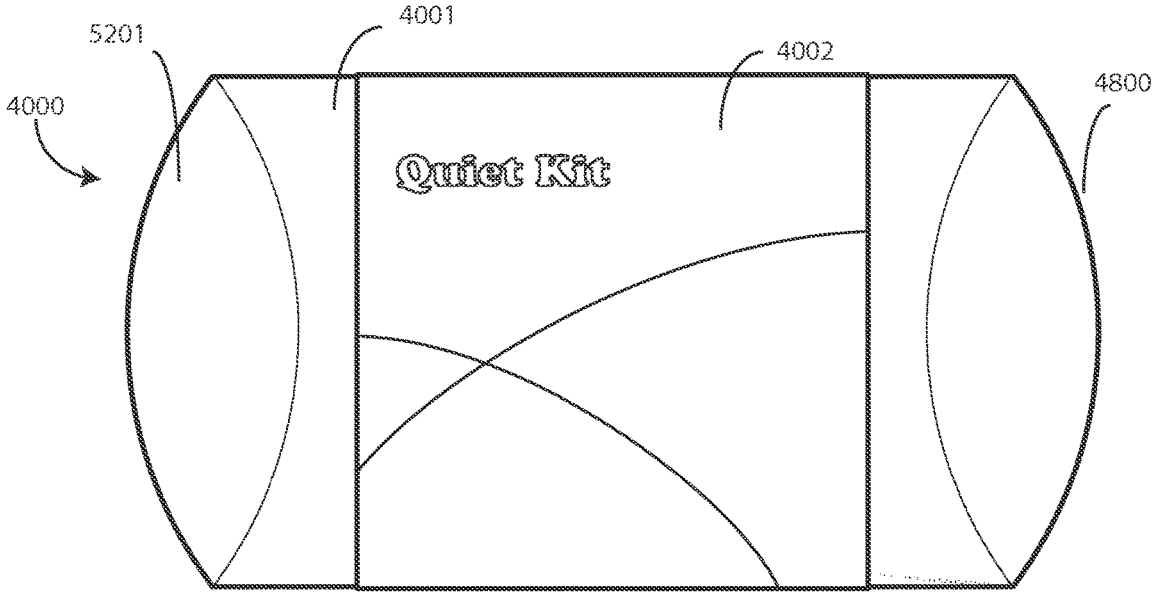
FIG. 53 is another front elevation view of another explanatory device in accordance with one or more embodiments of the disclosure.
Figure 54:
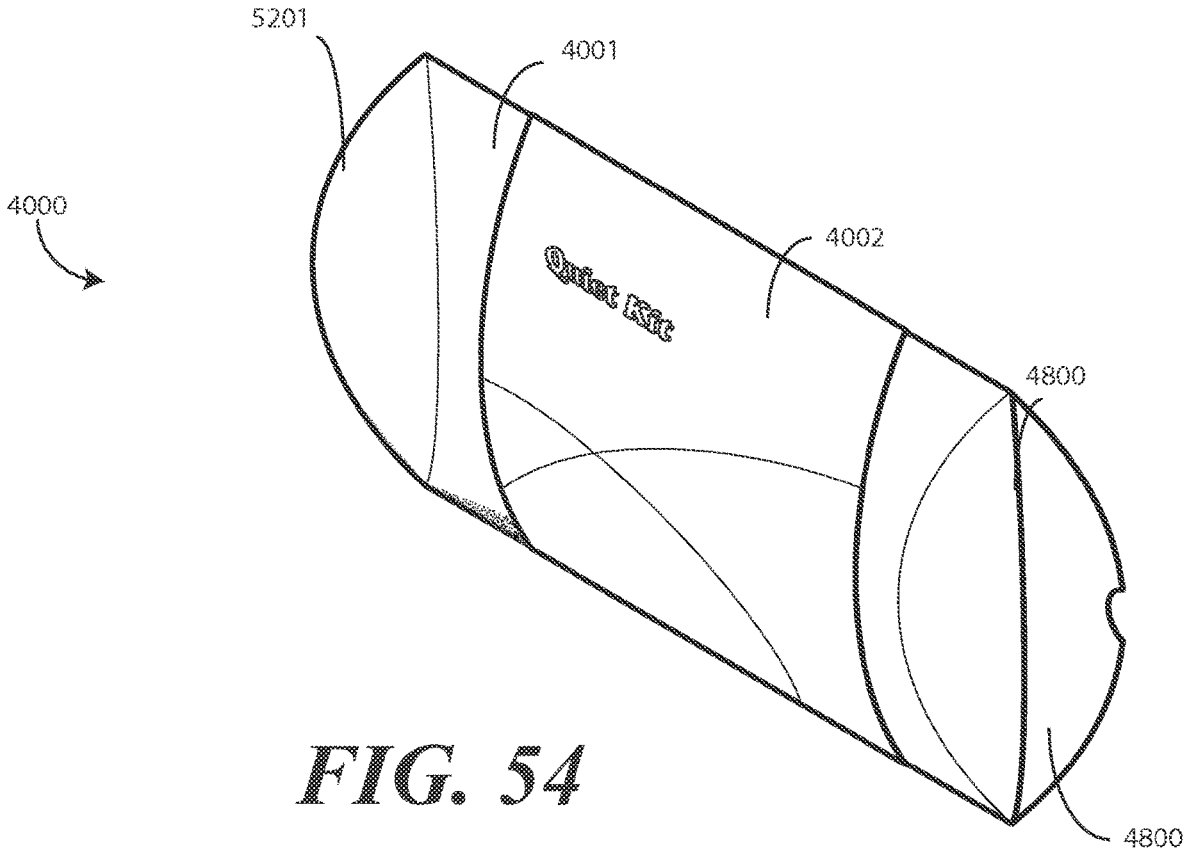
FIG. 54 is another perspective view of another explanatory device in accordance with one or more embodiments of the disclosure.
Figure 55:
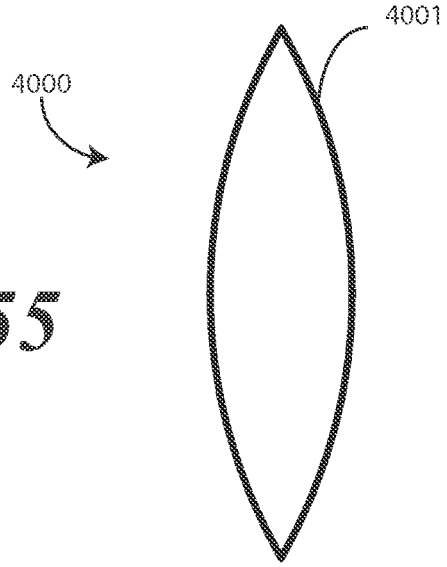
FIG. 55 is another left elevation view of another explanatory device in accordance with one or more embodiments of the disclosure.

FIG. 52 is a bottom plan view of the pack 4000 with the first flap 4200, a second flap 5200, a third flap 5200, and a fourth flap 5201 in the open position. FIG. 53 is a front elevation view of the pack 4000 with the first flap 4200, a second flap 5200, a third flap 5200, and a fourth flap 5201 in the open position. FIG. 54 is a perspective view of the pack 4000 with the first flap 4200, a second flap 5200, a third flap 5200, and a fourth flap 5201 in the open position. FIG. 55 is a left elevation view of the pack 4000 with the first flap 4200, a second flap 5200, a third flap 5200, and a fourth flap 5201 in the open position.

Embodiments of the disclosure contemplate that some use applications may require only a single pack. Moreover, embodiments of the disclosure contemplate that sometimes a hangable kit is unnecessary. To accommodate such use cases, the pack 4000 of FIGS. 40-55 provides a single kit with easy-opening flaps that can contain items associated with a Refresh Kit, a Relax Kit, a Quiet Kit, or other kits in accordance with embodiments of the disclosure.

The pack 4000 of FIGS. 40-55 includes a container 4001 for housing items. In one embodiment, the container 4001 is manufactured from cardboard or another paper-based composite. Other materials will be obvious to those of ordinary skill in the art having the benefit of this disclosure.

In the illustrative embodiment of FIGS. 40-55, a branding sleeve 4002 is disposed about the container 4001. In one embodiment, the branding sleeve 4002 is manufactured from paper or cardboard and can selectively slide off the pack 4000 for removal. The branding sleeve 4002 allows the overall kit to be customized by placing branding information, kit information, and other information thereon.

For example, in one embodiment a healthcare service provider can place brand information on the branding sleeve 4002 to promote and strengthen brand equity. Other information can be placed on the branding sleeve 4002 as well. For example, in one embodiment manufacturer information can be placed on the branding sleeve 4002. In one embodiment tracking information, such as a lot number, can be placed on the branding sleeve 4002. Where applicable, in one embodiment an expiration date can be placed on the branding sleeve 4002.

In one embodiment, the branding sleeve 4002 can include an inspirational phrase 4100 defining how a human condition is improved by use of the container contents. Illustrating by example, in one embodiment the pack 4000 is configured as a Quiet Kit and includes contents to help a user relax and fall asleep. In such an embodiment, the branding sleeve 4002 can include a quote by Francis Bacon stating, "Silence is the sleep that nourishes wisdom." Accordingly, where the pack 4000 includes earplugs and an eye mask for example, use of these items may help the user achieve a human condition of silence, which will help nourish their wisdom, which is an improvement on this condition. Other inspirational phrases 4100 will be obvious to those of ordinary skill in the art.

In one embodiment, the branding sleeve 4002 includes a pair of intersecting convex curves 4101, 4102. In one embodiment, the intersecting curves 4101, 4012 provide a mnemonic device indication of the container contents. For example, a user may come to recognize the intersecting curves 4101, 4102 with falling asleep, as the intersecting curves 4101, 4102 blend together to suggest a person's consciousness relaxing as they fall asleep. Accordingly, when the user sees the intersecting curves 4101, 4102, this serves as a mnemonic device that the pack 4000 is configured as a Quiet Kit.

In one embodiment, the intersecting curves 4101, 4012 define a color barrier. For example, portions of the branding sleeve 4002 above the intersecting curves 4101, 4102 can be a first color, such as white, while portions of the branding sleeve 4002 beneath the intersecting curves 4101, 4102 can be another color, such as purple. Other color combinations will be obvious to those of ordinary skill in the art having the benefit of this disclosure.

Branding slogans and other indicia can be placed on the branding sleeve 4002. For example, in one embodiment the sentences "We provide all our patients with the essentials they need to stay clean, comfortable, and well rested. This is an important part of healing and recovery, both here and at home" can be placed on the branding sleeve 4002. Contents of the container 4001 can be placed on the branding sleeve 4002 as well. For example, in one embodiment the branding sleeve 4002 can read: "Quiet Kit: Earplugs, eye mask, puzzles, questions for my caregiver, pencil, do not disturb card." Other sentences will be obvious to those of ordinary skill in the art having the benefit of this disclosure.

In one or more embodiments, each end of the container 4001 includes a pair of flaps 4200, 4800, 5200, 5201 to close the ends 4103, 4014 of the container 4001. For example, the first end 4103 is closed by a first flap 4200 and a second flap 4800. Similarly, the second end 4104 is closed by a third flap a third flap 5200 and a fourth flap 5201.

In one or more embodiments, each of the first flap 4200, the second flap 5200, the third flap 5200, and the fourth flap 5201 are configured to have a prolate spheroid shape. This shape resembles the shape of an eye, football, or almond. Configuring each of the first flap 4200, the second flap 5200, the third flap 5200, and the fourth flap 5201 provides an easy opening mechanism where the curvature of the container 4001 keeps each of the first flap 4200, the second flap 5200, the third flap 5200, and the fourth flap 5201 in either the open or closed position.

By using this shape for each of the first flap 4200, the second flap 5200, the third flap 5200, and the fourth flap 5201, in one embodiment the flaps define a concave profile when in the closed position (best viewed in FIG. 41) and a convex profile when in the open position (best viewed in FIG. 53. In one or more embodiments, the inner flap, e.g., flap 4800, can include a thumb aperture 4801 to assist in opening the inner flap.

Figure 56:
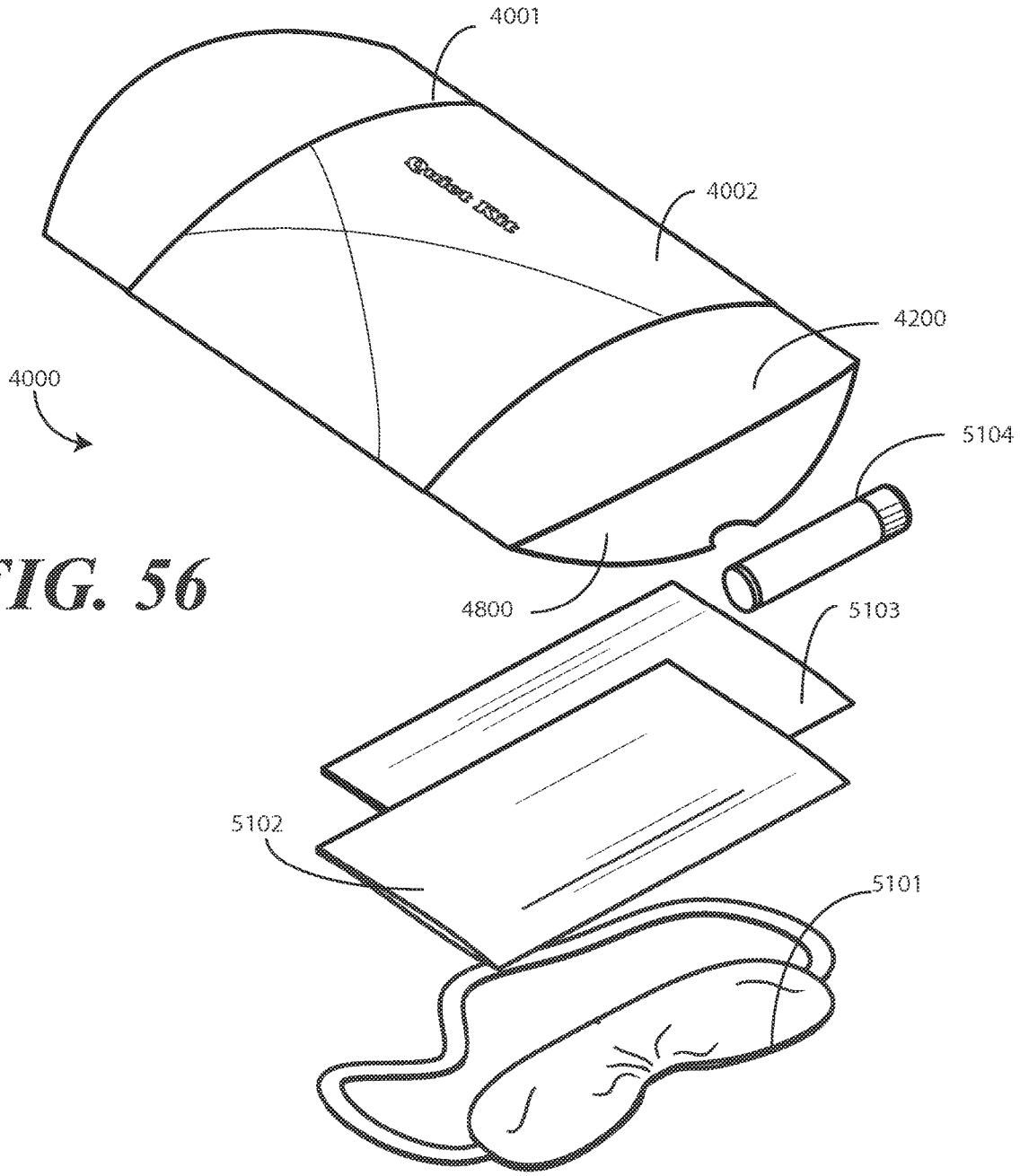
FIG. 56 is a perspective exploded view of another explanatory device in accordance with one or more embodiments of the disclosure.
Figure 57:
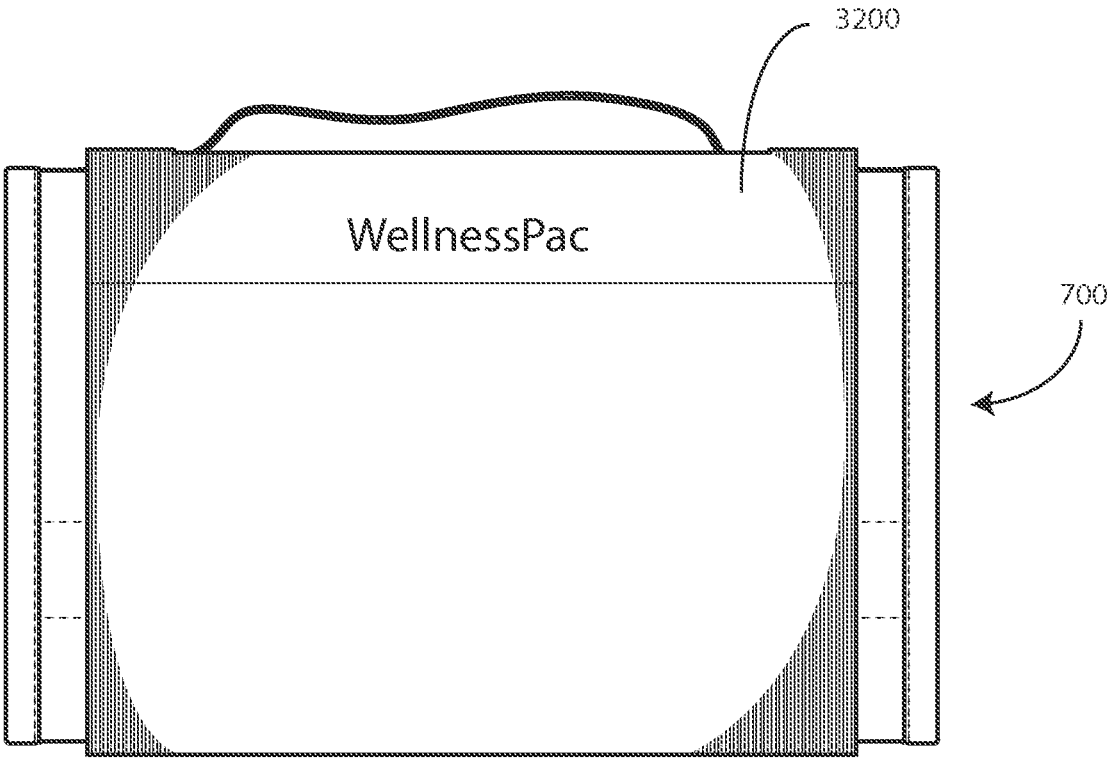
FIG. 57 is a front elevation view of one explanatory device in accordance with one or more embodiments of the disclosure that illustrates ornamental design features of the device.
Figure 58:
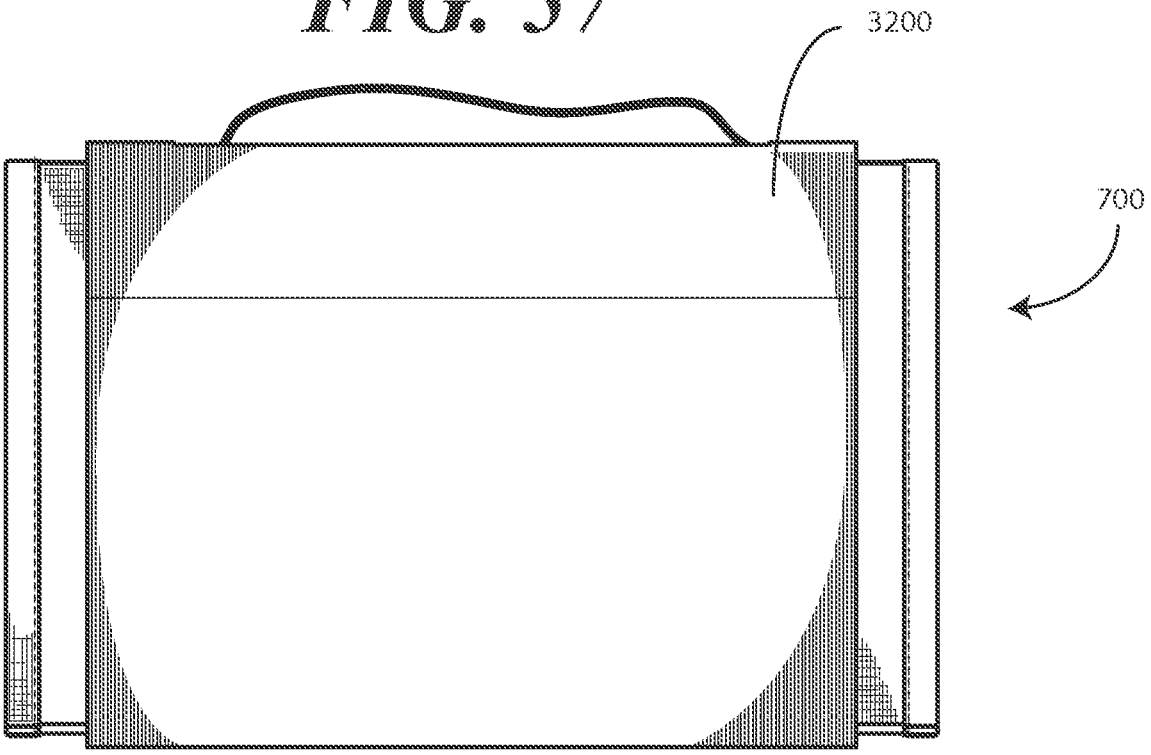
FIG. 58 is a rear elevation view of one explanatory device in accordance with one or more embodiments of the disclosure that illustrates ornamental design features of the device.
Figure 59:
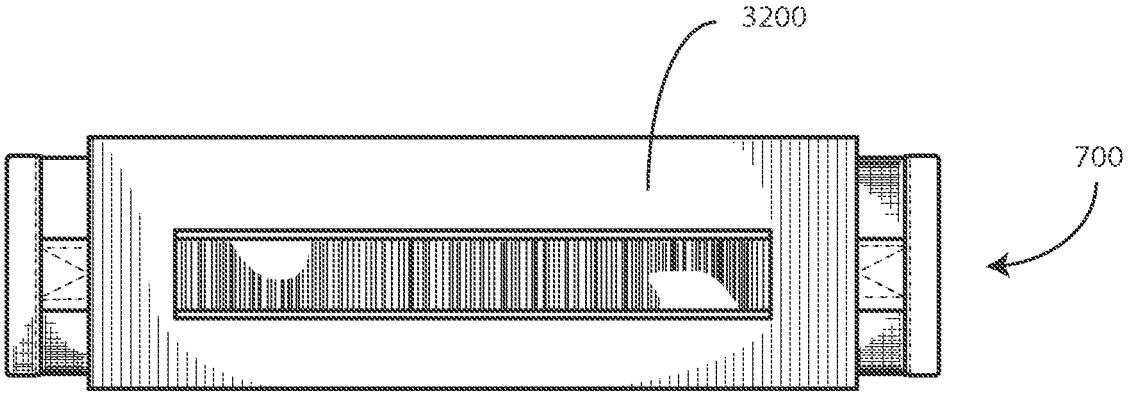
FIG. 59 is a top plan view of one explanatory device in accordance with one or more embodiments of the disclosure that illustrates ornamental design features of the device.
Figure 60:
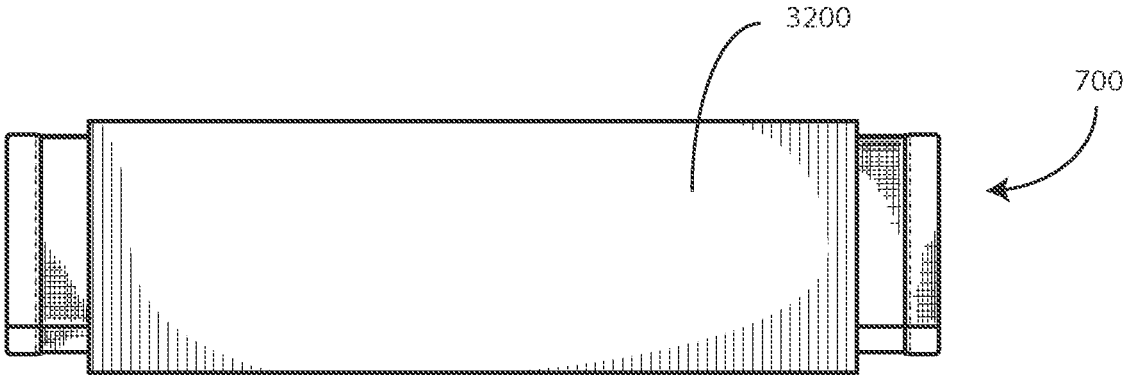
FIG. 60 is a bottom plan view of one explanatory device in accordance with one or more embodiments of the disclosure that illustrates ornamental design features of the device.
Figure 61:
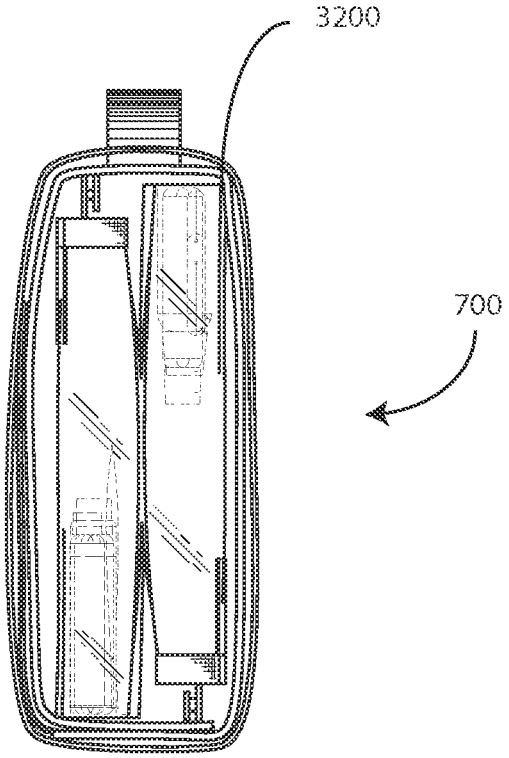
FIG. 61 is a right elevation view of one explanatory device in accordance with one or more embodiments of the disclosure that illustrates ornamental design features of the device.
Figure 62:
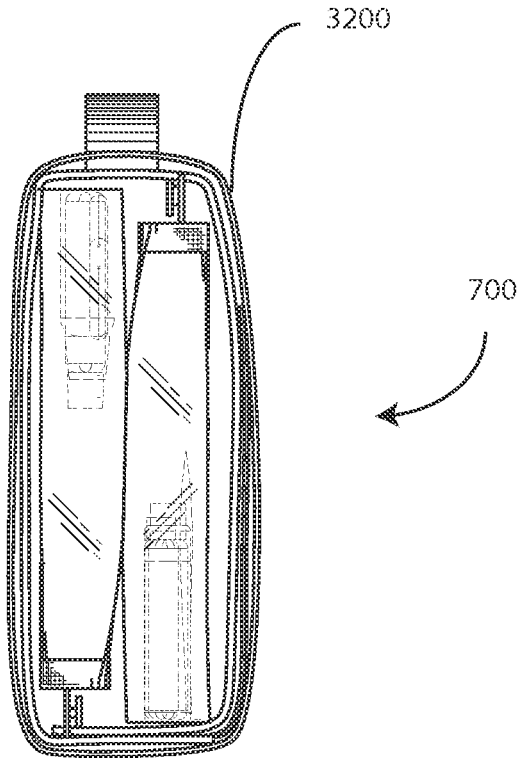
FIG. 62 is a left elevation view of one explanatory device in accordance with one or more embodiments of the disclosure that illustrates ornamental design features of the device.
Figure 63:
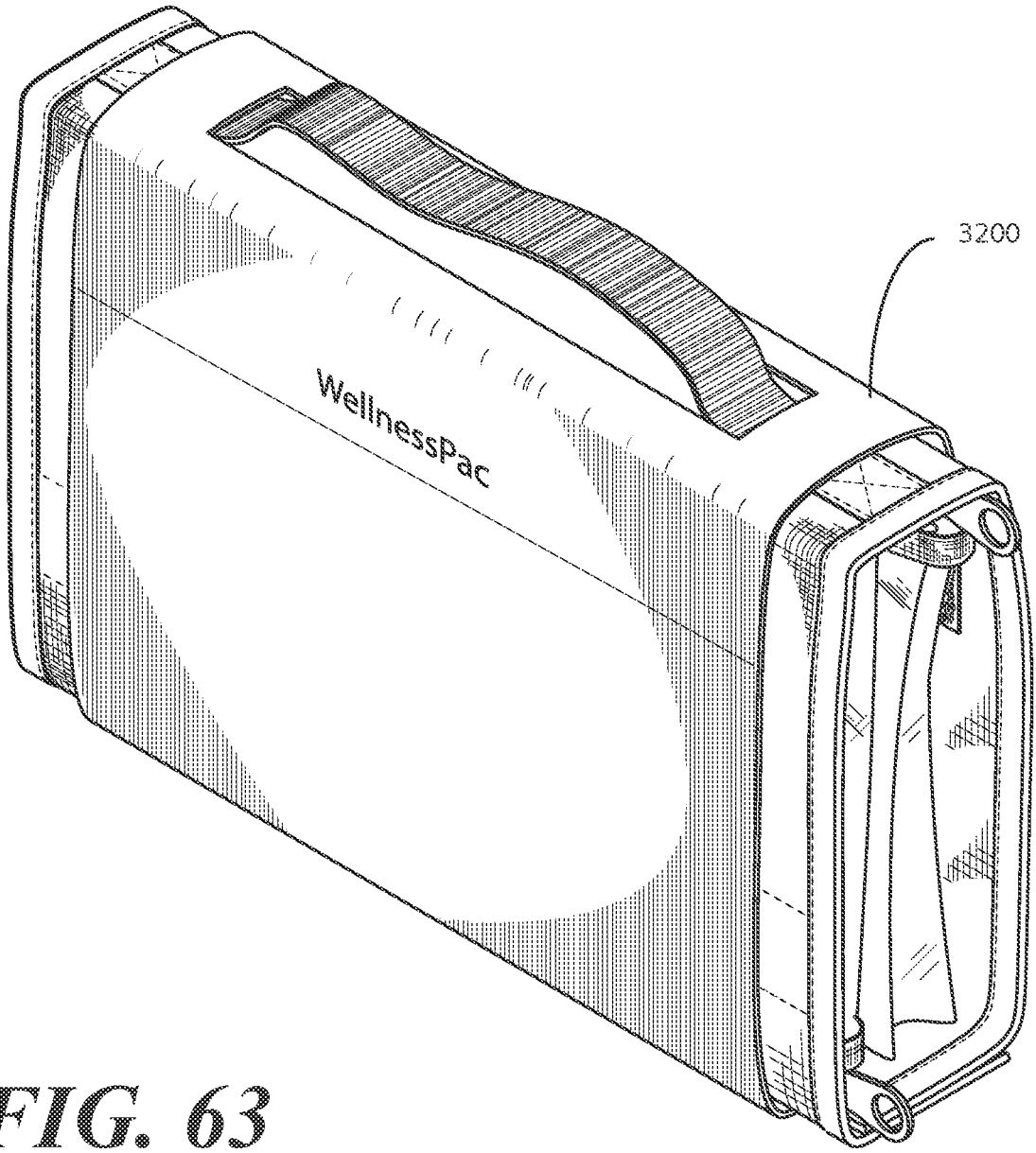
FIG. 63 is a perspective view of one explanatory device in accordance with one or more embodiments of the disclosure that illustrates ornamental design features of the device.
Figure 64:
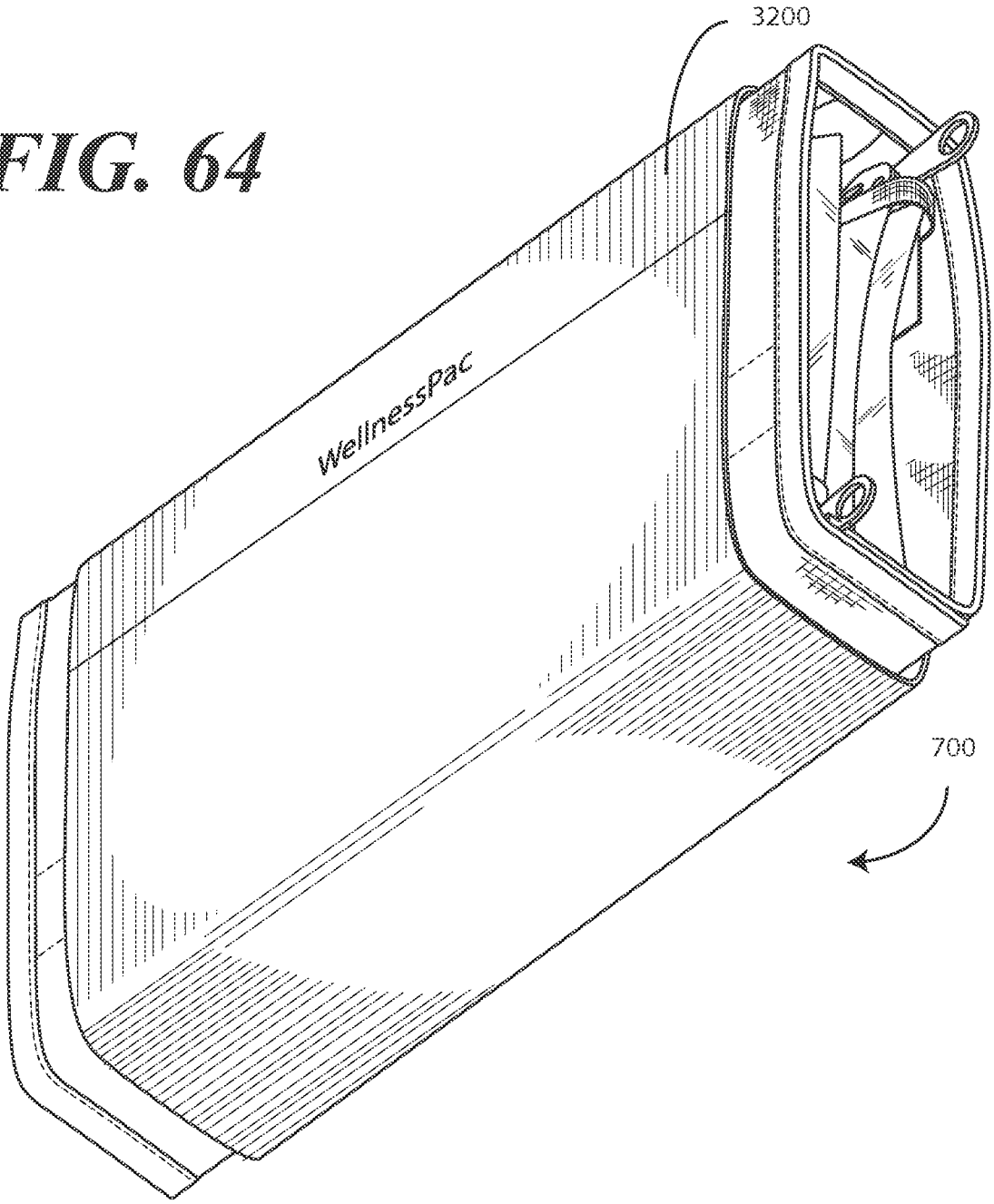
FIG. 64 is another perspective view of one explanatory device in accordance with one or more embodiments of the disclosure that illustrates ornamental design features of the device.
Figure 65:
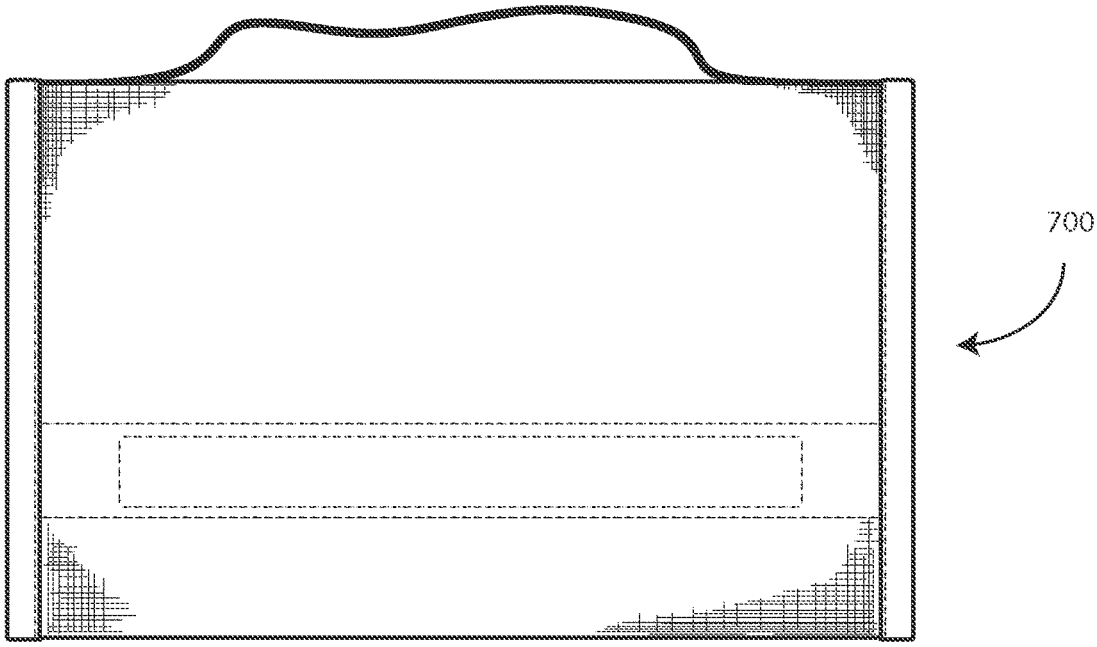
FIG. 65 is another front elevation view of one explanatory device in accordance with one or more embodiments of the disclosure that illustrates ornamental design features of the device.
Figure 66:
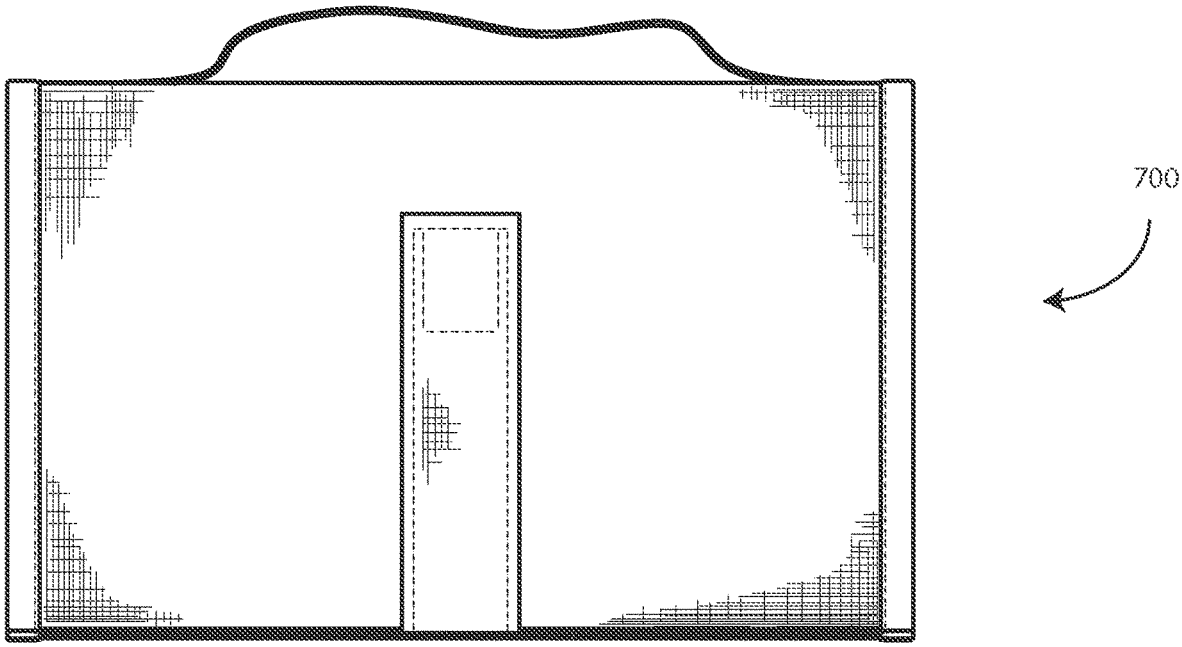
FIG. 66 is another rear elevation view of one explanatory device in accordance with one or more embodiments of the disclosure that illustrates ornamental design features of the device.
Figure 67:
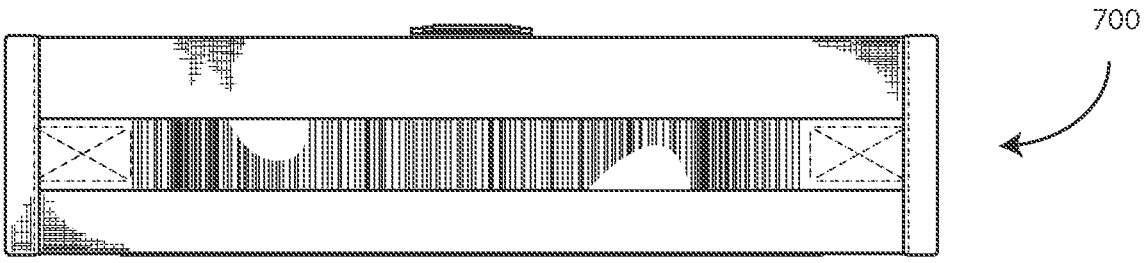
FIG. 67 is another top plan view of one explanatory device in accordance with one or more embodiments of the disclosure that illustrates ornamental design features of the device.
Figure 68:
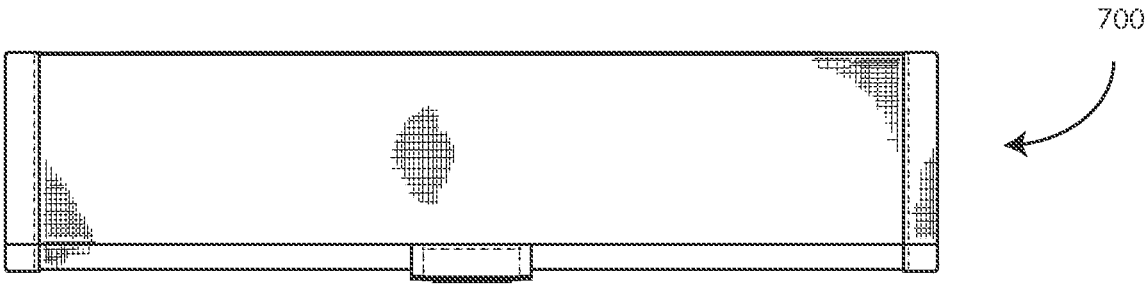
FIG. 68 is another bottom plan view of one explanatory device in accordance with one or more embodiments of the disclosure that illustrates ornamental design features of the device.
Figure 69:
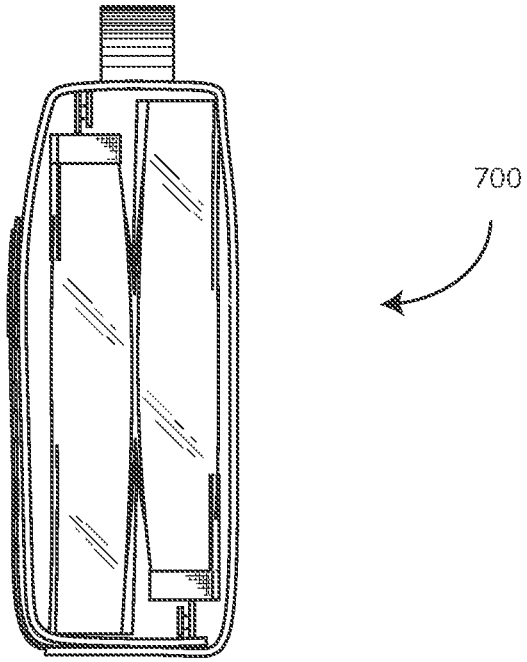
FIG. 69 is another right elevation view of one explanatory device in accordance with one or more embodiments of the disclosure that illustrates ornamental design features of the device.
Figure 70:
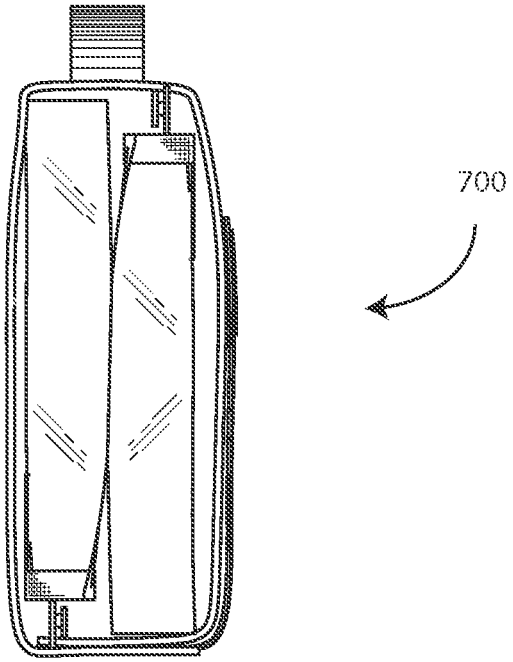
FIG. 70 is another left elevation view of one explanatory device in accordance with one or more embodiments of the disclosure that illustrates ornamental design features of the device.
Figure 71:
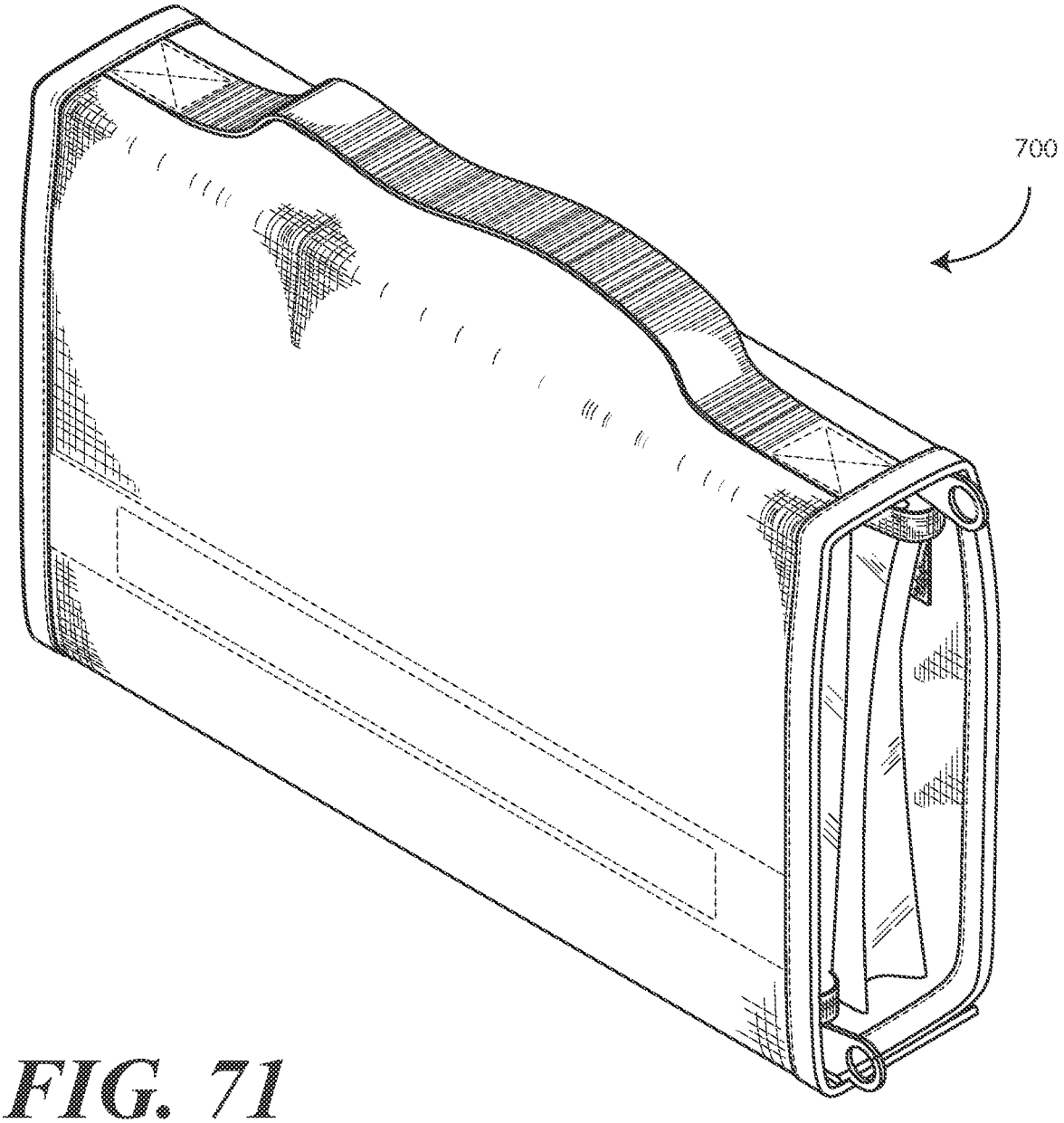
FIG. 71 is another perspective view of one explanatory device in accordance with one or more embodiments of the disclosure that illustrates ornamental design features of the device.
Figure 72:
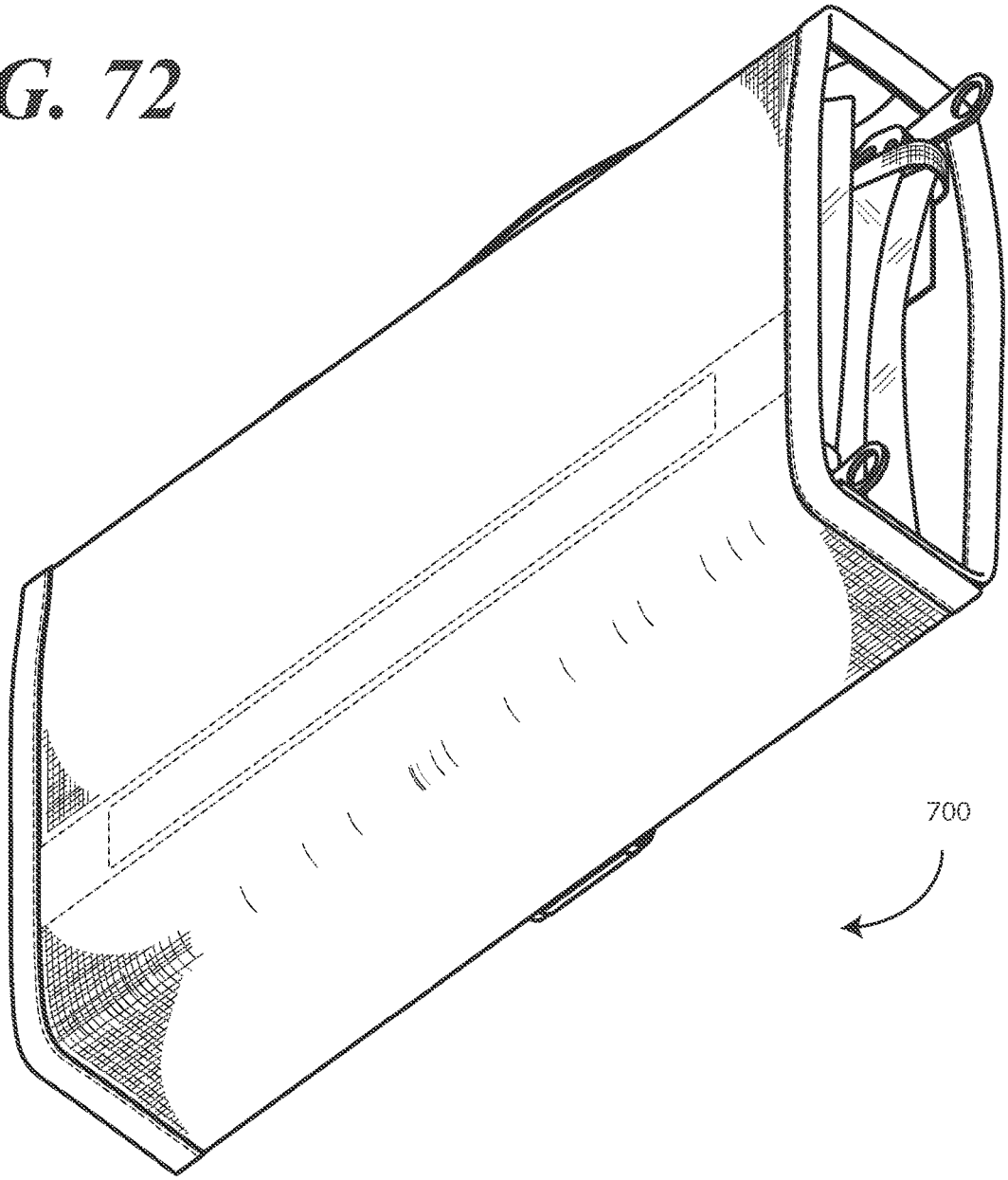
FIG. 72 is another perspective view of one explanatory device in accordance with one or more embodiments of the disclosure that illustrates ornamental design features of the device.
Figure 73:
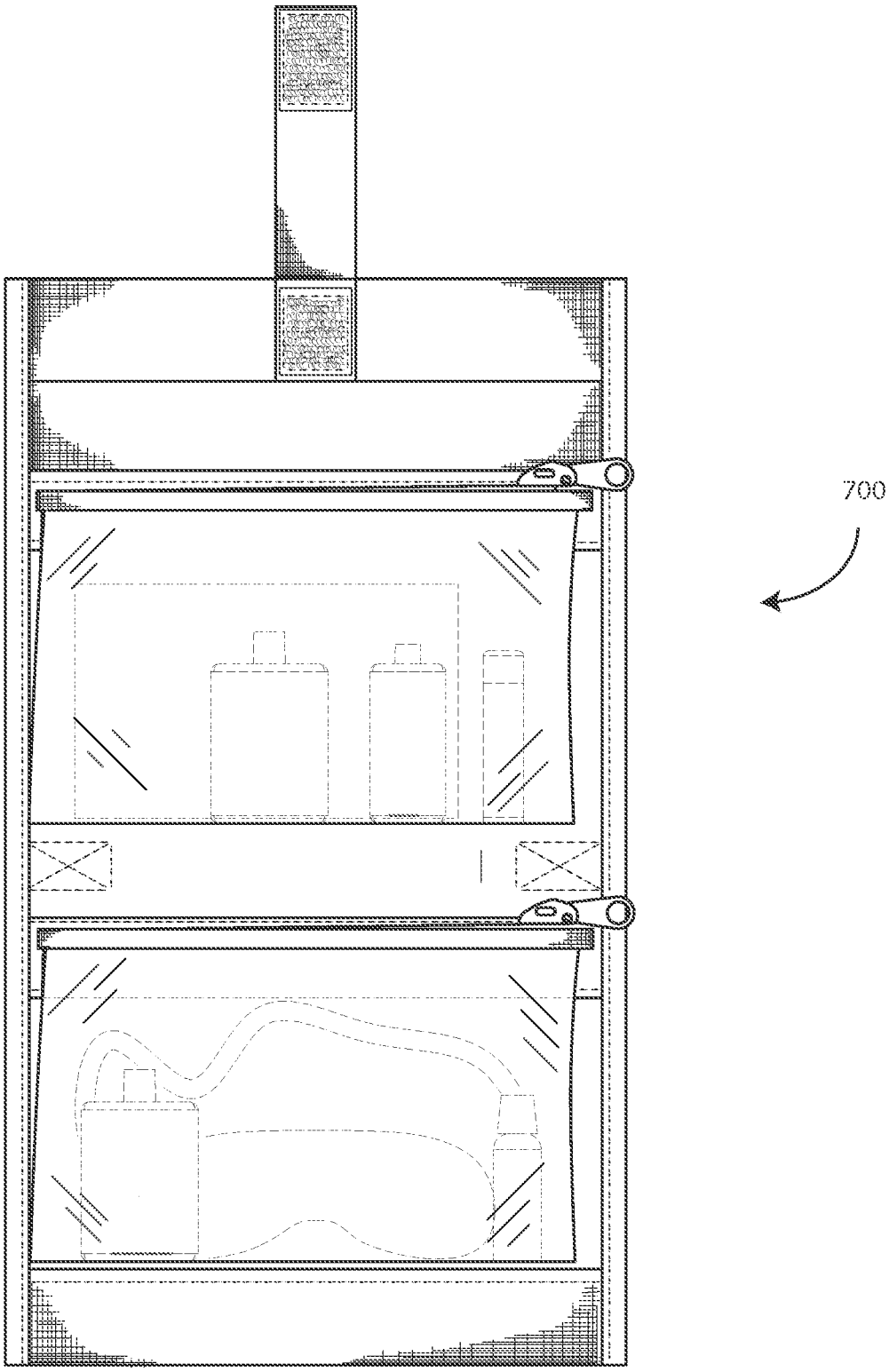
FIG. 73 is another front elevation view of one explanatory device in accordance with one or more embodiments of the disclosure that illustrates ornamental design features of the device.
Figure 74:
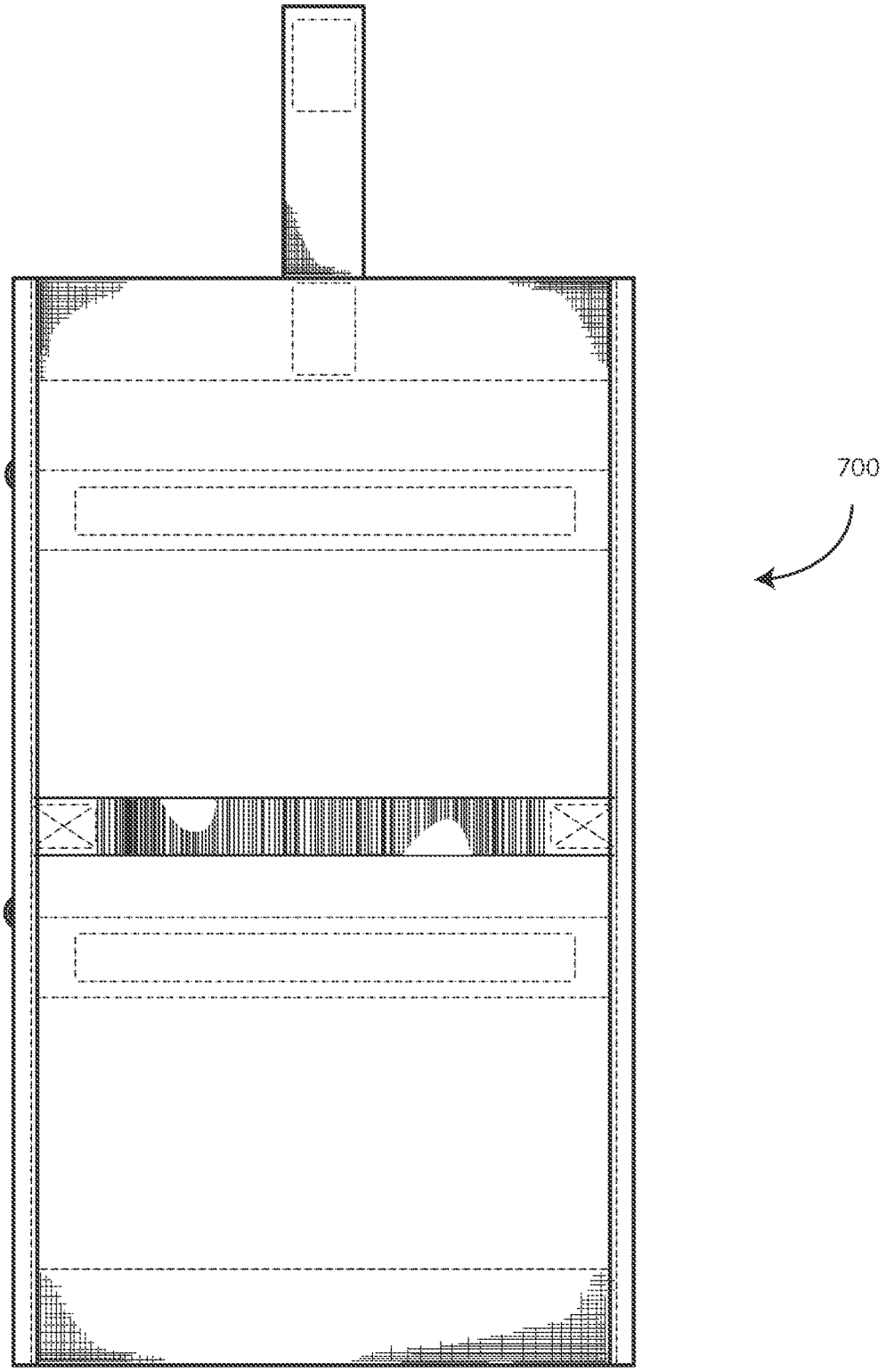
FIG. 74 is another rear elevation view of one explanatory device in accordance with one or more embodiments of the disclosure that illustrates ornamental design features of the device.
Figure 75:
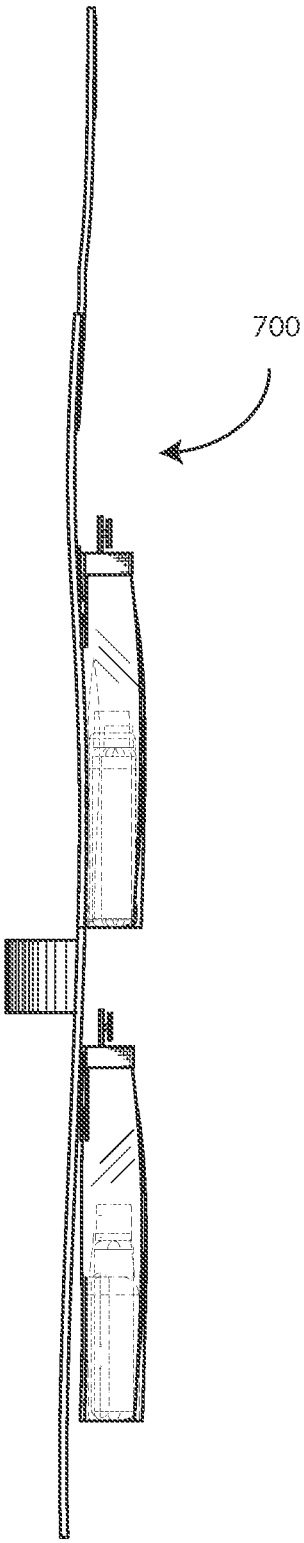
FIG. 75 is another left elevation view of one explanatory device in accordance with one or more embodiments of the disclosure that illustrates ornamental design features of the device.
Figure 76:
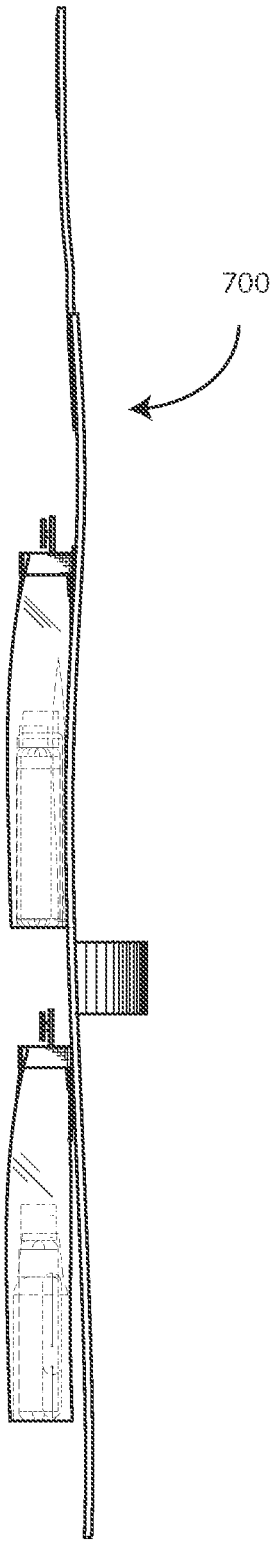
FIG. 76 is another right elevation view of one explanatory device in accordance with one or more embodiments of the disclosure that illustrates ornamental design features of the device.
Figure 77:
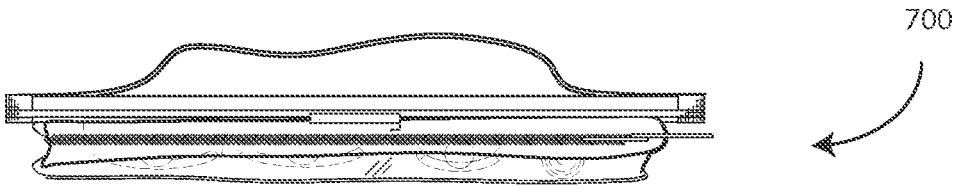
FIG. 77 is another top plan view of one explanatory device in accordance with one or more embodiments of the disclosure that illustrates ornamental design features of the device.
Figure 78:
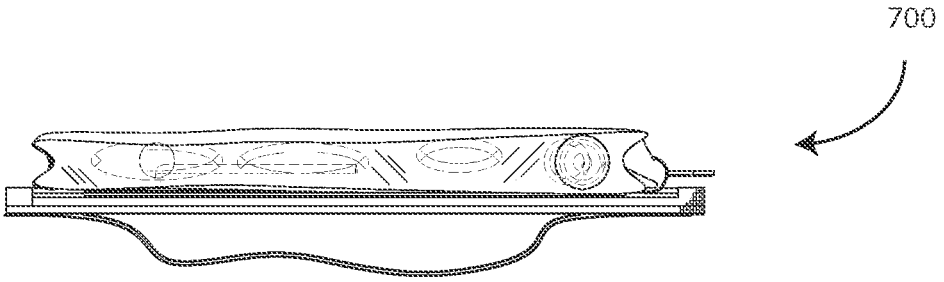
FIG. 78 is another bottom plan view of one explanatory device in accordance with one or more embodiments of the disclosure that illustrates ornamental design features of the device.
Figure 79:
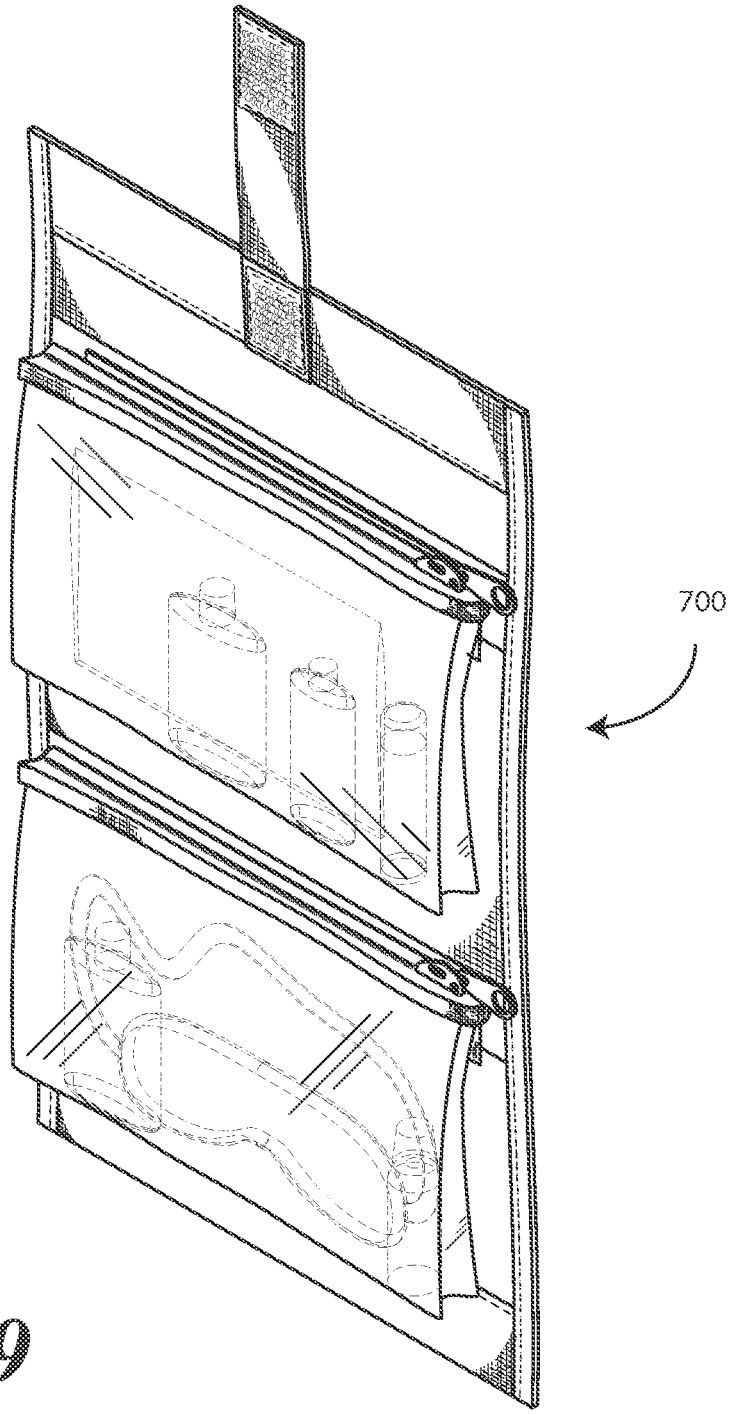
FIG. 79 is another perspective view of one explanatory device in accordance with one or more embodiments of the disclosure that illustrates ornamental design features of the device.
Figure 80:
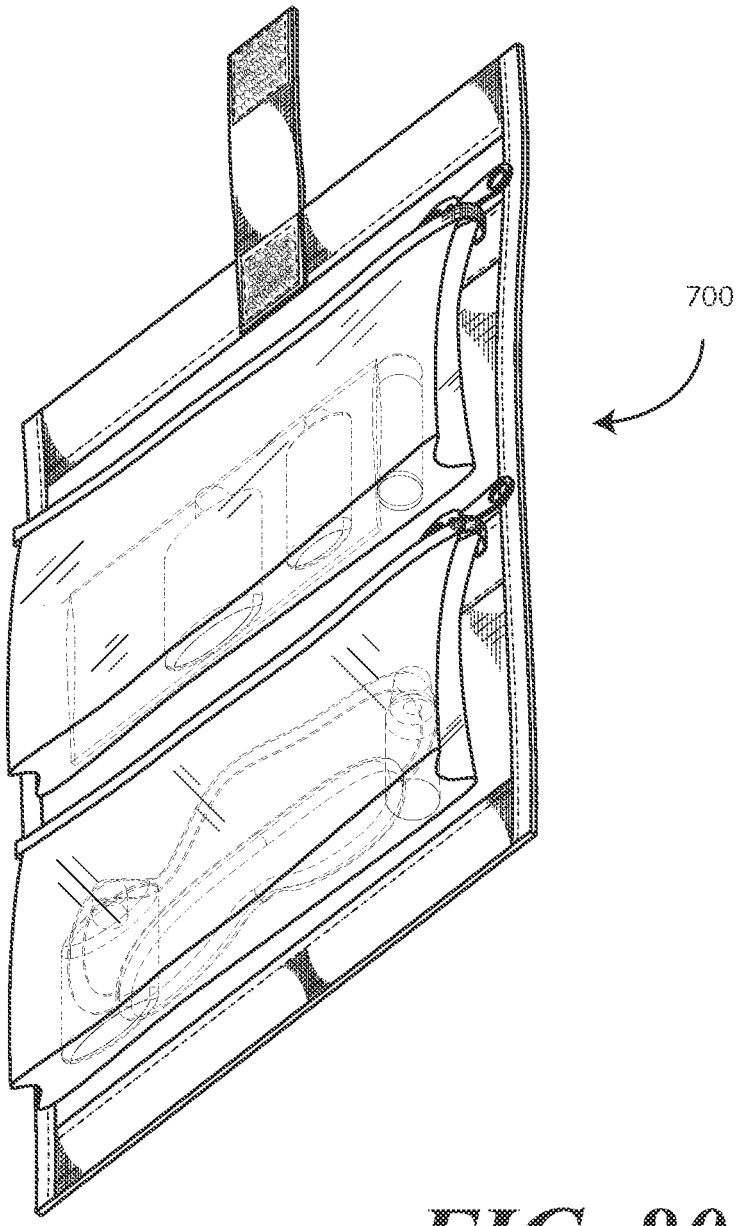
FIG. 80 is another perspective view of one explanatory device in accordance with one or more embodiments of the disclosure that illustrates ornamental design features of the device.
Figure 81:
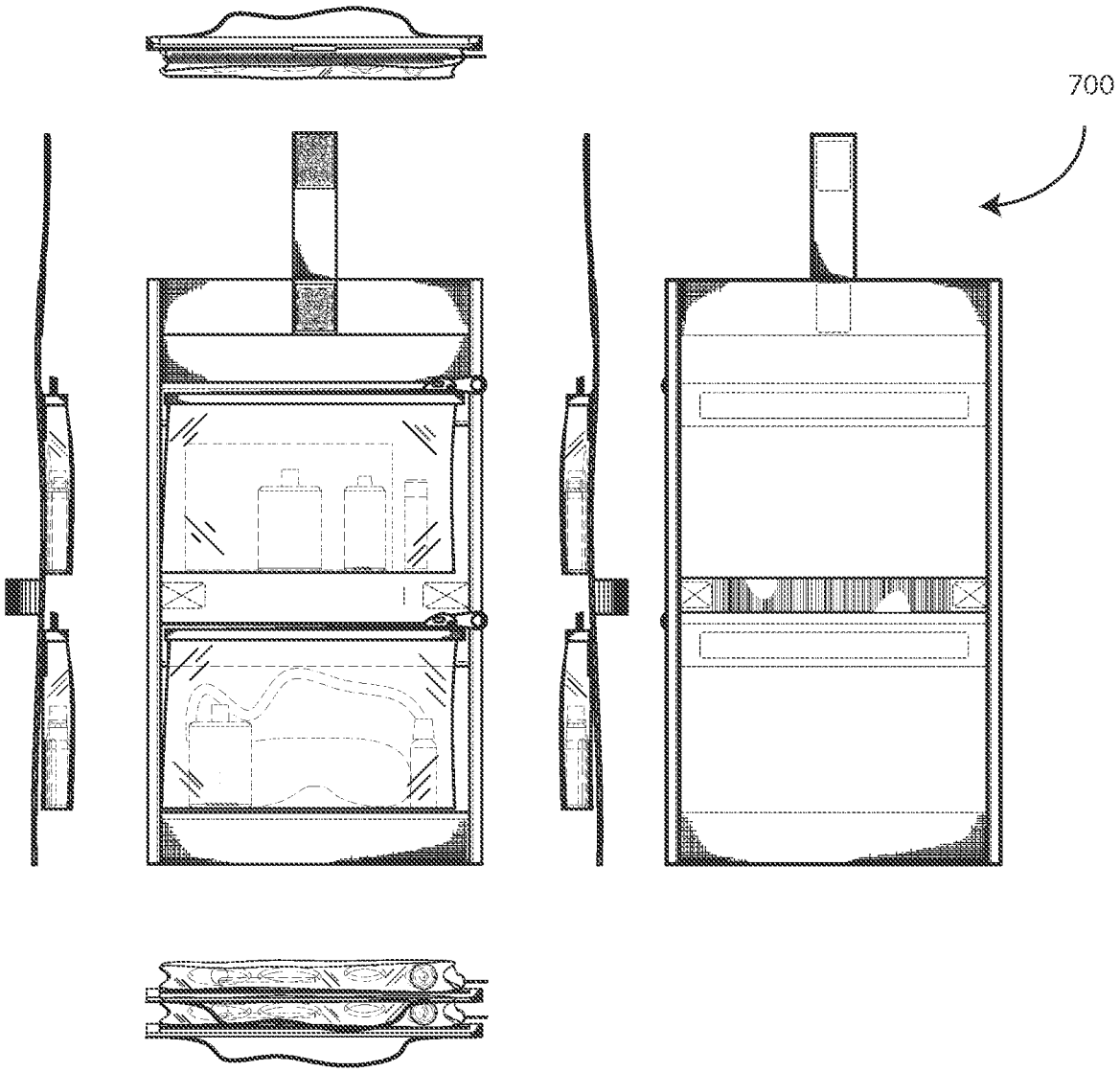
FIG. 81 is a multi-sided view of one explanatory device in accordance with one or more embodiments of the disclosure that illustrates ornamental design features of the device.
Figure 82:
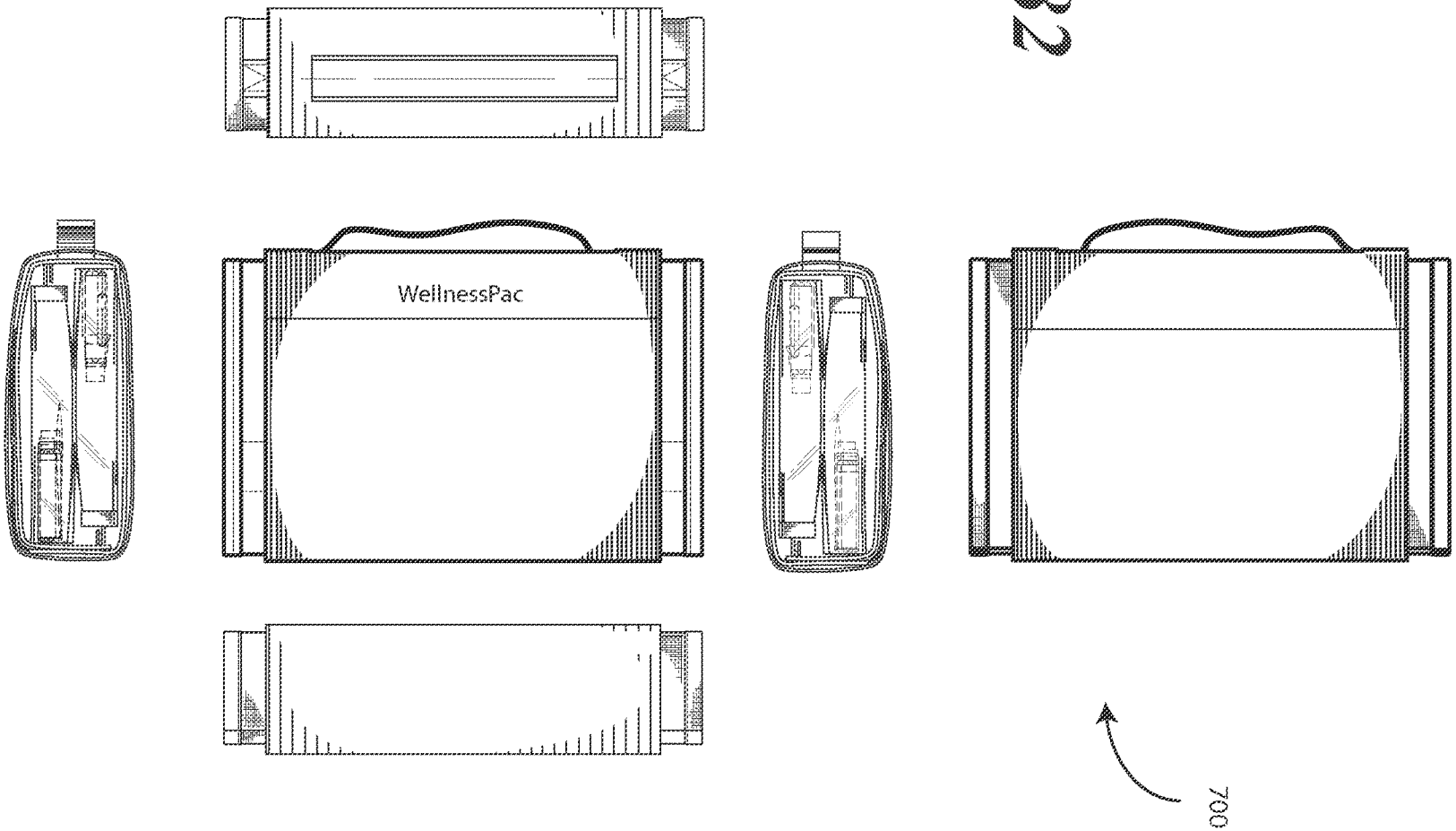
FIG. 82 is another multi-sided view of one explanatory device in accordance with one or more embodiments of the disclosure that illustrates ornamental design features of the device.
Figure 83:
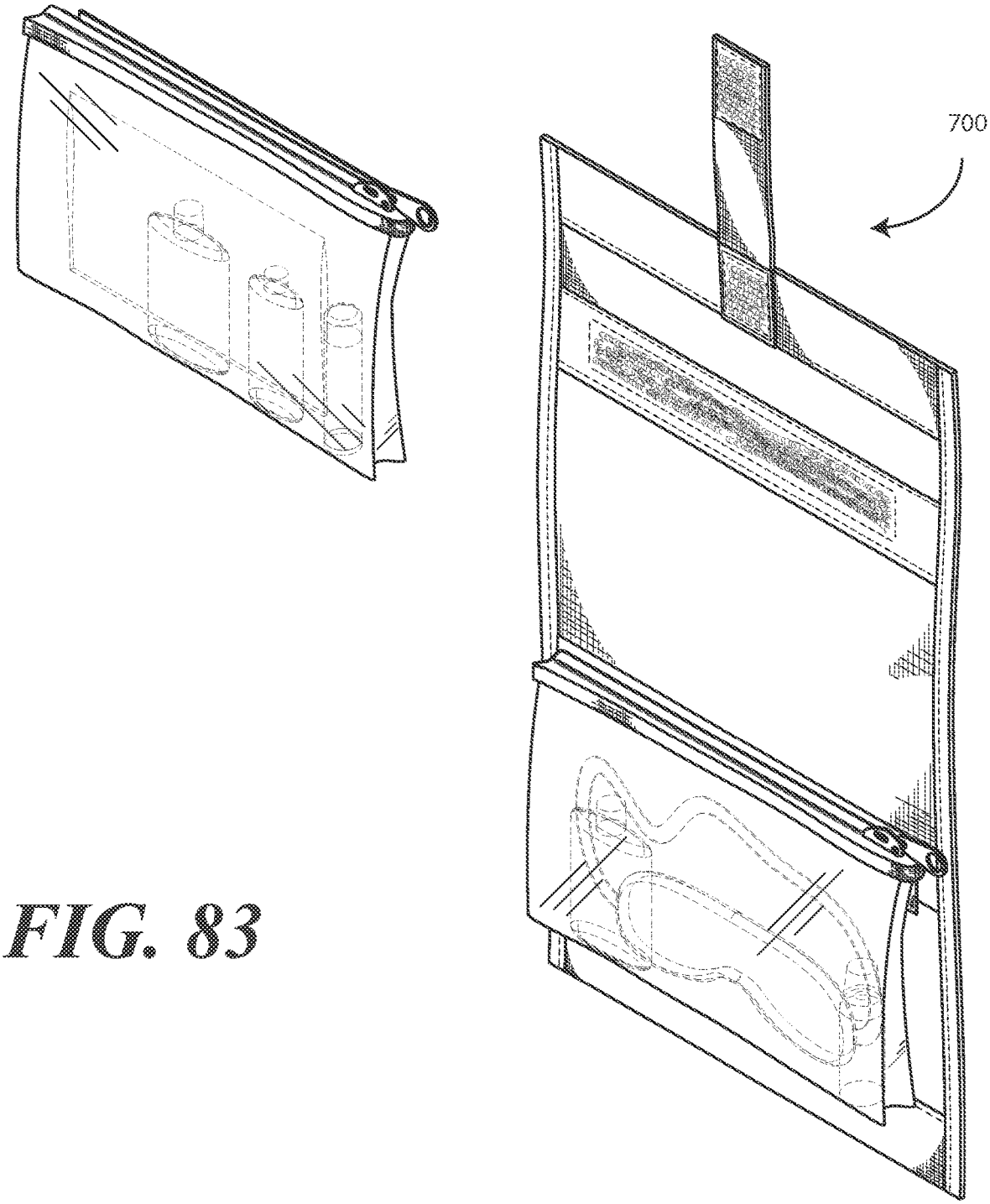
FIG. 83 is another perspective view of one explanatory device in accordance with one or more embodiments of the disclosure that illustrates ornamental design features of the device.
Figure 84:
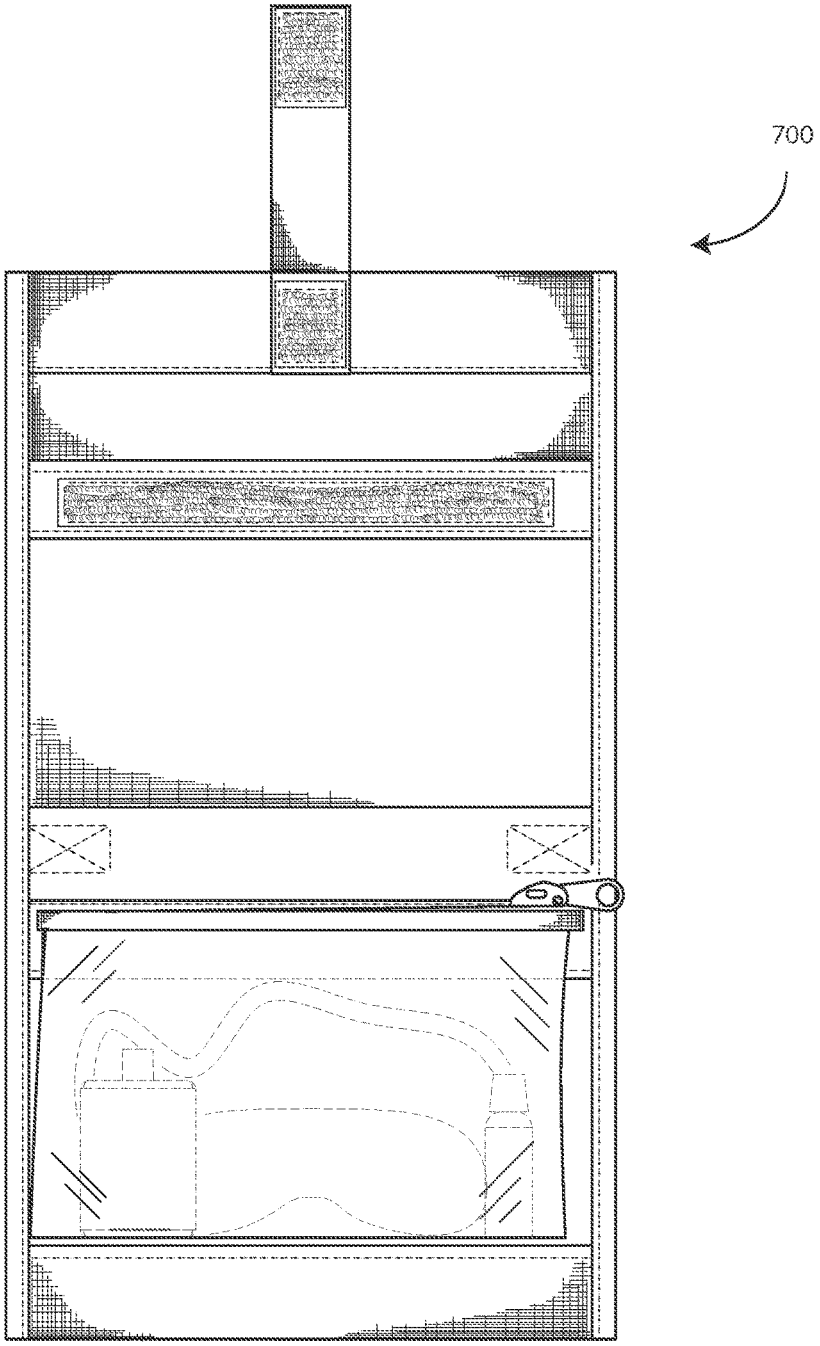
FIG. 84 is another front elevation view of one explanatory device in accordance with one or more embodiments of the disclosure that illustrates ornamental design features of the device.
Figure 85:
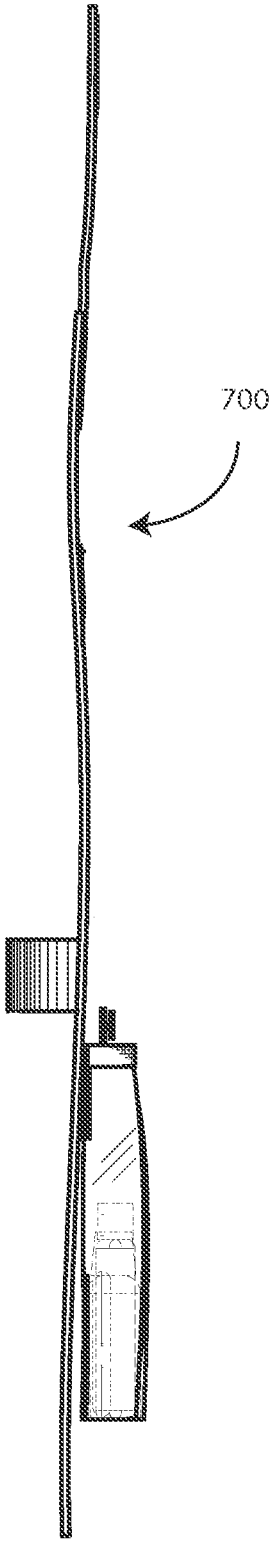
FIG. 85 is another left elevation view of one explanatory device in accordance with one or more embodiments of the disclosure that illustrates ornamental design features of the device.
Figure 86:
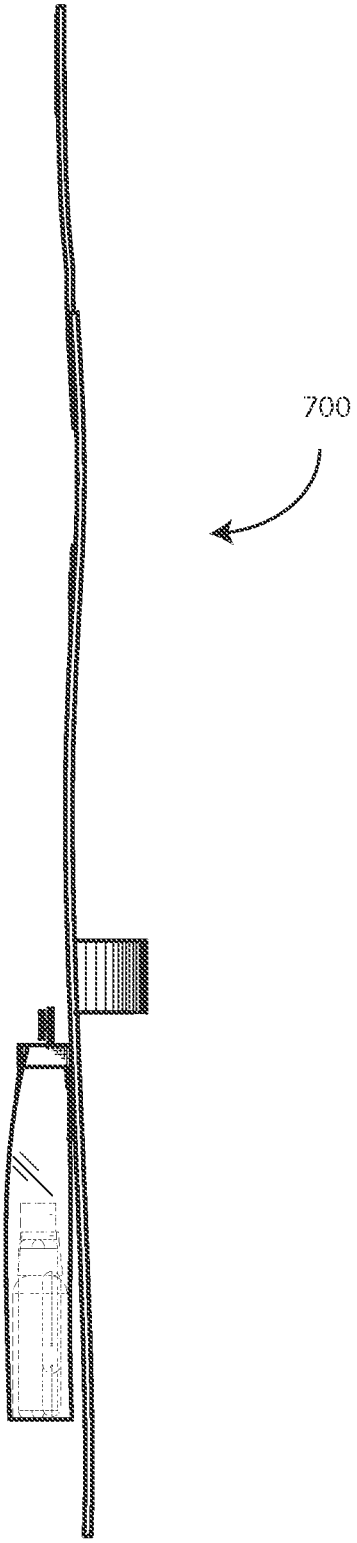
FIG. 86 is another right elevation view of one explanatory device in accordance with one or more embodiments of the disclosure that illustrates ornamental design features of the device.
Figure 87:
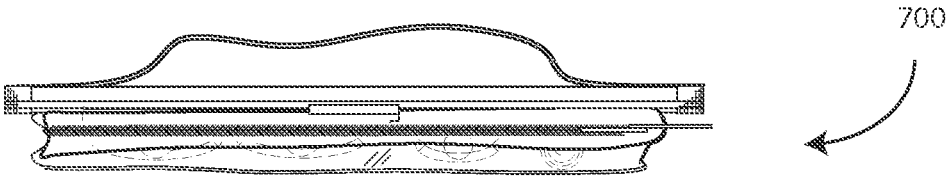
FIG. 87 is another top plan view of one explanatory device in accordance with one or more embodiments of the disclosure that illustrates ornamental design features of the device.
Figure 88:
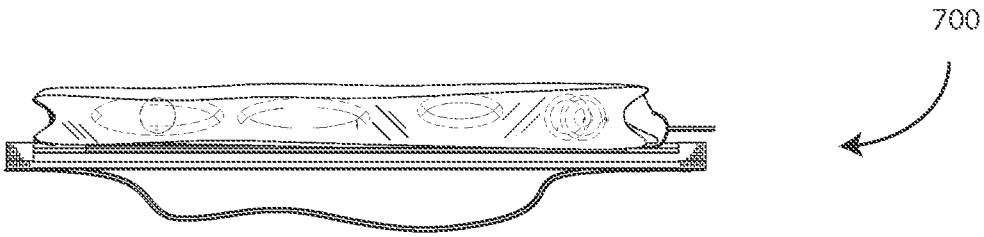
FIG. 88 is another bottom plan view of one explanatory device in accordance with one or more embodiments of the disclosure that illustrates ornamental design features of the device.
Figure 89:
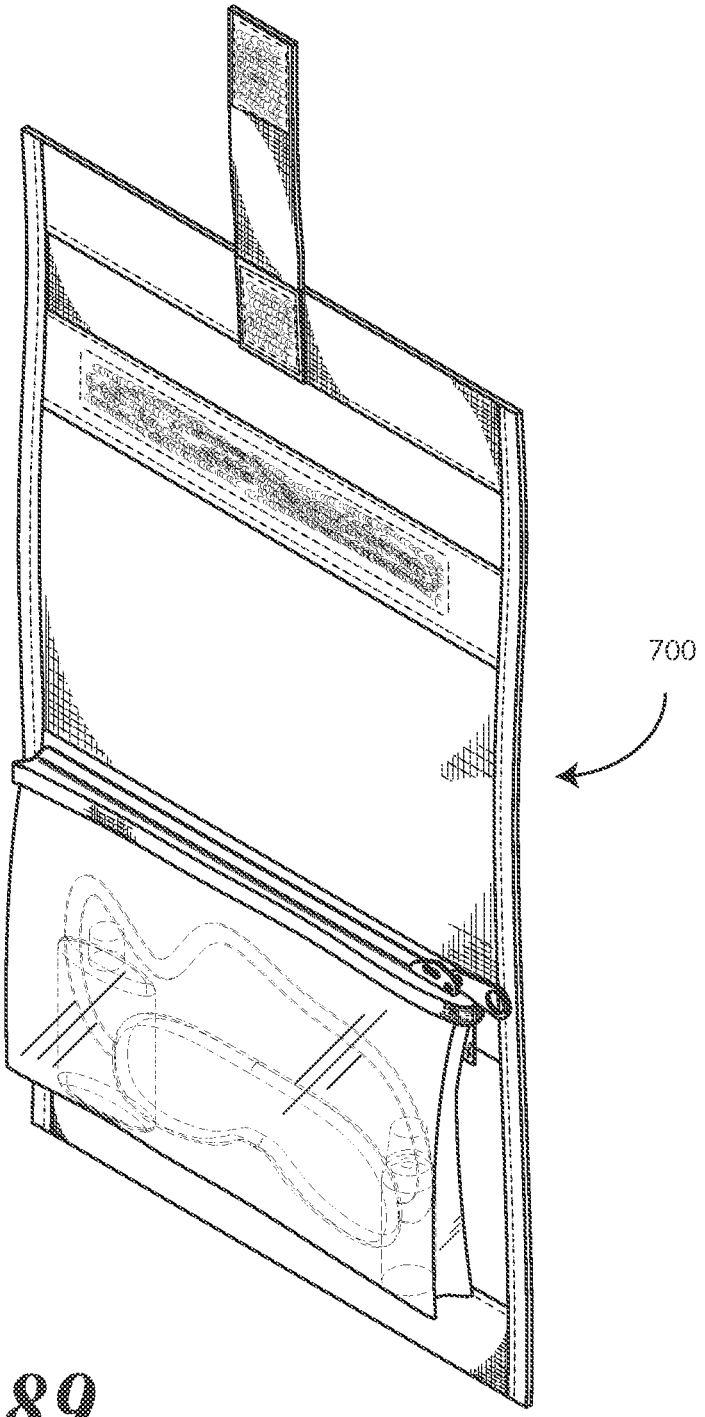
FIG. 89 is another perspective view of one explanatory device in accordance with one or more embodiments of the disclosure that illustrates ornamental design features of the device.
Figure 90:
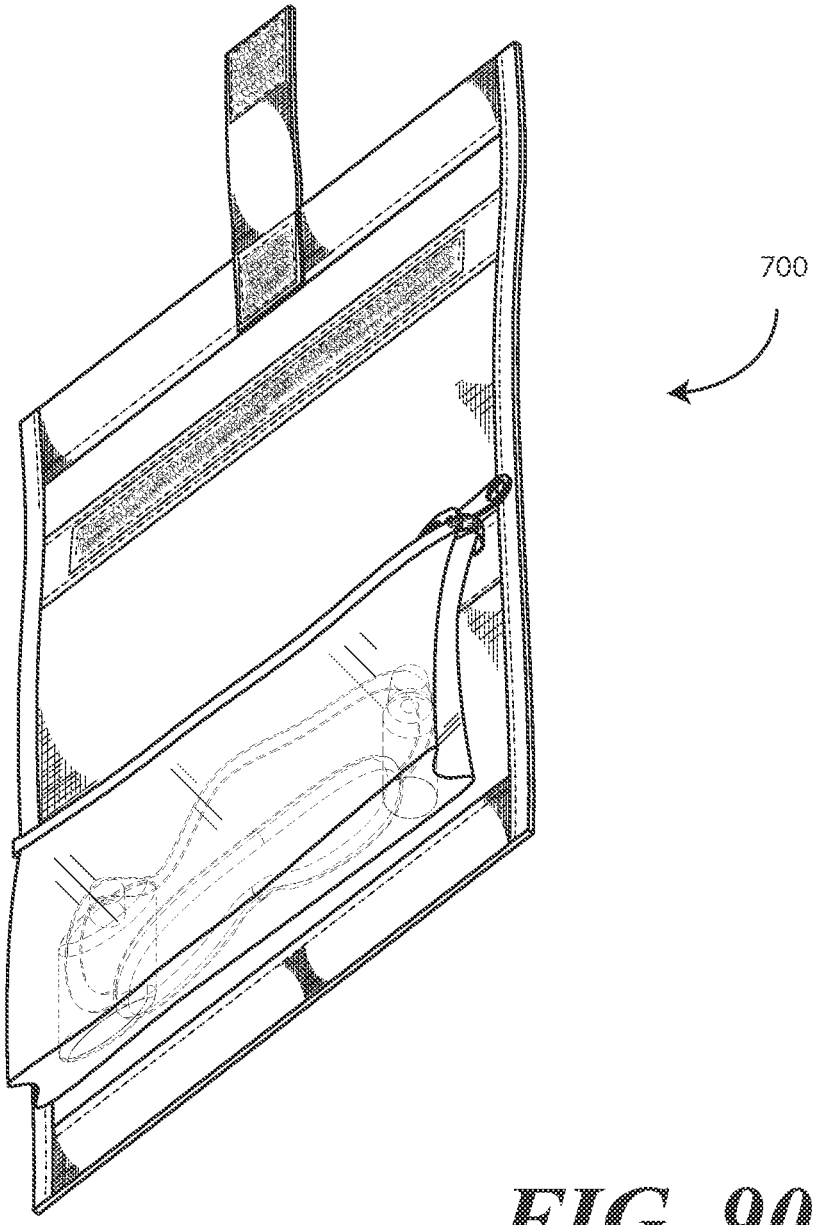
FIG. 90 is another perspective view of one explanatory device in accordance with one or more embodiments of the disclosure that illustrates ornamental design features of the device.
Figure 91:
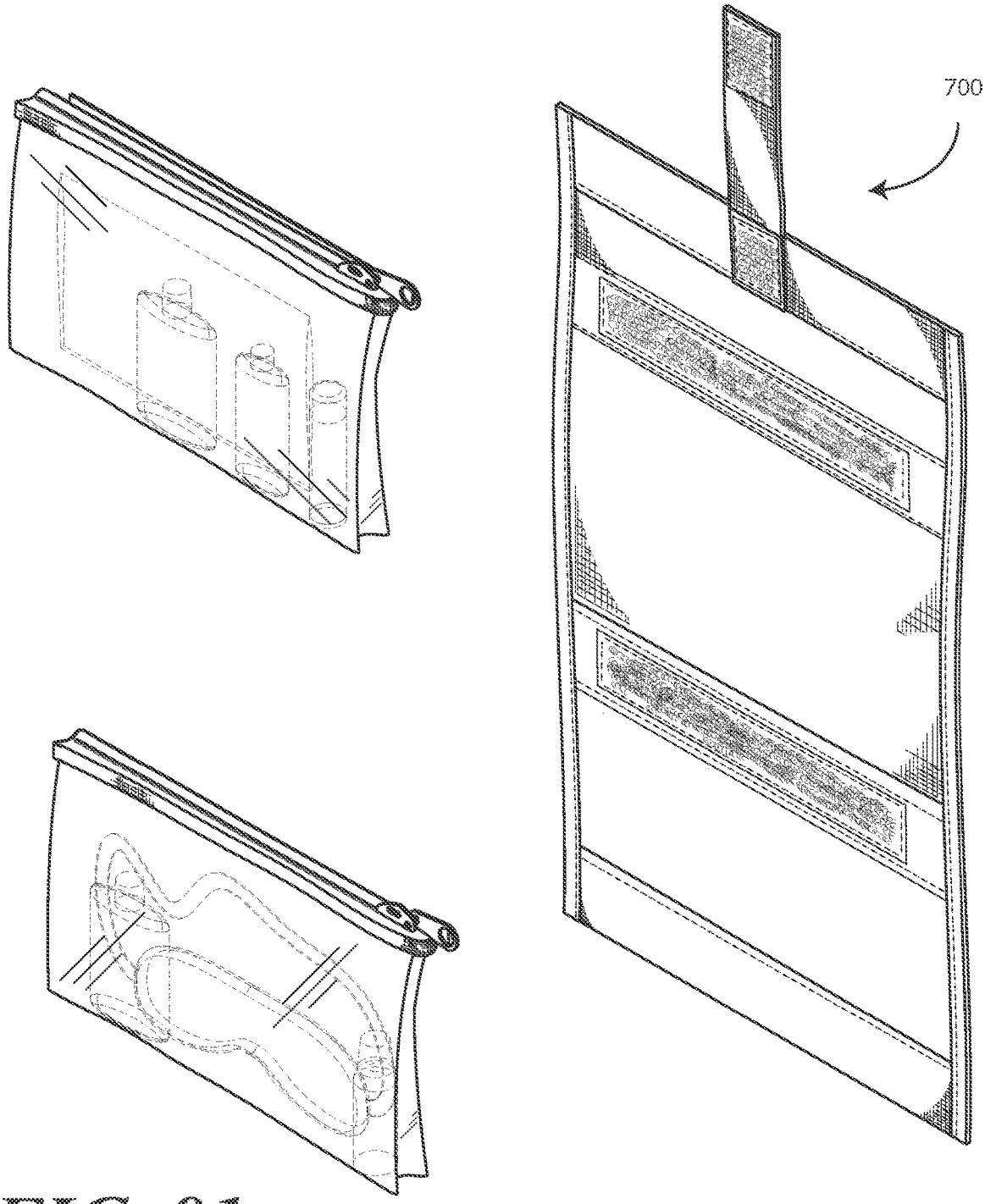
FIG. 91 is another perspective view of one explanatory device in accordance with one or more embodiments of the disclosure that illustrates ornamental design features of the device.
Figure 92:
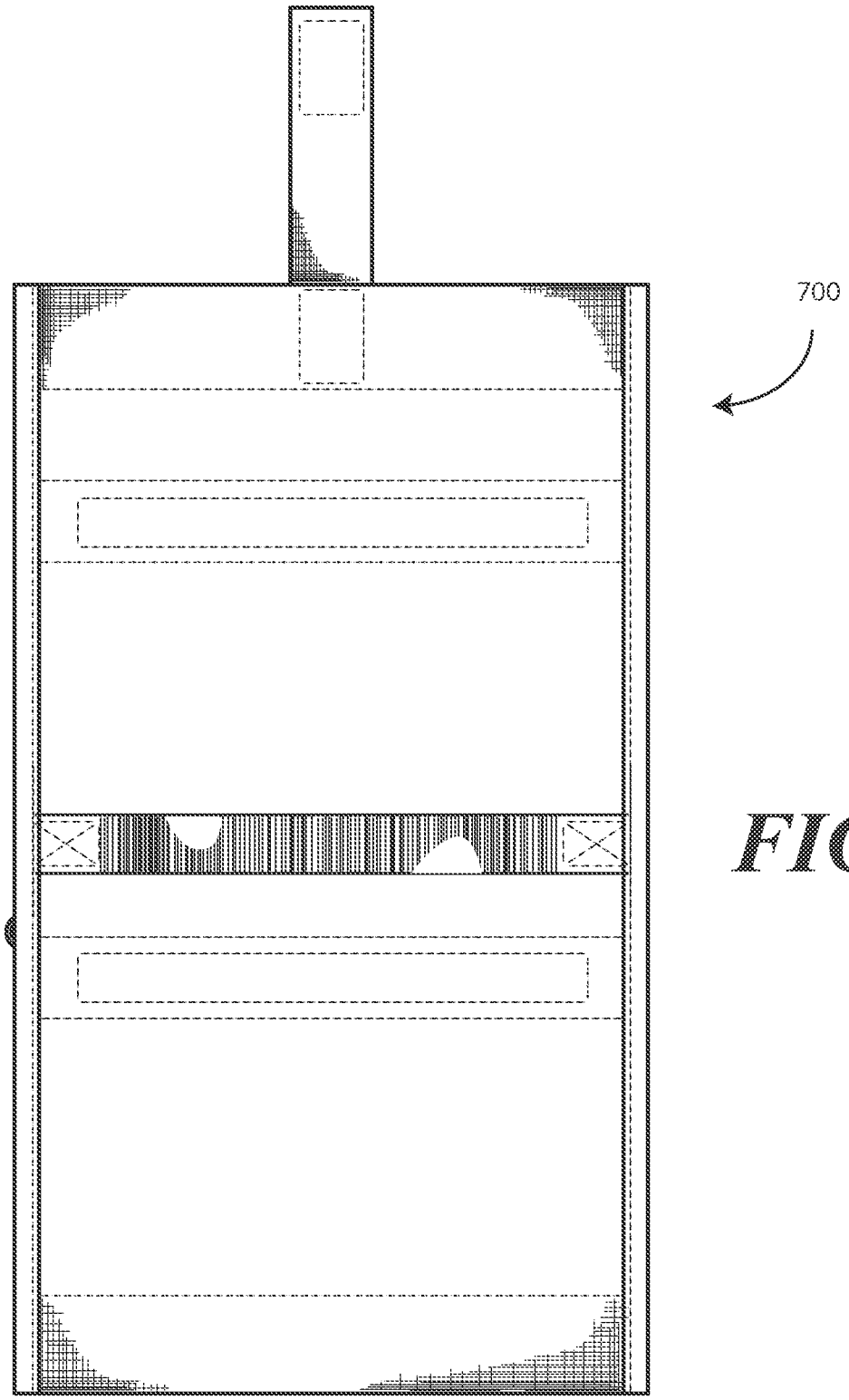
FIG. 92 is another front elevation view of one explanatory device in accordance with one or more embodiments of the disclosure that illustrates ornamental design features of the device.
Figure 93:
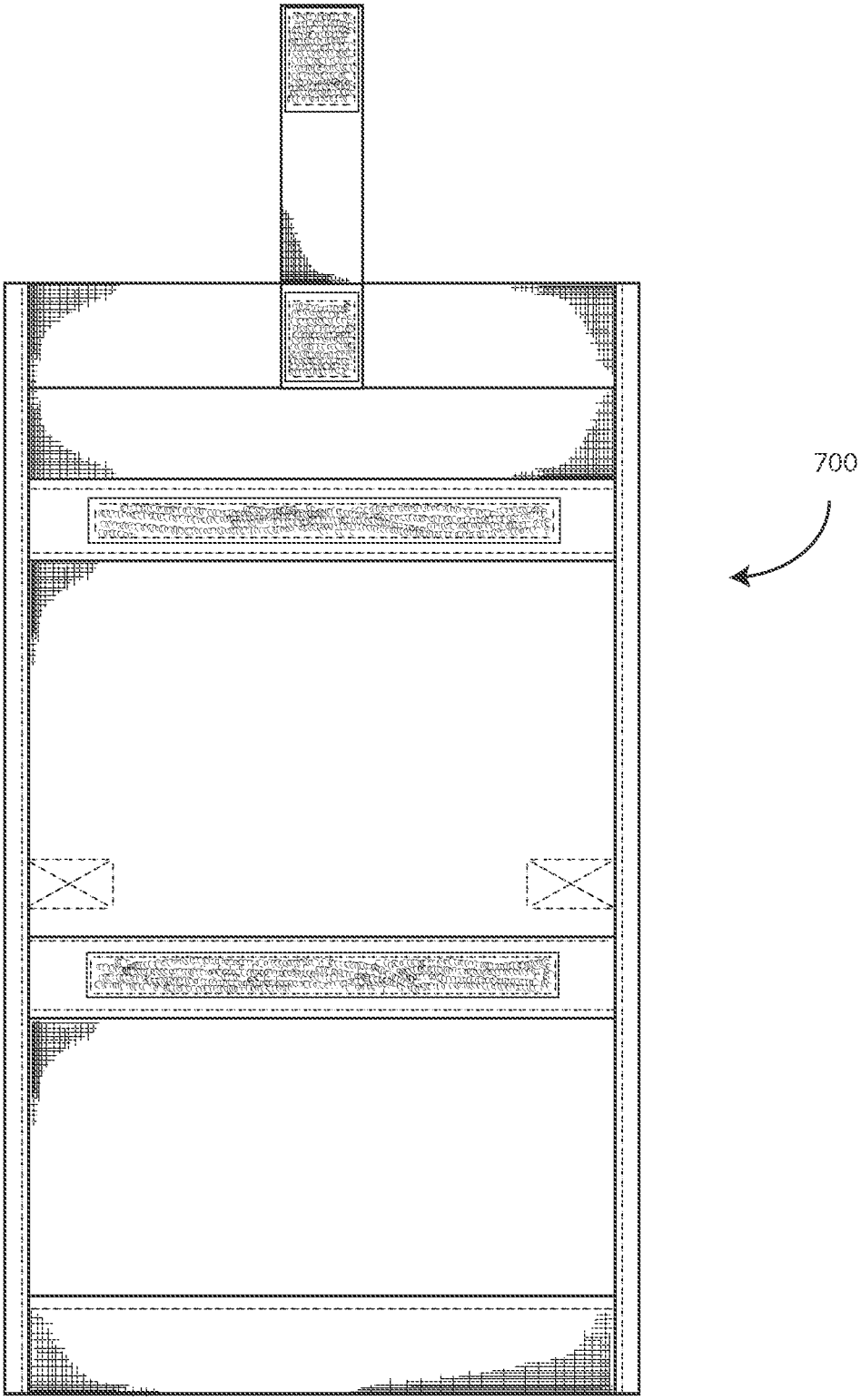
FIG. 93 is another rear elevation view of one explanatory device in accordance with one or more embodiments of the disclosure that illustrates ornamental design features of the device.
Figure 94:
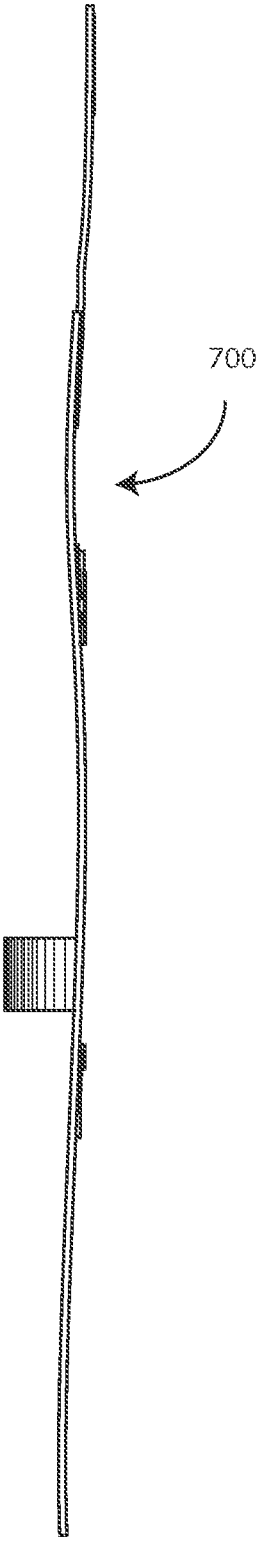
FIG. 94 is another left elevation view of one explanatory device in accordance with one or more embodiments of the disclosure that illustrates ornamental design features of the device.
Figure 95:
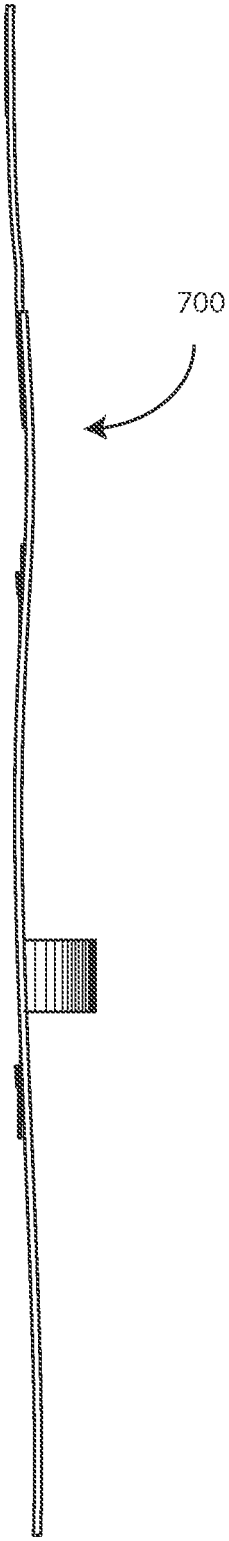
FIG. 95 is another right elevation view of one explanatory device in accordance with one or more embodiments of the disclosure that illustrates ornamental design features of the device.
Figure 96:
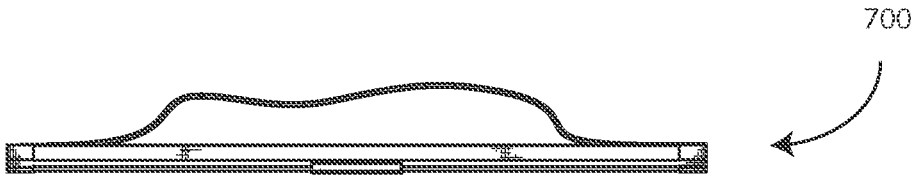
FIG. 96 is another top plan view of one explanatory device in accordance with one or more embodiments of the disclosure that illustrates ornamental design features of the device.
Figure 97:
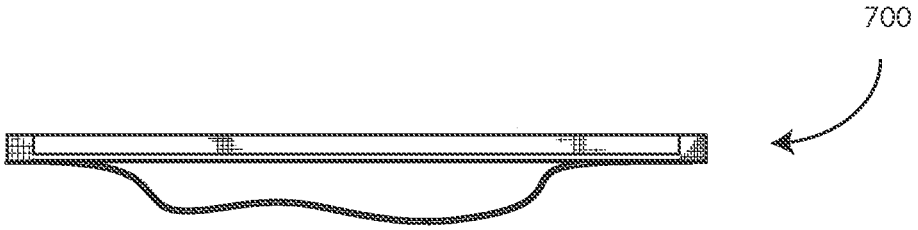
FIG. 97 is another bottom plan view of one explanatory device in accordance with one or more embodiments of the disclosure that illustrates ornamental design features of the device.
Figure 98:
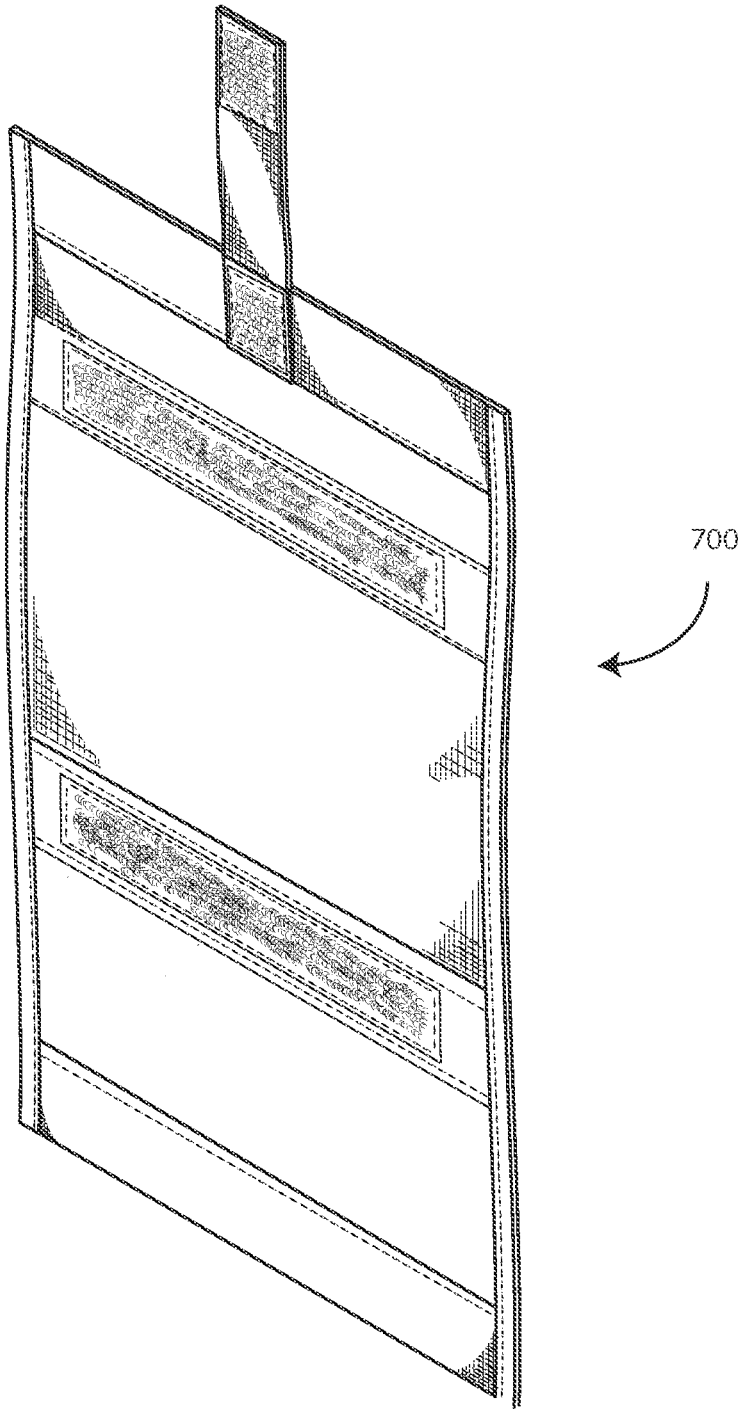
FIG. 98 is another perspective view of one explanatory device in accordance with one or more embodiments of the disclosure that illustrates ornamental design features of the device.
Figure 99:
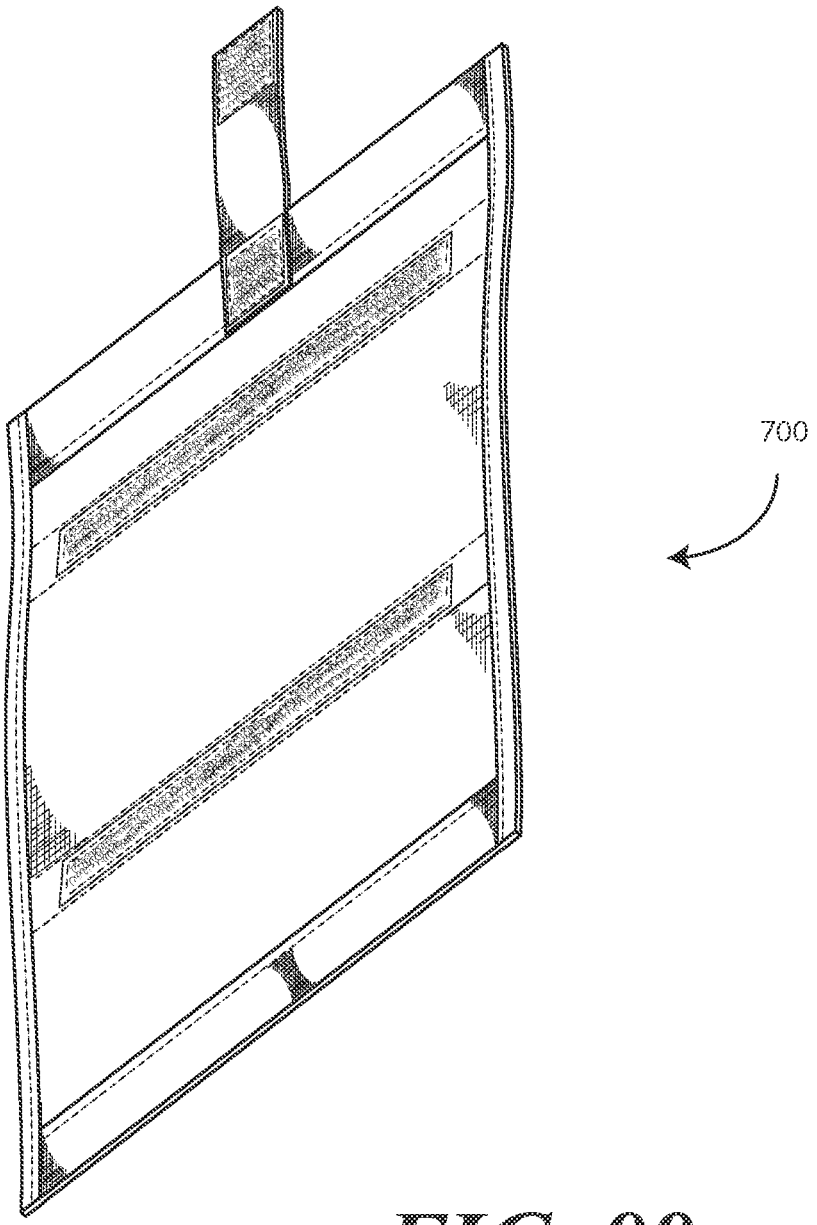
FIG. 99 is another perspective view of one explanatory device in accordance with one or more embodiments of the disclosure that illustrates ornamental design features of the device.
Figure 100:
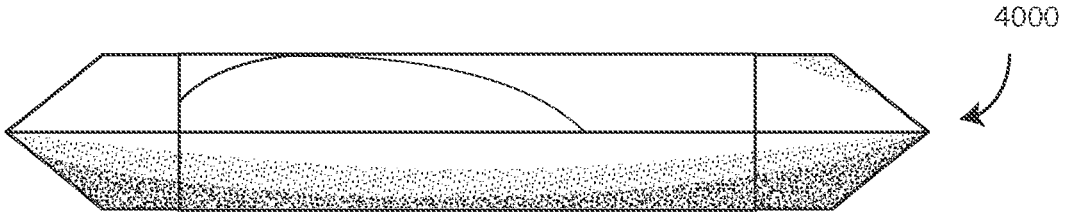
FIG. 100 is a bottom plan view of another explanatory device in accordance with one or more embodiments of the disclosure that illustrates ornamental design features of the device.
Figure 101:
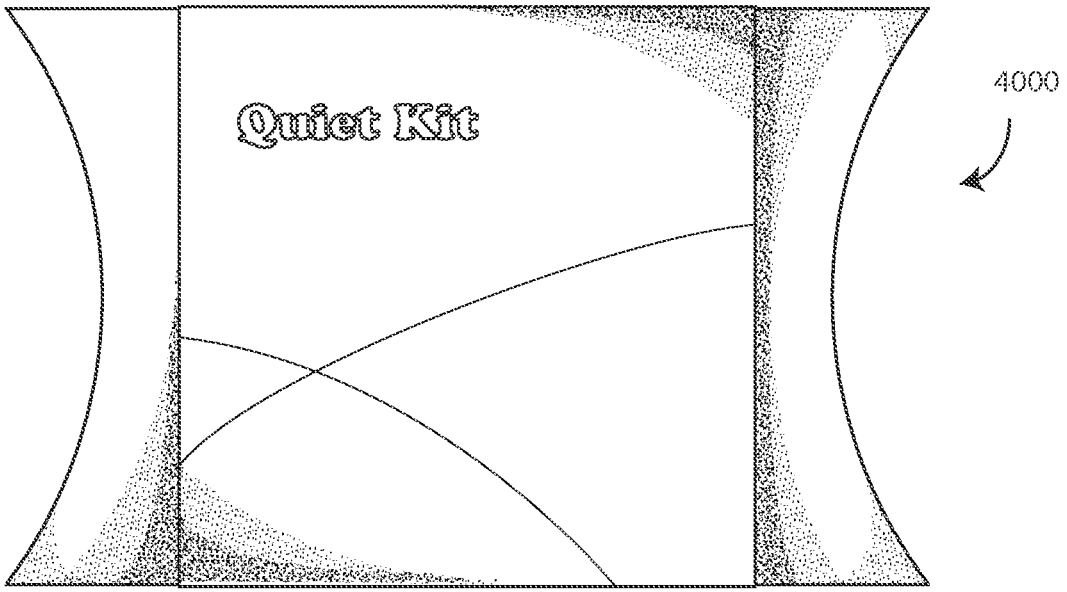
FIG. 101 is a front elevation view of another explanatory device in accordance with one or more embodiments of the disclosure that illustrates ornamental design features of the device.
Figure 102:
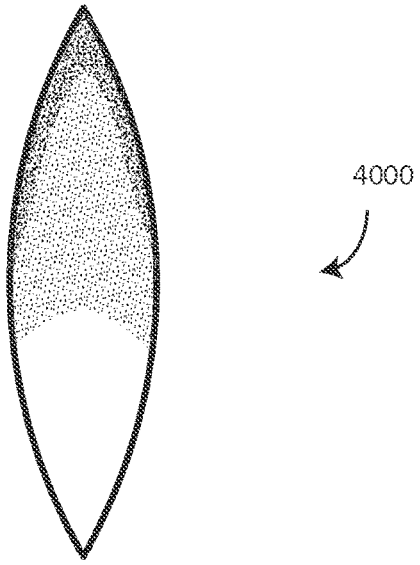
FIG. 102 is a right elevation view of another explanatory device in accordance with one or more embodiments of the disclosure that illustrates ornamental design features of the device.
Figure 103:
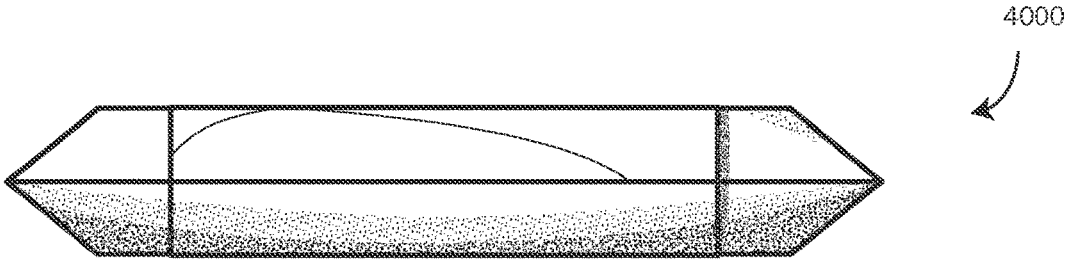
FIG. 103 is another bottom plan view of another explanatory device in accordance with one or more embodiments of the disclosure that illustrates ornamental design features of the device.
Figure 104:
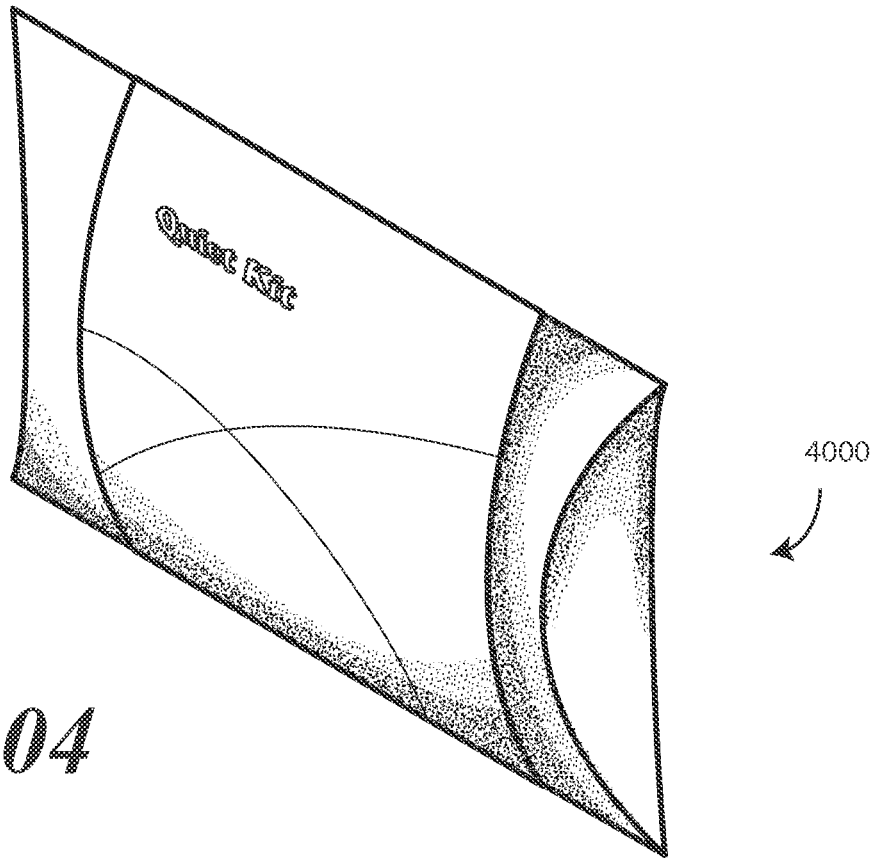
FIG. 104 is a perspective view of another explanatory device in accordance with one or more embodiments of the disclosure that illustrates ornamental design features of the device.
Figure 105:
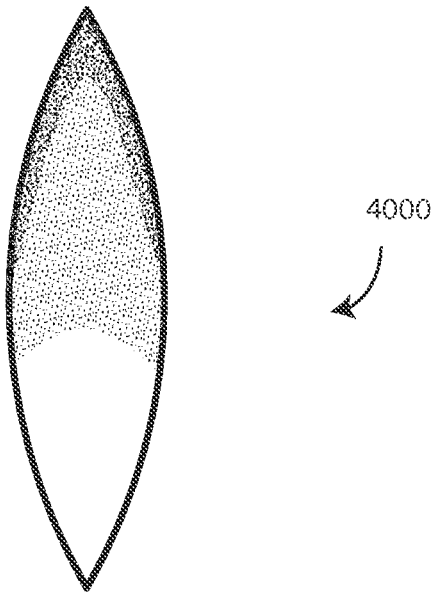
FIG. 105 is a left elevation view of another explanatory device in accordance with one or more embodiments of the disclosure that illustrates ornamental design features of the device.
Figure 106:
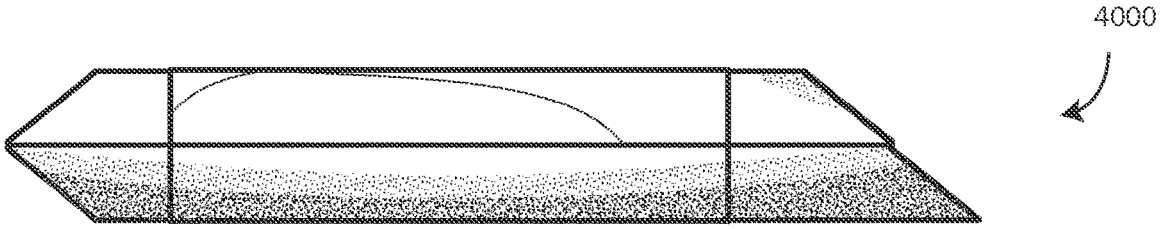
FIG. 106 is another bottom plan view of another explanatory device in accordance with one or more embodiments of the disclosure that illustrates ornamental design features of the device.
Figure 107:
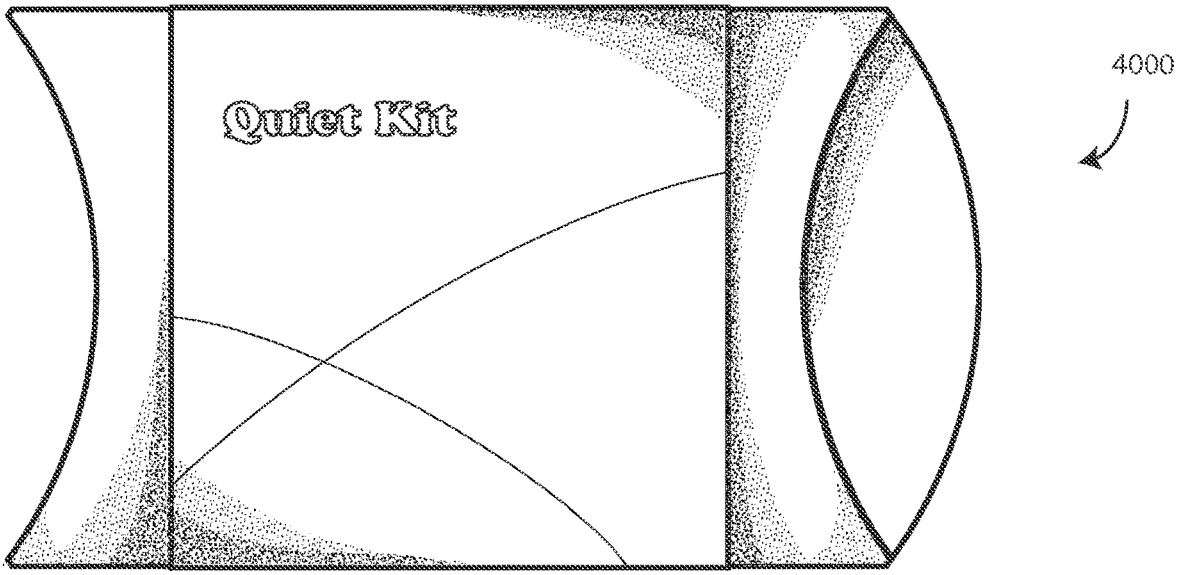
FIG. 107 is another front elevation view of another explanatory device in accordance with one or more embodiments of the disclosure that illustrates ornamental design features of the device.
Figure 108:
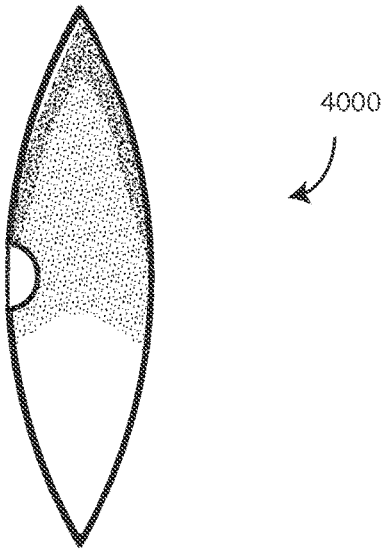
FIG. 108 is another right elevation view of another explanatory device in accordance with one or more embodiments of the disclosure that illustrates ornamental design features of the device.
Figure 109:
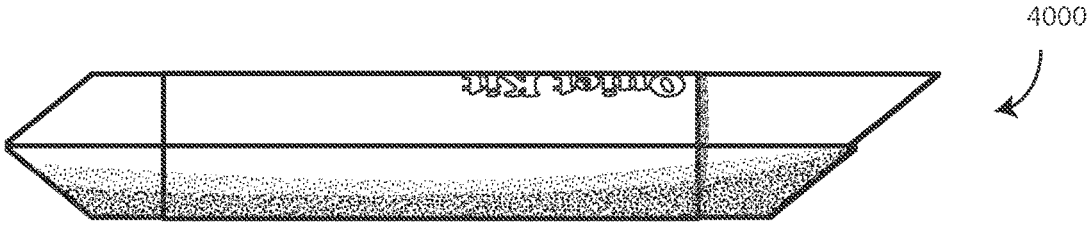
FIG. 109 is another top plan view of another explanatory device in accordance with one or more embodiments of the disclosure that illustrates ornamental design features of the device.
Figure 110:
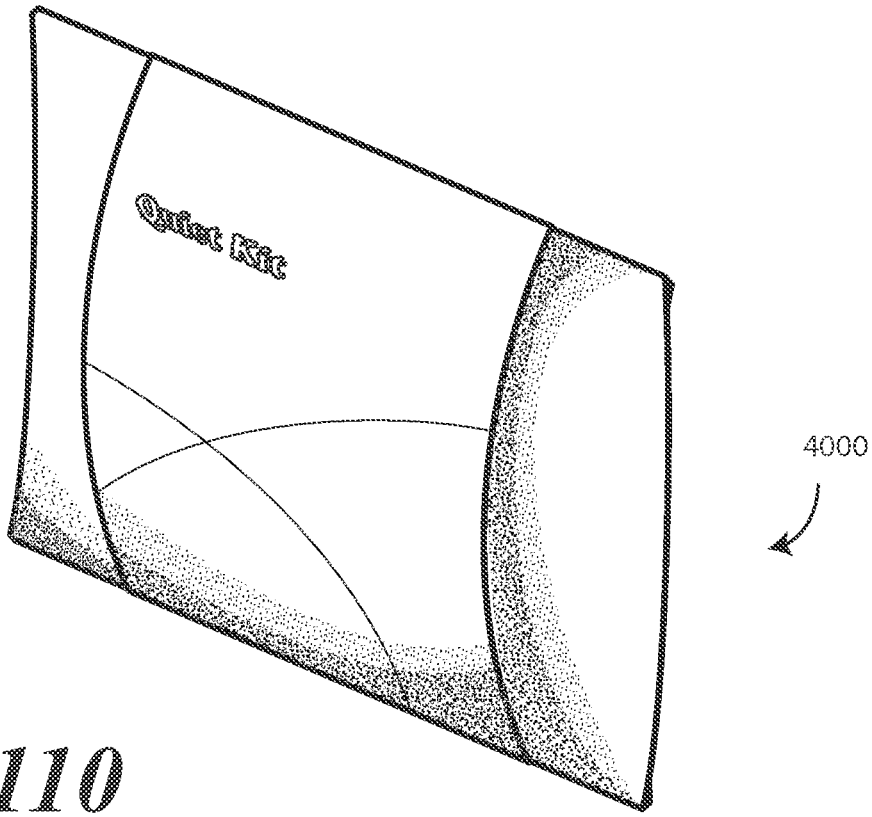
FIG. 110 is another perspective view of another explanatory device in accordance with one or more embodiments of the disclosure that illustrates ornamental design features of the device.
Figure 111:
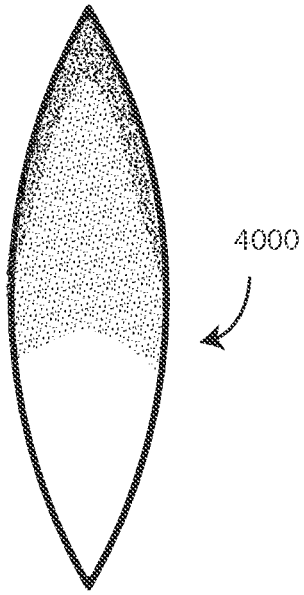
FIG. 111 is another left elevation view of another explanatory device in accordance with one or more embodiments of the disclosure that illustrates ornamental design features of the device.
Figure 112:
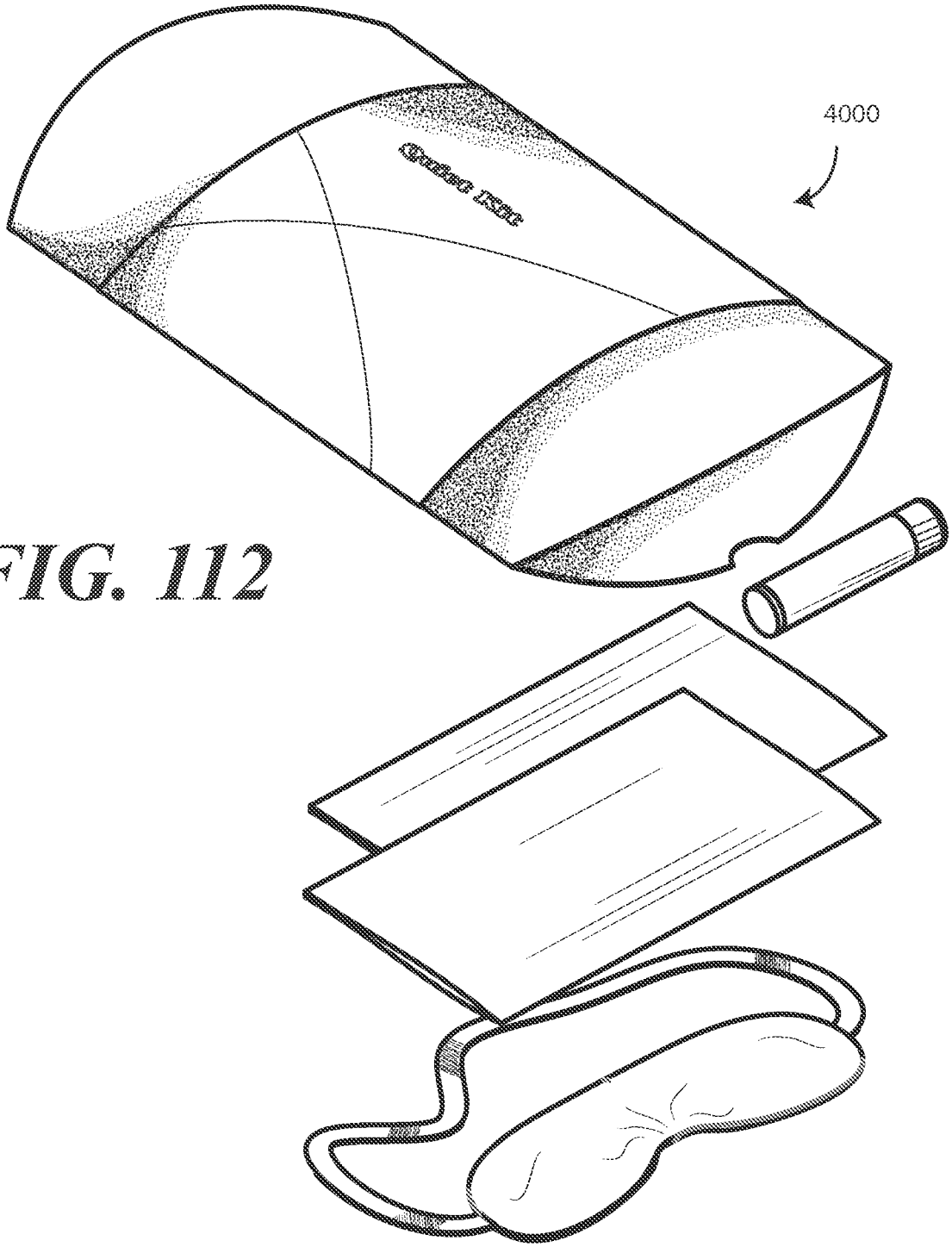
FIG. 112 is a perspective exploded view of another explanatory device in accordance with one or more embodiments of the disclosure that illustrates ornamental design features of the device.
Figure 113:
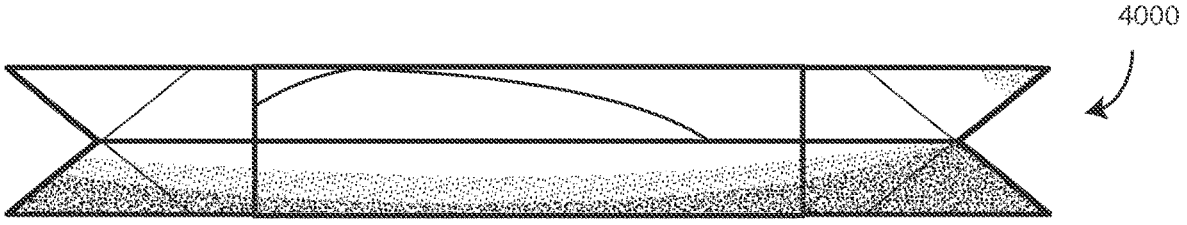
FIG. 113 is another bottom plan view of another explanatory device in accordance with one or more embodiments of the disclosure that illustrates ornamental design features of the device.
Figure 114:
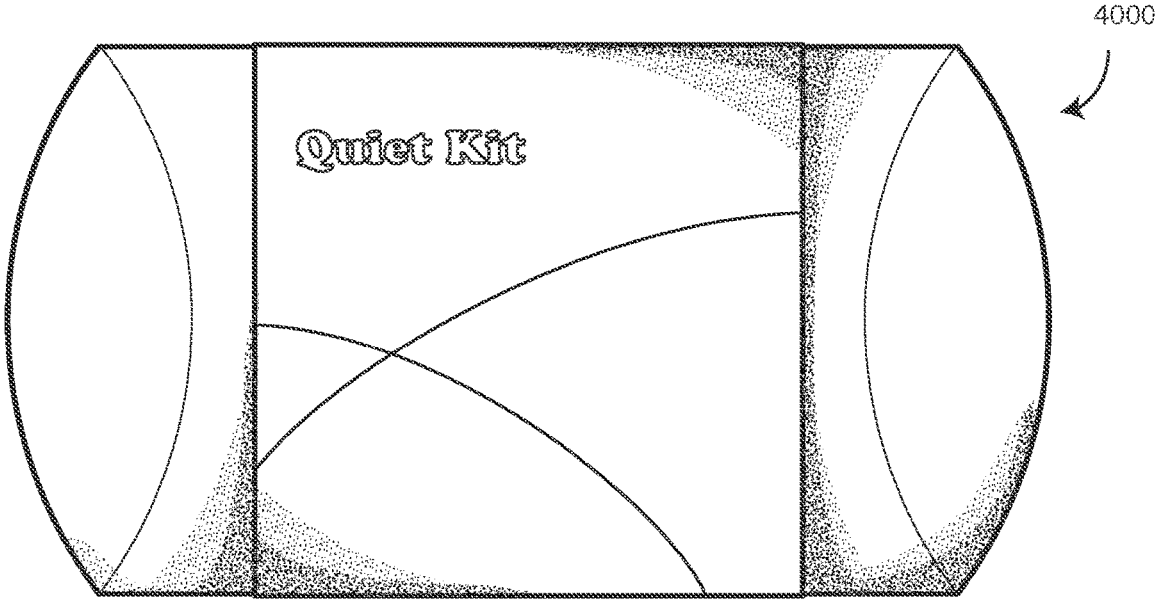
FIG. 114 is another front elevation view of another explanatory device in accordance with one or more embodiments of the disclosure that illustrates ornamental design features of the device.
Figure 115:
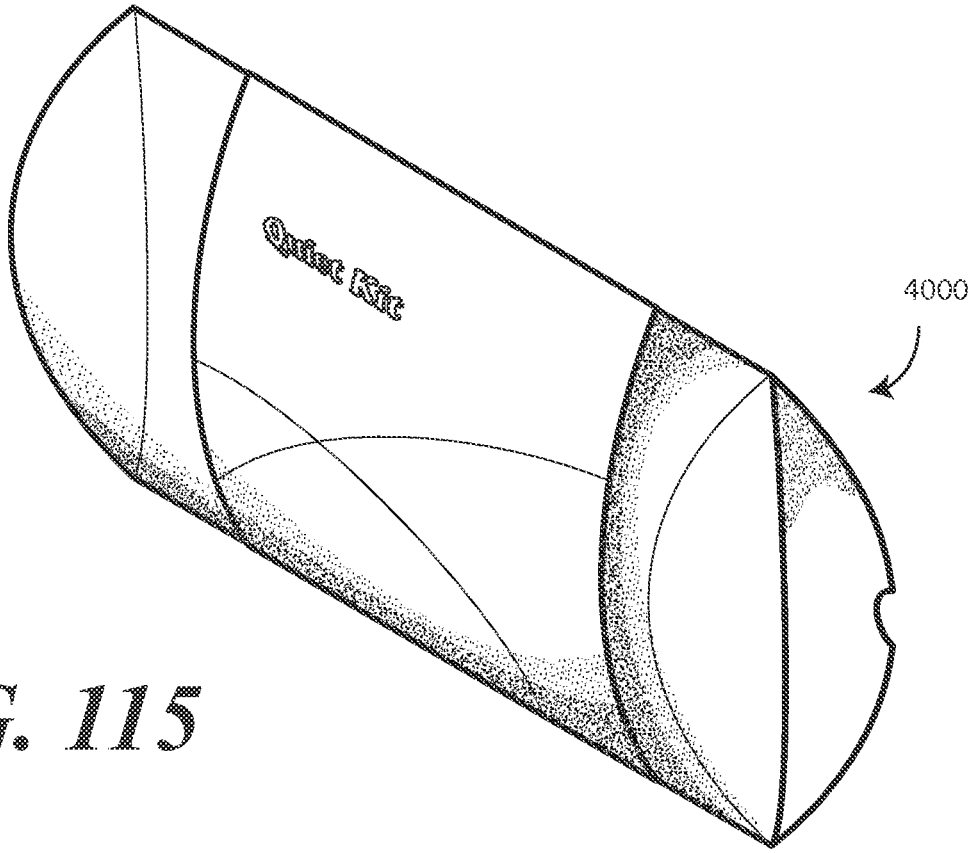
FIG. 115 is another perspective view of another explanatory device in accordance with one or more embodiments of the disclosure that illustrates ornamental design features of the device.
Figure 116:
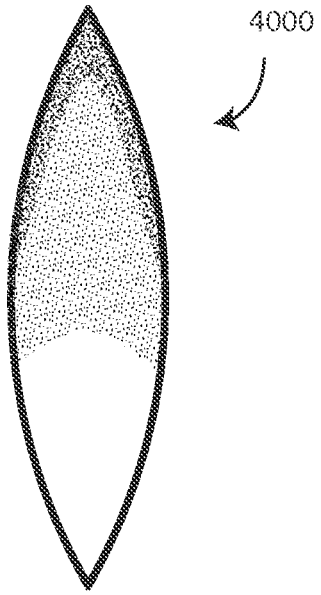
FIG. 116 is another right elevation view of another explanatory device in accordance with one or more embodiments of the disclosure that illustrates ornamental design features of the device.

Just as with the pouches (701, 702) of previous embodiments, the container 4001 can enclose container contents. Turning now to FIG. 56, illustrated therein is one such embodiment. In FIG. 56, the container 4001 is to contain one or more items 5101, 5102, 5103, 5104. In this illustrative embodiment, the pack 4000 is configured as a "Quiet" kit. Accordingly, in one embodiment, the one or more items 5101, 5102, 5103, 5104 are one or more of an eye mask, earplugs, a puzzle book, a healthcare question list, a do not disturb sign, or a pencil. Examples of the puzzle book include crossword puzzles or Sudoku puzzles. In one embodiment, the puzzle book includes both easy and difficult puzzles. A user can employ the pencil to complete the puzzles of the puzzle book. In one embodiment, the healthcare question list includes a predetermined set of questions, such as "What surgery will be performed on me?" or "What steps do I take to properly recover?" Alternatively, in another embodiment the healthcare question list can be a booklet of lined paper upon which the patient can write answers to their own questions.

While numerous utilitarian features of various packs configured in accordance with one or more embodiments of the disclosure have been described above, each pack has associated therewith a multitude of ornamental design features as well. To be sure, some of the elements associated with embodiments of the disclosure provide both functional and ornamental design features. For example, the branding sleeves, while providing functionality of supporting branding and other information, also create a banded ornamental design about the packs. Similarly, the shape of the flaps of containers, while helping to keep the flaps either in the open or closed position, provide a very unique ornamental design for the container as well.

Turning now to FIGS. 57-99, illustrated therein are ornamental design elements of one explanatory pack 700 configured in accordance with one or more embodiments of the disclosure. The pack 700 of FIGS. 57-99 is shown in various configurations. For example, in FIGS. 57-63, the pack 700 is shown with a branding sleeve 3200. In FIGS. 65-72, the pack 700 is shown in a closed position. In FIGS. 73-99, the pack 700 is shown in various open configurations.

Turning now to FIGS. 100-116, illustrated therein are ornamental design elements of another explanatory pack 4000 configured in accordance with one or more embodiments of the disclosure. The pack 4000 of FIGS. 100-116 is shown in various configurations. For example, in FIGS. 100-105, the pack 4000 is shown in a closed position. In FIGS. 106-116, the pack 4000 is shown in various open configurations.

Figure 117:
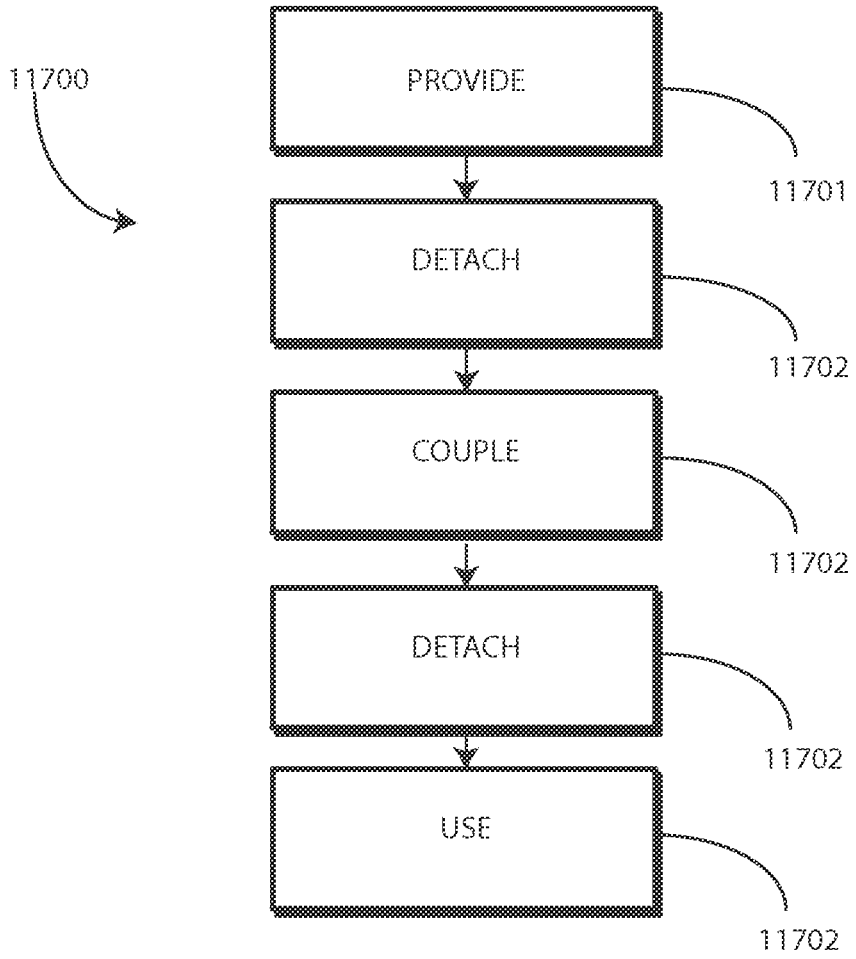
FIG. 117 is a method in accordance with one or more embodiments of the disclosure.

Turning now to FIG. 117, illustrated therein is one explanatory method 11700 configured in accordance with one or more embodiments of the disclosure. At step 11701, the method 11700 provides a care pack. In one embodiment, the care pack comprises a base layer. In one embodiment, the base layer is foldable along at least four transverse folding lines. In one embodiment, a first pouch is selectively detachable from a first major face of the base layer. In one embodiment a second pouch is selectively detachable from the first major face of the base layer. In one embodiment the base layer defines a first end to conceal a bottom end of the second pouch. In one embodiment the base layer defines a second end to fold atop the first end. In one embodiment, a fastening extension extends distally from the second end. In one embodiment, the fastening extension is to couple to a second major face of the base layer to retain the pack in a closed configuration.

At step 11702, the method 11700 detaches the fastening extension from the second major face. At step 11703, the method 11700 couples a fastener of the fastening extension to the first major face to form a hanging loop for the care pack. At step 11704, the method 11700 detaches one or more of the first pouch or the second pouch from the first major face. At step 11705, the method 11700 uses items disposed within one of the pouches.

Figure 118:
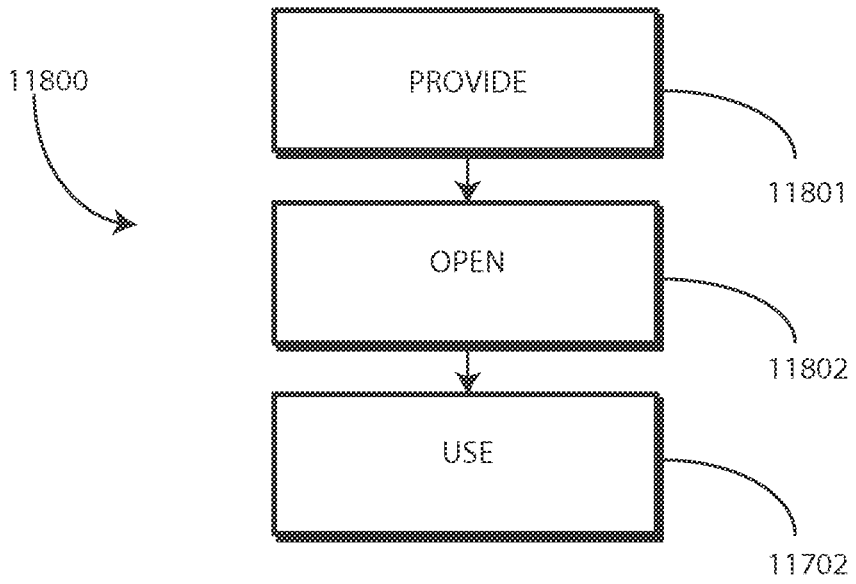
FIG. 118 is another method in accordance with one or more embodiments of the disclosure.

Turning now to FIG. 118, illustrated therein is another method 11800 for using another pack configured in accordance with one or more embodiments of the disclosure. At step 11801, the method 11800 provides a care pack. In one embodiment, the pack includes a container comprising a pair of flaps disposed at each end. In one embodiment, each pair of flaps defines a concave profile relative to the container when in a closed position and a convex profile when in an open position. In one embodiment, the pack includes a branding sleeve disposed about the container. In one embodiment, the branding sleeve comprises indicia of container contents. In one embodiment, the container contents comprise one or more of an eye mask, earplugs, a puzzle book, a healthcare question list, a do not disturb sign, or a pencil. At step 11802, the method 11800 opens a pair of flaps. At step 11803, the method 11800 uses items disposed within one of the pouches.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. For example, while Refresh, Relax, and Quiet kits have been described above, the packs could easily be configured for other applications. A Protect and Prevent Kit to assist one in recovering from radiation therapy may include a cleansing gel, a skin cream, and a skin protectant.

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A pack, comprising:

a base layer, the base layer foldable along at least four transverse folding lines;

a first pouch selectively detachable from a first major face of the base layer, the first pouch disposed between a first transverse folding line and a second transverse folding line;

a second pouch selectively detachable from the first major face of the base layer, the second pouch disposed between a third transverse folding line and a fourth transverse folding line; and a fastening extension;

the base layer defining a first end to fold about the fourth transverse folding line to conceal a bottom end of the second pouch;

the base layer defining a second end to fold about the first transverse folding line atop the first end;

the fastening extension extending distally from the second end, the fastening extension to couple to a second major face of the base layer to retain the pack in a closed configuration.

2. The pack of claim 1, the fastening extension comprising one of a hook fastener or a loop fastener, the second major face comprising a complementary fastener.

3. The pack of claim 2, the first major face comprising another complementary fastener disposed at the second end.

4. The pack of claim 3, the fastening extension to couple to the another complementary fastener to form a hanging loop when the pack is in an open configuration.

5. The pack of claim 4, the second end comprising a stiffener disposed exterior to the first transverse folding line.

6. The pack of claim 5, the first end to fold between the first pouch and the second pouch when the pack is in the closed configuration.

7. The pack of claim 1, further comprising a handle disposed along the second major face between the second transverse folding line and the third transverse folding line.

8. The pack of claim 7, further comprising a branding sleeve disposed about the pack when in the closed configuration, the branding sleeve defining an aperture through which the handle may be accessed.

9. The pack of claim 1, the first pouch and the second pouch each comprising a closure to retain one or more items therein.

10. The pack of claim 9, the one or more items comprising one or more of a cleansing gel, a skin cream, a hand sanitizer, toothpaste, lip balm, or a toothbrush.

11. The pack of claim 10, the one or more items comprising one or more of an eye mask, earplugs, a puzzle book, a healthcare question list, a do not disturb sign, or a pencil.

12. The pack of claim 11, each pouch comprising a single-word identifier of contents disposed within the each pouch, the single-word identifier disposed along an exterior of the each pouch.

13. The pack of claim 12, the single-word identifier one of Refresh or Relax.

14. The pack of claim 9, each pouch transparent.

15. The pack of claim 1, each of the first pouch and the second pouch attached to the first major face by a hook and loop fastener.

16. A method, comprising:

providing a care pack, the care pack comprising:

a base layer, the base layer foldable along at least four transverse folding lines;

a first pouch selectively detachable from a first major face of the base layer;

a second pouch selectively detachable from the first major face of the base layer; and a fastening extension;

the base layer defining a first end to conceal a bottom end of the second pouch;

the base layer defining a second end to fold atop the first end;

the fastening extension extending distally from the second end, the fastening extension to couple to a second major face of the base layer to retain the care pack in a closed configuration;

detaching the fastening extension from the second major face; and coupling a fastener of the fastening extension to the first major face to form a hanging loop for the care pack.

17. The method of claim 16, further comprising detaching one or more of the first pouch or the second pouch from the first major face.

* * * * *